US012539991B2

(12) United States Patent
Cheng

(10) Patent No.: US 12,539,991 B2
(45) Date of Patent: Feb. 3, 2026

(54) METHOD AND SYSTEM FOR CLOSING A RECEPTACLE

(71) Applicant: Paul Po Cheng, London (CA)

(72) Inventor: Paul Po Cheng, London (CA)

( * ) Notice: Subject to any disclaimer, the term of this patent is extended or adjusted under 35 U.S.C. 154(b) by 28 days.

(21) Appl. No.: 18/372,780

(22) Filed: Sep. 26, 2023

(65) Prior Publication Data

US 2024/0101291 A1 Mar. 28, 2024

Related U.S. Application Data

(60) Provisional application No. 63/498,291, filed on Apr. 26, 2023, provisional application No. 63/377,371, filed on Sep. 28, 2022.

(51) Int. Cl.
*B65B 7/28* (2006.01)
*B65D 39/00* (2006.01)

(52) U.S. Cl.
CPC ..... *B65B 7/285* (2013.01); *B65B 7/2821* (2013.01); *B65D 39/00* (2013.01)

(58) Field of Classification Search
None
See application file for complete search history.

(56) References Cited

U.S. PATENT DOCUMENTS

| | | | |
|---|---|---|---|
| 3,222,256 | A | 12/1965 | Fletcher et al. |
| 3,699,297 | A | 10/1972 | Grin et al. |
| 4,865,804 | A | 9/1989 | McGeary et al. |
| 5,401,933 | A | 3/1995 | Yoneda |
| 5,912,935 | A | 6/1999 | Isobe et al. |
| 8,483,346 | B2 | 7/2013 | McCarty et al. |
| 8,811,566 | B2 | 8/2014 | Park et al. |
| 9,646,728 | B2 | 5/2017 | Lee et al. |
| 9,922,731 | B2 | 3/2018 | Lee et al. |
| 10,410,754 | B2 | 9/2019 | Barger et al. |

(Continued)

FOREIGN PATENT DOCUMENTS

| | | | |
|---|---|---|---|
| CA | 741416 | A | 8/1966 |
| CA | 906693 | A | 8/1972 |

(Continued)

OTHER PUBLICATIONS

Partial European Search Report for the corresponding EP Application No. 23199821.2 dated Jan. 25, 2024.

*Primary Examiner* — Chinyere J Rushing-Tucker
(74) *Attorney, Agent, or Firm* — Gowling WLG (Canada) LLP

(57) ABSTRACT

A method of closing an open end of a receptacle having a wall with an inner wall surface. The method includes providing an end element including an internal portion thereof formed for at least partial engagement thereof with the wall. One or more heating elements are provided, for heating a heated layer of the internal portion to a hot working temperature in an inert atmosphere. When the heated layer is at the hot working temperature, an engagement part of the heated layer is engaged with a preselected part of the wall. One or both of the receptacle and the end element are subjected to an engagement motion relative to the other while the engagement part and the preselected part are engaged for plastic deformation thereof, to at least partially bond the heated layer and the wall of the receptacle together to form a gastight container assembly.

15 Claims, 28 Drawing Sheets

(56) References Cited

U.S. PATENT DOCUMENTS

| | | | | |
|---|---|---|---|---|
| 10,475,542 | B2 | 11/2019 | Byers et al. | |
| 10,583,513 | B2 | 3/2020 | Gryaznov et al. | |
| 2017/0206984 | A1 | 7/2017 | Lee et al. | |
| 2020/0118696 | A1 | 4/2020 | Pomilleanu et al. | |
| 2021/0166825 | A1* | 6/2021 | Sheeder | G21C 21/02 |
| 2022/0063849 | A1* | 3/2022 | Hatje | B65B 31/046 |

FOREIGN PATENT DOCUMENTS

| | | | | |
|---|---|---|---|---|
| CN | 10224138 | A | 11/2011 | |
| GB | 816919 | A | 7/1959 | |
| GB | 915652 | A | 1/1963 | |
| GB | 1 085 382 | A | 9/1967 | |
| GB | 1 093 259 | A | 11/1967 | |
| GB | 1 094 564 | A | 12/1967 | |
| GB | 1 132 356 | A | 10/1968 | |
| GB | 1 136 509 | A | 12/1968 | |
| GB | 1 162 842 | A | 8/1969 | |
| JP | H04114872 | A | 4/1992 | |
| WO | 2003/009307 | A1 | 1/2003 | |
| WO | 2004/068503 | A2 | 8/2004 | |
| WO | 2013/087869 | A1 | 6/2013 | |
| WO | WO-2014053433 | A1 * | 4/2014 | B65D 77/067 |
| WO | 2022/237092 | A1 | 11/2022 | |

* cited by examiner

METHOD AND SYSTEM FOR CLOSING A RECEPTACLE

CROSS-REFERENCE TO RELATED APPLICATIONS

This application claims the benefit of U.S. Provisional Patent Application No. 63/377,371, filed on Sep. 28, 2022, and U.S. Provisional Patent Application No. 63/498,291, filed on Apr. 26, 2023, both of which are hereby incorporated herein by reference in their entirety.

FIELD OF THE INVENTION

The present invention is a method and a system for closing an open end of a receptacle.

BACKGROUND OF THE INVENTION

As is well known in the art, welding a metal cap or end piece to a thin-walled metal tube, to close an open end of the tube, may be difficult to achieve because the wall of the tube is relatively thin. The problems are exacerbated if the cap or end piece is made of a metal that differs from the metal of the thin-walled tube.

For example, as illustrated in FIGS. 1A and 1B, an open end of a thin-walled tube (sometimes referred to as a "cladding tube") 10 formed for use in a fuel bundle for a CANDU nuclear reactor may be closed by a prior art plug 12 that fits inside an open end 11A of the tube 10 and that has an external part 16 that is welded to an exterior surface of the tube 10. (It will be understood that the other drawings illustrate embodiments of the invention.)

Typically, the tube 10 has two open ends 11A, 11B when formed. In the example illustrated, the thin-walled tube 10 is formed to receive uranium fuel pellets (not shown) therein. The tube 10 is typically round in cross-section. After the fuel pellets are positioned in the tube, spaces inside the tube between the fuel pellets and the tube are filled with a suitable gas (e.g., helium) that is compressed, in order to provide higher thermal conductivity. After the fuel pellets and a suitable gas are positioned in the tube, the two open ends 11A, 11B of the tube 10 are closed, to provide a "fuel pencil" (not shown).

It is intended that the ends 11A, 11B are to be completely closed or sealed gastight (i.e., fluid-tight), and that the closures are permanent. For a CANDU reactor, a number of the fuel pencils are secured together in a frame to form the fuel bundle having a predetermined size and shape, formed to fit into the reactor. Once the fuel in a fuel bundle is spent, the used fuel bundle is removed from the nuclear reactor and stored.

The used fuel bundles are highly radioactive when first removed from the reactor. Although the radioactivity reduces over time, residual radioactivity and some chemical toxicity is expected to persist for a very long time, e.g., thousands of years. The fuel pencil may therefore have a very long useful life, and as noted above, it is important that the fuel pencil remains sealed gastight throughout its useful life.

As noted above, the tube 10 is a thin-walled tube. A wall 19 of the tube 10 may be, for example, approximately 0.5 mm to 0.8 mm thick. In the prior art, the tube 10 may be made, for example, of a zirconium alloy, e.g., Zircaloy™.

Typically, the plug 12 is made of zirconium, and plugs are secured in each end respectively. Alternatively, the plug 12 may be made of steel or another material. For clarity of illustration, only the open end 11A is shown in FIG. 1B as being closed by the plug 12.

In order to close the open end 11A, first, the plug 12 is moved in the direction indicated by arrow "A" in FIG. 1A to position an internal part 13 of the plug 12 inside the open end 11A. In the prior art, after the internal part 13 is inserted into the open end 11A, an external part 16 of the plug remains exposed, and the external part 16 is then welded to the tube 10 at an end portion 18 thereof that is proximal to the open end 11A (FIG. 1B). Laser or electron beam welding may be used to secure the plug 12 to the tube 10 and to form what is intended to be a gastight seal between the plug 12 and the tube 10. Other conventional types of welding may be utilized.

However, in some instances, conventional welding has been found to result in cracks in the tube 10, primarily in the tube wall 19 at the end portion 18. Also, even if cracks are not present, it is clear that the end portion 18 of the tube 10, and possibly the plug 12 or part thereof, include heat-affected zones (HAZ) and residual stress patterns after conventional welding.

As is well known in the art, the heat-affected zones are areas of weakness at which the weld or the tube 10, or the end plug 12 may fail. The heat-affected zones are the result of heating the metal of the tube and/or the metal of the exposed portion 16 above the melting temperature thereof.

Where conventional welding is utilized, the heat-affected zones develop because, during conventional welding, a part of the end portion 18 of the tube 10 is heated to a temperature greater than its melting temperature. Also, part of the external part 16 may be melted by conventional welding. The melted metal is allowed to cool, to attach the external part to the tube at the end portion 18. Metal that has been melted and allowed to solidify, to attach the external part 16 to the tube 10, is identified by reference character 14 in FIG. 1B. For clarity of illustration, the amount of the re-solidified weld material 14 is exaggerated in FIG. 1B.

In addition to potential loss of a gastight seal of a conventional fuel pencil due to heat-affected zones and residual stress patterns resulting from conventional welding, zirconium-based nuclear fuel cladding has been found to be subject to degradation due to oxidation, hydriding and radiation damage. It is conventionally believed that these effects may be minimized if the weld securing the plug in the tube is located on an exterior of the tube wall.

As is also well known, different types of nuclear reactors require fuel bundles of different designs. Also, different radioactive fuel (i.e., other than uranium pellets) may be used. However, many nuclear reactors use fuel bundles that include fuel pencils including thin-walled cladding tubes that are closed at each end thereof, as described above. Cracking and heat-affected zones may occur after closing open ends of the thin-walled tubes that are used in these fuel bundles in nuclear reactors other than CANDU reactors.

In general, in the absence of corrosion or other deterioration of the tube wall or the plugs, the fuel pencil is unlikely to be subjected to significant pressures during its useful life that might tend to pull or push the plug 12 out of the tube 10, except for the pressure exerted by the compressed gas inside the fuel pencil. However, it can be seen from the foregoing that the thin-walled tube and the plugs that are included in a fuel pencil must retain their physical integrity, first, when in use in the nuclear reactor, and second, when the fuel pencil is included in a spent fuel bundle that is intended to be stored for a very long time. Accordingly, it is important that the end plugs are sealed to the tube, and remain sealed to the tube, to provide a gastight seal over the years the tube is in use.

Containers made of different materials other than those used in the tubes or plugs (e.g., stainless steel) may be used for storage of waste from nuclear power generation operations. The container may, for example, include an open-ended container body and a cap or lid. After the waste is positioned in the container body, the cap or lid is secured to the container body, to provide a gastight seal therebetween. The container body typically is not thin-walled, however, the issues arising in the prior art with respect to closures for the containers are similar to those arising in connection with fuel pencils, described above.

The container body may have a stainless steel wall that is about two or three inches thick, and when a cap or lid is conventionally welded to the container body, one or more heat-affected zones and residual stress patterns typically result. The container body may also degrade for other reasons, e.g., due to radiation damage over an extended period of time.

As with the fuel pencils, it is intended that the lid is to be sealed to the container body with a gastight (i.e., fluid-tight) seal, for a very long time. However, in the prior art, the conventional welding methods typically result in heat-affected zones and residual stress patterns in the container.

SUMMARY OF THE INVENTION

For the foregoing reasons, there is a need for a method and system for closing an open end of a receptacle that overcomes or mitigates one or more of the defects or deficiencies of the prior art.

In its broad aspect, the invention provides a method of closing an open end of a receptacle having a wall with an inner wall surface. The method includes providing an end element including an internal portion thereof formed for at least partial engagement thereof with the inner wall surface. One or more heating elements are provided, for heating a heated layer of the internal portion to a hot working temperature in an inert atmosphere. When the heated layer is at the hot working temperature, an engagement part of the heated layer is engaged with a preselected part of the wall. One or both of the receptacle and the end element are subjected to an engagement motion relative to the other while the engagement part and the preselected part are engaged for plastic deformation thereof, to at least partially bond the heated layer and the wall of the receptacle together to form a gastight container assembly.

In another of its aspects, the invention provides a method of closing an open end of a receptacle having a wall with an outer wall surface. The method includes providing an end element formed for covering the open end of the receptacle. The end element includes a external portion (1028) and an internal portion (1032), the internal portion (1032) comprising a body (1038) having an inner surface (1087) formed to fit over the outer wall surface (1045) of the wall (1019) of the receptacle (1010). The external portion (1028) covering the open end when the inner surface (1087) fits over the preselected portion. The end element also includes one or more fins (1040) mounted to the inner surface (1087), for engagement with the outer wall surface (1045) of the receptacle (1010).

One or more heating elements (1048) are provided, for heating at least engagement parts of the fins. One or more receptacle heating elements (1044) are also provided, for heating, at the preselected portion thereof, a heated wall layer of the receptacle wall (1019). An inert atmosphere covering said at least one fin and the preselected portion of the wall is also provided.

The one or more heating elements are energized, to heat the engagement parts to a hot working temperature, at which the engagement part is at least partially plastically deformable. Also, the one or more receptacle heating elements are energized, to heat the heated layer to the hot working temperature, at which the heated layer is at least partially plastically deformable.

When the engagement parts are at the hot working temperature and the heated layer is at the hot working temperature, the engagement parts and one or more preselected parts of the heated layer are engaged together. While the engagement parts and the preselected parts are engaged with each other, one or both of the end element and the receptacle are subjected to an engagement motion relative to the other, to move one or both of the end element and the receptacle relative to the other for at least partially bonding the end element and the receptacle together to provide a gastight sealed receptacle assembly.

In another of its aspects, the invention provides a method of closing an open end of a receptacle (1210) having a wall with an outer wall surface, the receptacle defining a receptacle axis thereof. The method also includes providing an end element (1212) formed for covering the open end of the receptacle, the end element defining an end element axis thereof. The end element includes a external portion (1228) and an internal portion (1232). The internal portion (1232) includes a body (1238) having an inner wall (1287) formed to fit over a preselected portion (1247) of the outer wall surface (1245) of the receptacle (1210). The external portion covers the open end, when the inner surface fits over the preselected portion.

The receptacle also includes one or more fins (1240) mounted to the preselected portion, for engagement with one or more preselected parts (1225) of the body (1238).

One or more fin heating elements (1244) are provided, for heating at least engagement parts of the one or more fins. Also, one or more heating elements (1248) are provided, for heating the one or more preselected parts of the body (1238). The receptacle and the end element are positioned to align the end element axis with the receptacle axis. An inert atmosphere is also provided, to cover the one or more fins and the preselected portion of the outer wall surface, and to covering the inner wall (1287).

The one or more fin heating elements (1248) are energized, to heat the engagement parts to a hot working temperature, at which the engagement parts are at least partially plastically deformable. Also, the one or more heating elements (1248) are energized, to heat the one or more preselected parts to the hot working temperature, at which the preselected parts are at least partially plastically deformable.

When the engagement parts are at the hot working temperature and the preselected parts are at the hot working temperature, the engagement parts and the preselected parts are urged together. One or both of the end element and the receptacle are subjected to an engagement motion relative to the other, while the engagement parts and the preselected parts are engaged with each other, to move one or both of the end element and the receptacle relative to the other for at least partially bonding the engagement part and said at least one preselected part together, to provide a gastight sealed receptacle assembly.

BRIEF DESCRIPTION OF THE DRAWINGS

The invention will be better understood with reference to the attached drawings, in which.

DETAILED DESCRIPTION

Figure 1A:
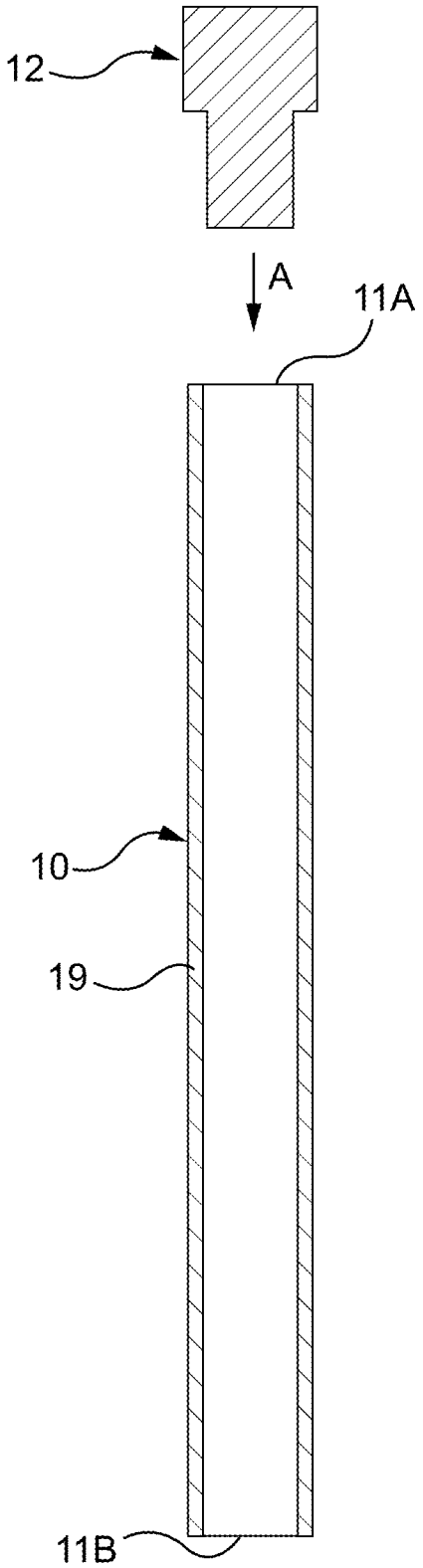
FIG. 1A (PRIOR ART)
FIG. 1A (previously described) is an exploded cross-section of a prior art end plug and a thin-walled tube of the prior art.
Figure 1B:
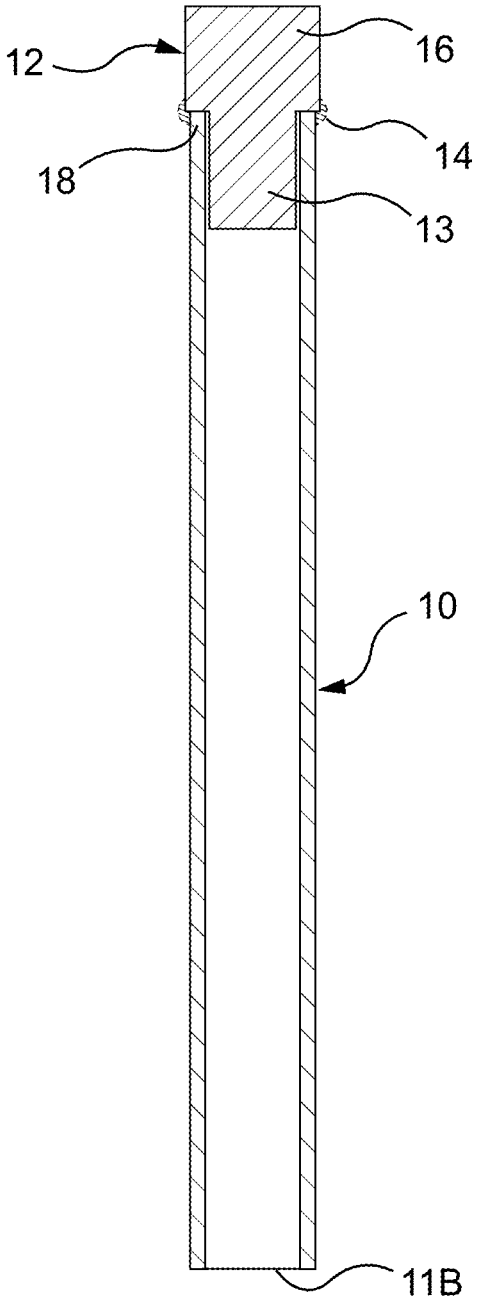
FIG. 1B (PRIOR ART)
FIG. 1B (previously described) is a cross-section of the prior art end plug of FIG. 1A positioned in an end of the tube.
Figure 2A:
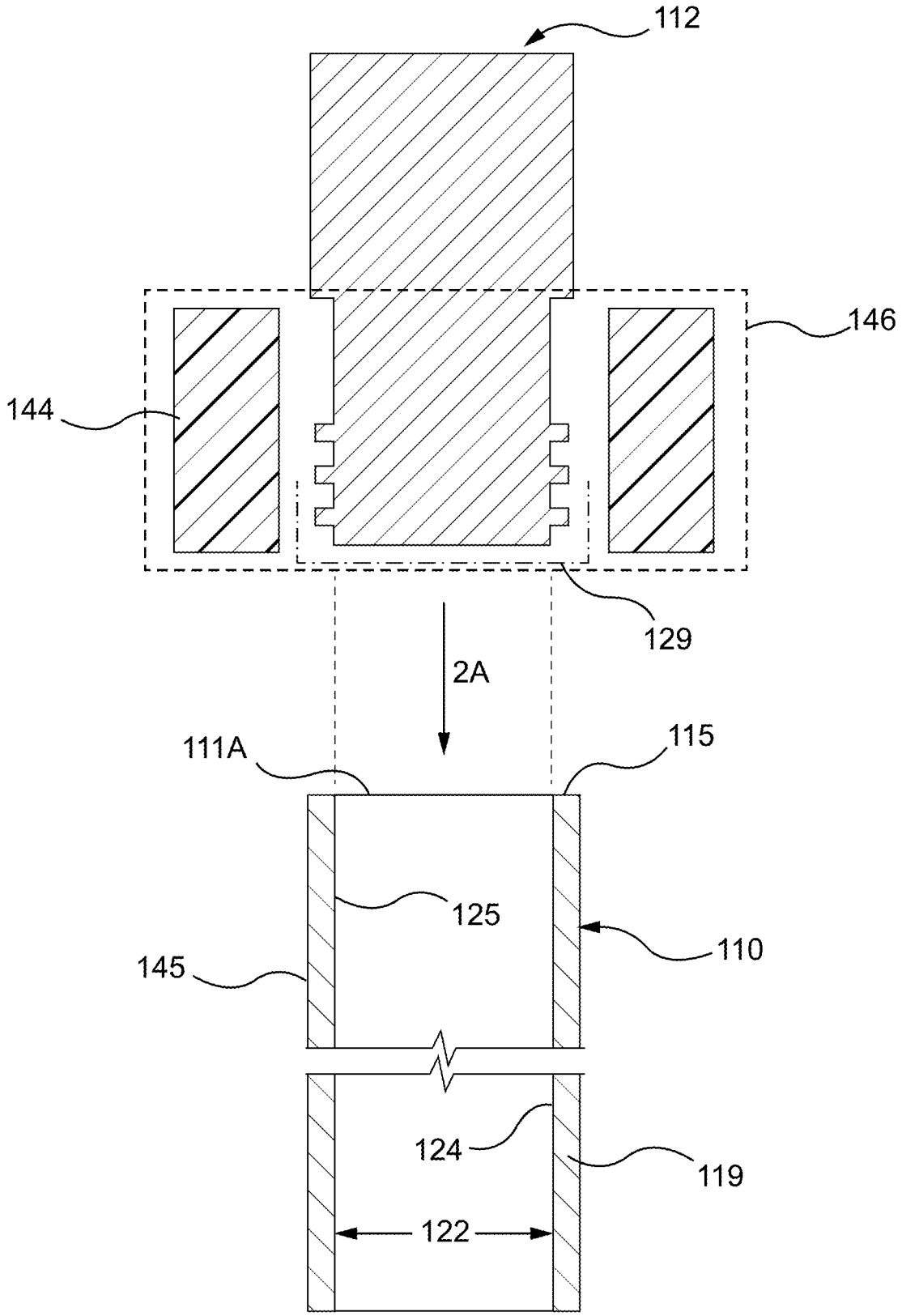
FIG. 2A is a cross-section of an embodiment of an end element of the invention and a cross-section of a receptacle in which the end element is partially receivable.

In the attached drawings, like reference characters designate corresponding elements throughout. In particular, to simplify the description, the reference characters previously used in FIGS. 1A and 1B in describing the prior art are used again in connection with the description of the invention hereinafter, except that each such reference character is increased by 100 (or by whole number multiples thereof, as the case may be), where the elements described correspond to the elements illustrated in FIGS. 1A and 1B. Reference is first made to FIGS. 2A-2E to describe an embodiment of a method of closing an open end 111A of a receptacle 110. The receptacle 110 has a wall 119 with an inner wall surface 124 that defines an inner diameter 122. The inner diameter 122 also defines a receptacle axis "Y" (FIGS. 2A, 2C).

In one embodiment, the method includes providing an end element or plug 112 that defines an end element axis "X" thereof.

As will be described, the end element 112 is for closing an open end 111A of the receptacle 110. The receptacle 110 may, for instance, be in the form of a tube, as illustrated in FIGS. 2A-2E. As can be seen in FIG. 2A, the receptacle wall 119 also has an outer diameter 126. The open end 111A is located at a selected end 115 of the tube 110. It will be understood that although the tube 110 initially has two open ends, closing only one open end is described herein, to simplify the description. It will also be understood that the other open end preferably is closed using another end plug, utilizing the method of the invention described herein. In one embodiment, the tube 110 preferably is round in cross-section, and defines a longitudinal axis "Y" thereof (FIG. 2A).

Figure 2B:
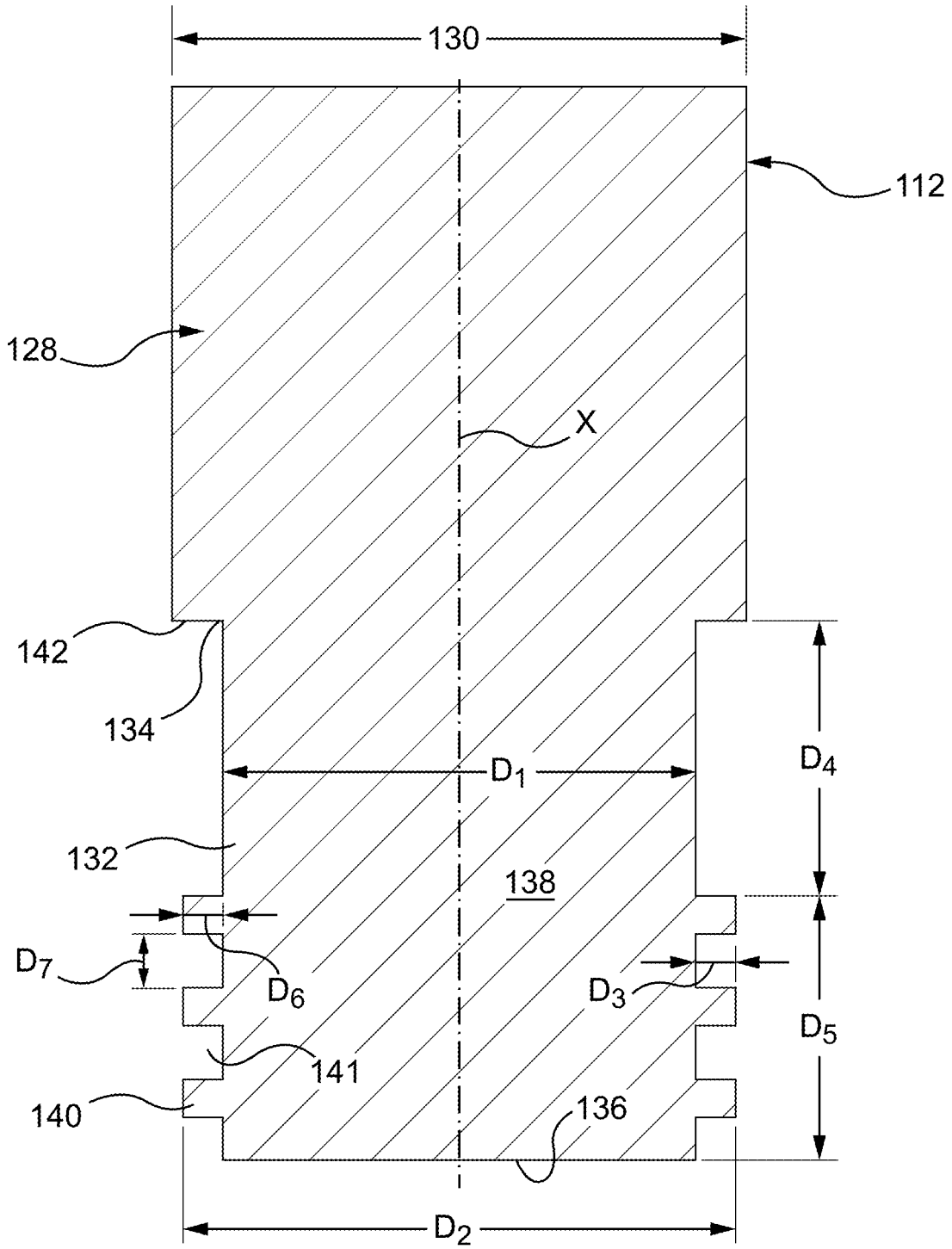
FIG. 2B is a cross-section of the end element of FIG. 2A, drawn at a larger scale.
Figure 2C:
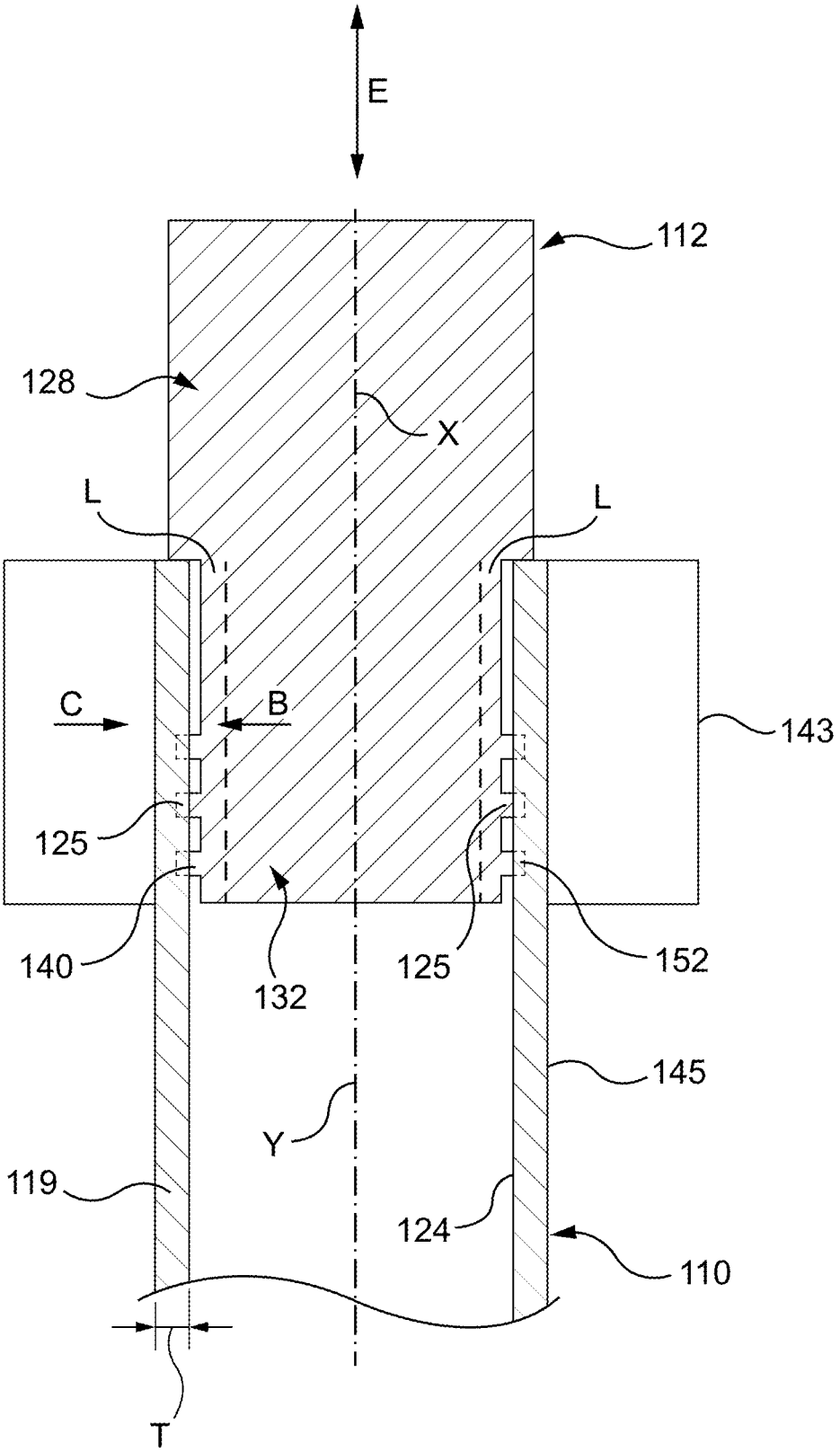
FIG. 2C is a cross-section of the end element of FIG. 2B showing an internal portion of the end element positioned in the receptacle.

In one embodiment, the end plug 112 preferably includes an external portion 128 having one or more external portion diameters 130 that are greater than the inner diameter 122 of the receptacle 110 (FIG. 2B). As will be described, the end plug 112 preferably also includes an internal portion 132 formed for at least partial engagement thereof with the inner wall surface 124 (FIG. 2B).

Preferably, the internal portion 132 extends between an outer end 134 located at the external portion 128 and an inner end 136 thereof, located distal to the external portion 128 (FIG. 2B). As can be seen in FIG. 2B, the internal and external portions 132, 128 preferably define the end element axis "X".

One or more heating elements 144 preferably are provided, for heating the internal portion 132. In addition, an inert atmosphere is provided that covers the internal portion 132 and a preselected part 125 of the wall 119 that is partially included in the inner wall surface 124.

Figure 2D:
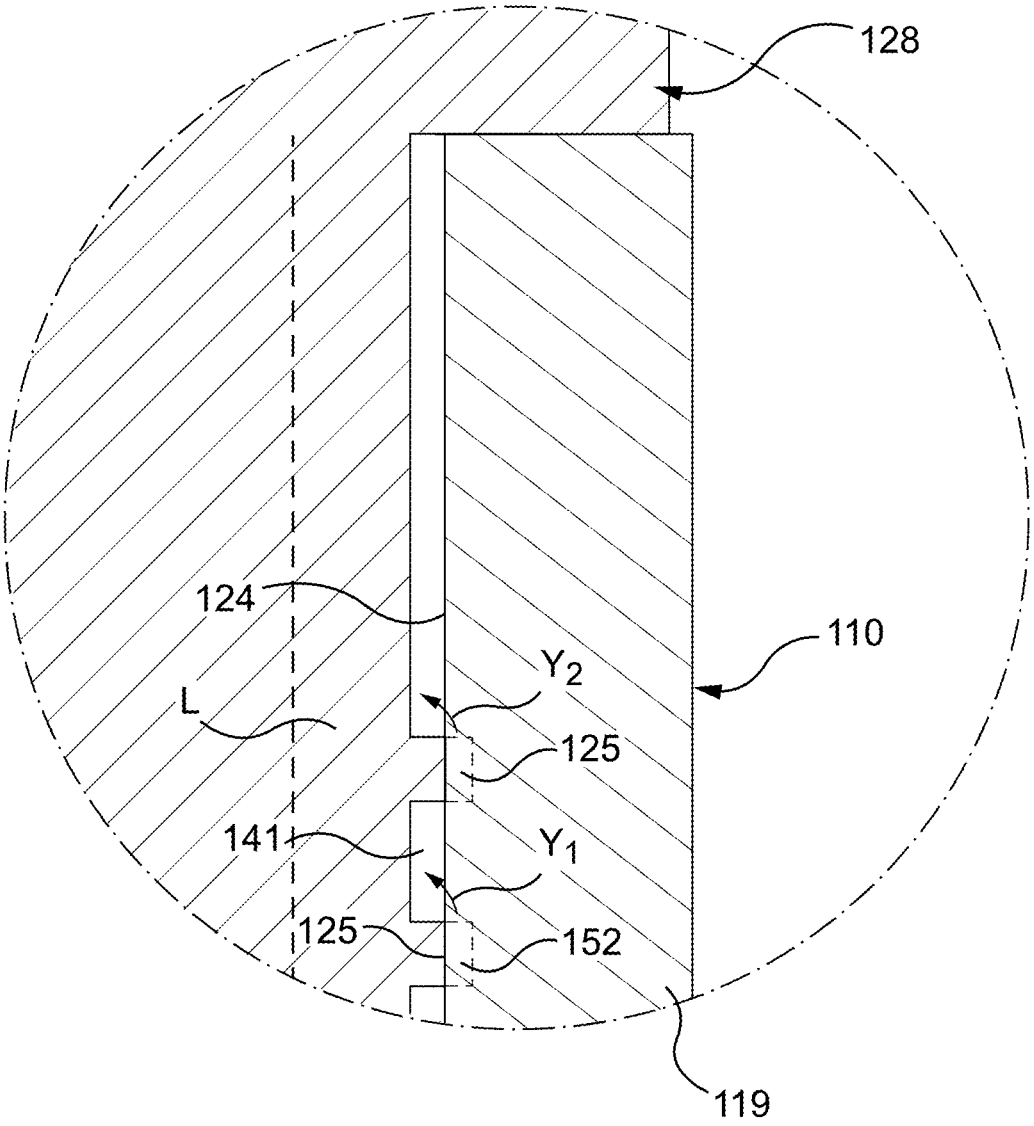
FIG. 2D is a portion of the drawing of FIG. 2C, drawn at a larger scale.

Preferably, the heating element (144) is energized, to heat one or more heated layers "L" of the internal portion 132 to a hot working temperature, at which the heated layer "L" is at least partially plastically deformable (FIGS. 2C, 2D). Those skilled in the art would appreciate that the hot working temperature is below the melting temperature of the metal of the end element 112. The heated layer "L" is not heated to a temperature above the hot working temperature. It will be understood that, for the purposes hereof, the term "hot working temperature" may refer to a range of temperatures that are below the melting temperature at which the heated layer "L" is partially plastically deformable.

When the heated layer is at the hot working temperature, at least an engagement part 152 of the heated layer "L" is engaged with at least the preselected part 125 of the wall (119). One or both of the receptacle 110 and the end element 112 are subjected to an engagement motion relative to the other while the engagement part 152 and the preselected part 125 are engaged with each other, for plastic deformation thereof. The engagement motion while the heated layer "L" is at the hot working temperature, and while the engagement part 125 and the preselected part are engaged, causes the heated layer "L" and the wall 119 to be bonded together, to form a gastight container assembly 127 (FIG. 2C).

In one embodiment, while the heated layer "L" is at the hot working temperature, and prior to engagement, one or both of the receptacle 110 and the end element 112 preferably are subjected to a translocation motion for locating the internal portion 132 in the receptacle 110, to engage the engagement part 152 of the heated layer with the preselected part 125 of the wall 119.

Those skilled in the art would appreciate that, in practice, the end element 112 preferably is held by an adiabatic holding fixture 129 while the heated layer "L" is heated by the heating element(s) 144. It will be understood that the adiabatic holding fixture 129 is only schematically represented in FIG. 2A.

Those skilled in the art would also appreciate that after the heating element 144 has heated the heated layer "L" to the hot working temperature, the adiabatic holding fixture 129 and the heating element 144 preferably are moved away from the internal portion 132, to permit the end element 112 to be moved to the receptacle 110 (i.e., subjected to the translocation motion), for engagement. Preferably, prior to subjecting one or both of the receptacle 110 and the end element 112 to the translocation motion, the receptacle 110 and the end element 112 are positioned relative to each other to align the end element axis "X" and the receptacle axis "Y" (FIG. 2B).

In one embodiment, the end element 112 and the receptacle 110 are positioned relative to each other to align their respective axes "X", "Y" prior to energizing the heating element 144.

In one embodiment, when the engagement part 152 is engaged with the preselected part 125, the end element 112 preferably is urged in the axial direction into the receptacle 110. It will be understood that, preferably, the end element 112 is continuously urged in the axial direction toward the receptacle 110 while one or both of the end element 112 and the receptacle 110 are subjected to the engagement motion, until the engagement motion ceases, as will also be described.

Those skilled in the art would appreciate that initiating engagement motion prior to engaging the engagement part 152 and the preselected part 125 may be advantageous, because in these circumstances less energy would be required to effect the engagement motion, and the wall of the receptacle would be subjected to less stress upon engagement. Accordingly, in one embodiment, the end element 112 preferably is subjected to the engagement motion before the engagement part 152 of the heated layer "L" is engaged with the preselected part 125 of the wall 119. It is therefore preferred that the end element is subject to the engagement motion while the end element 112 is subjected to the translocation motion.

Any motion of one or both of the end element 112 and the receptacle 110 relative to the other may be a suitable engagement motion. For example, the end element 112 may be rotated relative to the receptacle 110 about the end element axis "X" to provide the engagement motion. Such rotation may be in one or both directions, i.e., the engagement motion may be an oscillation motion about the end element axis. Alternatively, or in addition, the end element may be moved in the axial direction relative to the receptacle 110 while the engagement part 152 is at least partially engaged with the preselected part 125 to provide the engagement motion.

The engagement motion may be regularly repeated (i.e., repeated at preselected time intervals) or irregularly or randomly repeated. Because the internal portion 132 and the external portion 128 are formed or secured together, as a practical matter, the entire end element 112 preferably is subjected to the translocation motion and to the engagement motion.

Before or after the heated layer "L" is heated to the hot working temperature, the end plug 112 preferably is positioned so that the respective axes "X", "Y" of the end plug 112 and the tube 110 are aligned. While the heated layer "L" is at the hot working temperature, the plug 112 preferably is pushed into the open end 111A of the tube 110, i.e., the plug 112 preferably is pushed into the tube 110 in the direction indicted by arrow "2A" in FIG. 2A, engaging the engagement part 152 of the heated layer "L" with the preselected part 125 of the wall 119.

Figure 2E:
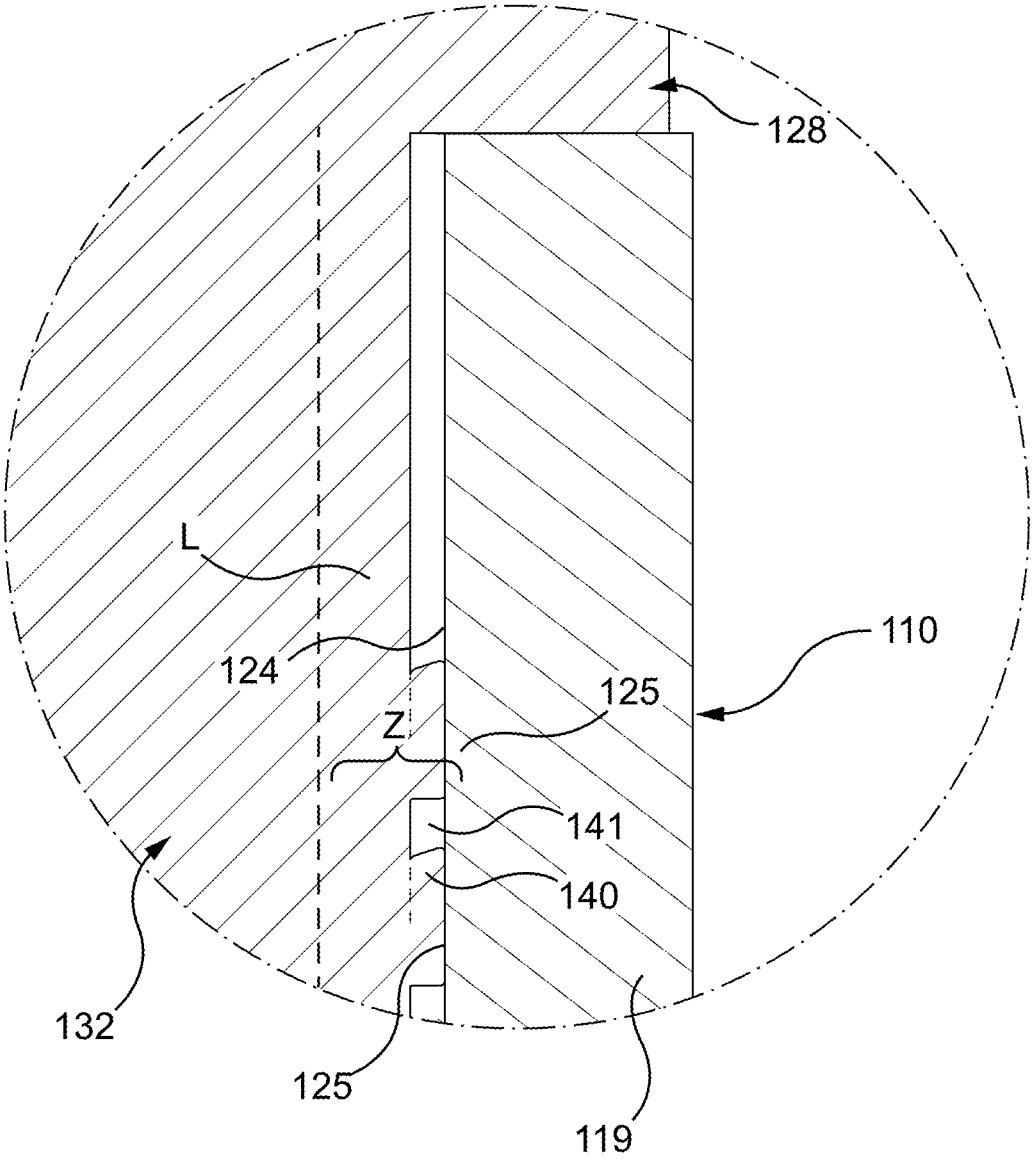
FIG. 2E is a cross-section showing parts of the internal portion received in indentations, bonded to the receptacle.

In one embodiment, the internal portion 132 preferably includes a body element 138 and one or more projecting elements 140 extending radially outwardly from the body element 138 relative to the end element axis "X". As will be described, the projecting element 140 preferably is at least partially included in the heated layer "L". Preferably, the projecting element 140 includes the engagement part 152 (FIGS. 2C-2E).

As can be seen in FIGS. 2B and 2C, each of the projecting elements 140 at least partially defines one or more recesses 141 located adjacent to the projecting elements 140. When the engagement part 152 is engaged with the preselected part 125 of the wall 119, the engagement part 152 preferably is at least partially moved into the adjacent recess 141, as will also be described.

Those skilled in the art would appreciate that, as the end element 112 is moved into the receptacle 110 (in the direction indicated by arrow "2A" in FIG. 2A) and the hot engagement part 152 in a particular projecting element 140 engages the preselected part 125, the engagement part 152, which is at least partially plastically deformable, is pushed in part into the recess 141 adjacent to that particular projecting element 140.

Preferably, the projecting elements 140 and the respective recesses 141 adjacent thereto are relatively small, in relation to the body 138. It will be understood that the sizes of the projecting elements 140 and the recesses 141 are exaggerated in FIGS. 2A-2E, for clarity of illustration.

As can be seen in FIGS. 2C and 2D, the projecting elements 140 preferably are at least partially in the heated layer "L". It will be understood that the width of the heated layer "L" as illustrated in FIGS. 2C and 2D is also exaggerated, for clarity of illustration.

As described above, the heating preferably is effected by the energized heating element 144, e.g., by induction heating, in an inert atmosphere. Preferably, one or more heating elements 144 configured for induction heating are provided (FIG. 2A). However, the heating may be effected by any suitable means. The heating element 144 preferably is configured to heat the heated layer "L" of the internal portion 132 to the hot working temperature. In practice, small parts of the body element 138 and the external portion 128 may also be indirectly heated, to a limited extent, but not to the hot working temperature.

It is also preferred that the internal portion 132 is covered by an inert (non-oxidizing) atmosphere, when the heating elements 144 are energized, and also while the internal portion 132 engages the inner wall surface 124 of the tube 110. In practice, the inert atmosphere may cover the entire inner wall surface 124 and the entire end plug 112. The inert atmosphere may be contained within a suitable container or hood, schematically indicated by dashed lines 146 in FIG. 2A. Those skilled in the art would be aware of a suitable inert atmosphere, and a suitable container or hood.

Once the heated layer "L" is at the hot working temperature, the one or more heating elements 144 are de-energized, and removed. The adiabatic holding fixture 129 is also removed. While the heated layer "L" is still at the hot working temperature, the internal portion 132 preferably is subjected to a translocation motion, and moved into the open end (i.e., in the direction indicated by arrow "2A" in FIG. 2A), to engage the projecting elements 140 with the preselected parts(s) of the wall 119 of the tube 110.

It will be understood that the internal portion 132 and the preselected part 125 of the inner surface 124 that is to be engaged with the engagement part(s) 152 of the internal portion 132 remain covered by the inert atmosphere until the internal portion 132 and the wall 119 are fused together, as will be described.

As noted above, in one embodiment, the engagement motion may commence before, or when, the translocation motion commences. Alternatively, the engagement motion may commence only upon engagement of the engagement parts 152 of the internal portion 132 with the preselected parts(s) 125 of the inner surface 124. As will be described, the engagement motion preferably continues after engagement, until the internal portion 132 and the tube 110 are fused or bonded together.

It will be understood that the engagement motion may involve any suitable movement of the internal portion 132 relative to the tube wall 119 upon engagement.

In one embodiment, the end plug 112 preferably is moved by the translocation motion into the open end (i.e., in the direction indicated by arrow "2A") until an engagement face 142 (FIG. 2B) of the external portion 128 abuts the tube 110, at the end 115 thereof (FIG. 2A). As can be seen in FIG. 2C, the engagement parts 152 of the projecting elements 140 of the internal portion 132 are initially plastically deformed as the internal portion 132 moves into the tube 110, before the engagement face 142 engages the end 115 of the tube 110. Such initial plastic deformation, taking place while the end element 112 is moving into the receptacle 110, is due to the translocation motion. If the end element 112 is also subjected to the engagement motion while it is subject to the translocation motion, then the initial plastic deformation that takes place while the end element 112 is moving into the receptacle 110 is also due to the simultaneous engagement motion.

It will be understood that the plug 112 is subject to the engagement motion after the translocation motion has stopped. It will also be understood that, after the engagement face 142 engages the end 115, the plug 112 preferably is still urged in the direction indicated by arrow "2A", while the plug 112 is also simultaneously subjected to the engagement motion. The engagement motion causes the crystalline microstructure of the engagement part(s) 152 and of the preselected part(s) 125 to shear, and to be formed into a substantially uniform microstructure across the engagement parts 152 and the preselected part(s) 125. Due to shearing, the engagement motion also adds heat to the engagement parts 152 and the preselected parts 125. The engagement motion stops when the internal portion 132 is bonded or fused with the wall 119. When the engagement motion stops, the pressure urging the plug 112 in the direction indicated by arrow "2A" also ceases.

Preferably, when the engagement parts 152 engage the preselected part(s) 125, only a light pressure is required to be applied (i.e., in a light drive fit) in the direction indicated by arrow "2A" in FIG. 2A in order to plastically deform the engagement parts 152 of the heated layer "L" and to push the end plug 112 into the tube, until the engagement face 142 abuts the tube 110 at the end 115 thereof. In FIGS. 2C and 2D, the internal portion 132 is shown in its fully inserted position, in which the engagement face 142 engages the end 115.

Those skilled in the art would appreciate that, because the wall 119 of the tube 110 is a relatively thin wall, the pressure or force applied to the end plug 112 to cause it to move in the direction indicated by arrow "2A" (i.e., to initiate and continue the translocation motion), and also the pressure or force applied to urge the engagement face 142 against the tube end 115 once the engagement face 142 has engaged the end 115, preferably is a relatively low pressure. Also, as will be described, a clamp or sleeve 143 may be engaged with the wall 119 proximal to the end 115, to support the wall 119.

It is preferred that the internal portion 132 is subjected to the engagement motion at the same time as the internal portion 132 is subjected to the translocation motion and moved into engagement with the inner wall surface 124. As noted above, the engagement motion preferably continues after initial engagement of the engagement parts 152 with the preselected parts 125 of the wall 119, and the end plug 112 continues to be urged in the direction indicated by arrow "2A", until the internal portion 132 and the tube 110 are fused together.

When the internal portion 132 is moved into the tube 110, the hot, plastically deformable engagement part 152 of each of the projecting elements 140 engages the preselected part(s) 125 of the wall 119, and each of the engagement parts 152 is at least partially plastically deformed by its engagement with the preselected part 125 of the wall 119. Each of the engagement parts 152 preferably is at least partially receivable in the recess 141 that is immediately downstream from the projecting element 140 in which each of the engagement parts 152 is respectively included, when each of the engagement parts 152 is respectively plastically deformed, for bonding engagement of the engagement parts 152 with the wall 119 of the tube 110.

It will be understood that "downstream" as used herein is in relation to the translocation movement of the plug 112, which is in the direction indicated by arrow "2A". Each engagement part 152 is partially pushed in a downstream direction opposite to the direction indicated by arrow "2A" into the indentation or space 141 that is immediately adjacent to and downstream from the projecting element 140 that includes the plastically deformable engagement part 152. As examples, the movement of at least portions 131 of the deformed parts 152 into respective downstream recesses 141 adjacent thereto is schematically represented by arrows "$Y_1$" and "$Y_2$" in FIG. 2D.

Those skilled in the art would appreciate that, because the wall 119 is relatively thin, it is preferred that very little pressure or force is applied to push the end plug 112 into the tube 110, in the direction indicated by arrow "2A". Rotating or oscillating the plug about the axis "X" as the plug 112 is moved into the tube 110 may tend to decrease the force or pressure required to be applied axially. Preferably, the portions 131 of the deformed engagement parts 152 that are pushed into the respective recesses 141 are relatively small. It will be understood that the size of the deformed engagement part 152 relative to the insert portion 132 is exaggerated in FIG. 2C, for clarity of illustration.

From the foregoing, it can be seen that including a number of relatively small (i.e., relatively thin, and relatively short) projections 140 in the internal portion 132 has the benefit of limiting the torque and pressure required to be applied to the plug 132 (for engagement motion and for translocation motion) to relatively low torque and pressure. Preferably, more than one relatively small projections 140 are provided, to consistently achieve a gastight seal.

As described above, the heated layer "L" of the internal portion 132 of the end plug 112 preferably is heated by the heating element 144 to the hot working temperature. However, in one embodiment, the wall 119 of the tube 110 is not directly heated by the heating element 144. When the engagement parts 152 (which are initially at the hot working temperature) engage the preselected part(s) 125 of the tube wall 119, heat is, to an extent, transferred therefrom to the wall 119 by conduction. The preselected parts 125 may also be heated to an extent by friction, due to the engagement motion that takes place when the engagement parts 152 and the preselected parts 125 are engaged.

As noted above, the body element 138 may be heated to an extent by the heating element 144. When this occurs, some of the heat stored in the body element 138 may also be transferred, to an extent, to the preselected part(s) 125 of the wall 119 by radiation of heat from the body element 138, when the engagement parts 152 engage the preselected part(s) 125. As is also noted above, some heat may also be transferred by conduction from the engagement parts 152 to the preselected part(s) 125, upon engagement.

Accordingly, when the engagement parts 152 (which are at the hot working temperature) engage the preselected part(s) 125, the preselected parts 125 may be at elevated temperatures, for a short time period. However, it will be understood that such elevated temperatures are below the hot working temperature.

Due to the engagement motion of the internal portion 132 upon engagement of the engagement parts 152 with the preselected parts 125 and immediately thereafter, while the engagement parts 152 are at the hot working temperature and the preselected part 125 is at the elevated temperature, the engagement parts 152 and the preselected part 125 are bonded together. It will be understood that the preselected part 125 is relatively small, and its extent has been exaggerated in FIG. 2E, for clarity of illustration.

During engagement, due to the engagement motion, at least a portion of the plastically deformed part 152 bonds with the metal at the preselected part(s) 125 of the wall 119 upon cooling and recrystallization. Accordingly, the method of the invention results in the tube 110 and the internal portion 132 being fused together. Because the heated layer "L" of the internal portion 132 is only heated to the hot working temperature (i.e., a temperature below the metal's melting temperature), the process of the invention does not result in heat-affected zones in the fused-together internal portion 132 and the tube wall 119. Specifically, the method of the invention results in a metallically bonded zone (identified for convenience by reference character "Z" in FIG. 2E) at which the end plug and the tube wall are bonded together, and in which bonded zone the metal has a substantially uniform crystalline microstructure.

It will be understood that the width of the zone "Z" as illustrated in FIG. 2E is exaggerated, for clarity of illustration.

In one embodiment, the method of the invention preferably additionally includes providing the clamp or sleeve 143 (FIG. 2C) that engages an outer surface 145 of the wall 119 of the tube 110, to support the wall 119 at the locations thereon where the parts 152 of the end plug 110 partially push radially outwardly, when the insert portion 132 is inserted. As illustrated in FIG. 2C, the radially outwardly-directed force (schematically represented in FIG. 2C by arrow "B") resulting from insertion of the insert portion 132 into the open end 111A of the tube 110 is opposed by the clamp or sleeve 143, which in response exerts an equal and opposite force (schematically represented in FIG. 2C by arrow "C"), to support the wall 119. It is believed that the clamp 143, when used, may reduce the risk that the tube wall 119 may crumple or fracture upon the insertion of the insert portion 132 into the open end 111A of the tube 110. It is preferred that the clamp 143 is insulated, so that it does not act as a heat sink when the engagement parts 152 (which initially are at the hot working temperature) are engaged with the preselected parts 125 of the wall 119. Preferably, the clamp 143 is removable once the insertion of the internal portion 132 has been completed, and the internal portion and the tube are bonded together.

Those skilled in the art would appreciate that the wall 119 may have any suitable thickness. As an example, and as noted above, the wall 119 may have a thickness "T" of approximately 0.5 mm (FIG. 2C). Those skilled in the art would appreciate that, in determining the extent to which the internal portion 132 should engage the inner surface 124 of the wall 119, the relative thinness of the wall 119 is taken into account.

As noted above, it is preferred that the projecting elements 140 and the engagement parts 152 that are plastically deformed are relatively small in relation to the body element 138 of the internal portion 132. If a relatively larger part of the internal portion 132 were engaged with the inner surface 124, then correspondingly greater force would be required to locate the internal portion 132 fully inside the end. A force or pressure directed as indicated by arrow "2A" that is excessive may cause the wall 119 to buckle or fail. Accordingly, those skilled in the art would appreciate that, in practice, the deformed part 152 preferably has a relatively small volume, compared to the volume of the body element 138. Those skilled in the art would also appreciate that when the clamp 143 is used to support the wall 119, a somewhat greater force may be used to push the insert portion 132 in the direction indicated by arrow "2A" into the tube 110 than would otherwise be acceptable.

In an electro-thermal analysis, induction heating of the projecting elements 140 was simulated, or modeled, to determine, among other things, how quickly the projecting elements 140 could be heated to the hot working temperature. For the purpose of the computer simulation of the analysis, the end element 112 was assumed to have the configuration shown in FIG. 2B, and certain dimensions thereof were assumed to be approximately as follows.

The external portion diameter 130 is 13.4 mm.

An inner diameter "$D_1$" of the body element 138 is 11.3 mm.

An outer diameter "$D_2$" of the internal portion 132 is 13.3 mm.

Each of the projecting elements 140 extends a distance "$D_3$" of 1 mm from the body element 138.

A distance "$D_4$" between the engagement surface 142 and the projecting element 140 that is closest to the engagement surface 142 is 5 mm.

The overall length of the internal portion 132, between its outer and inner ends 136, 134, is 11 mm. The projecting elements 140 and the recesses 141 are located over a distance "$D_5$" of 6 mm.

Each projecting element 140 extends a distance "$D_6$" from the body element 138 of 1 mm.

Each of the projecting elements 140 is spaced apart from the next projecting element 140 by a distance "$D_7$" of 1 mm.

It will be understood that the foregoing dimensions are exemplary only. It will also be understood that the dimensions of the projecting elements 140 and the recesses 141 therebetween are the dimensions thereof prior to the end element 112 being inserted into the tube 110, resulting in plastic deformation of the projecting elements 140.

The end element 112 was also assumed, for the purposes of simulation, to be made of Zircaloy™. In the simulation, the fins or projecting elements 140 were heated in an inert (non-oxiding) atmosphere to a hot working temperature of 1600° C.

The computer simulation demonstrated that one or more of the projecting elements 140 may be heated to the hot working temperature of about 1600° C. within about three seconds. In that time period, at least one of the projecting elements 140 was heated to the hot working temperature, and the body 138 was, to a distance of about 0.75 mm into the body, significantly heated.

Figure 3A:
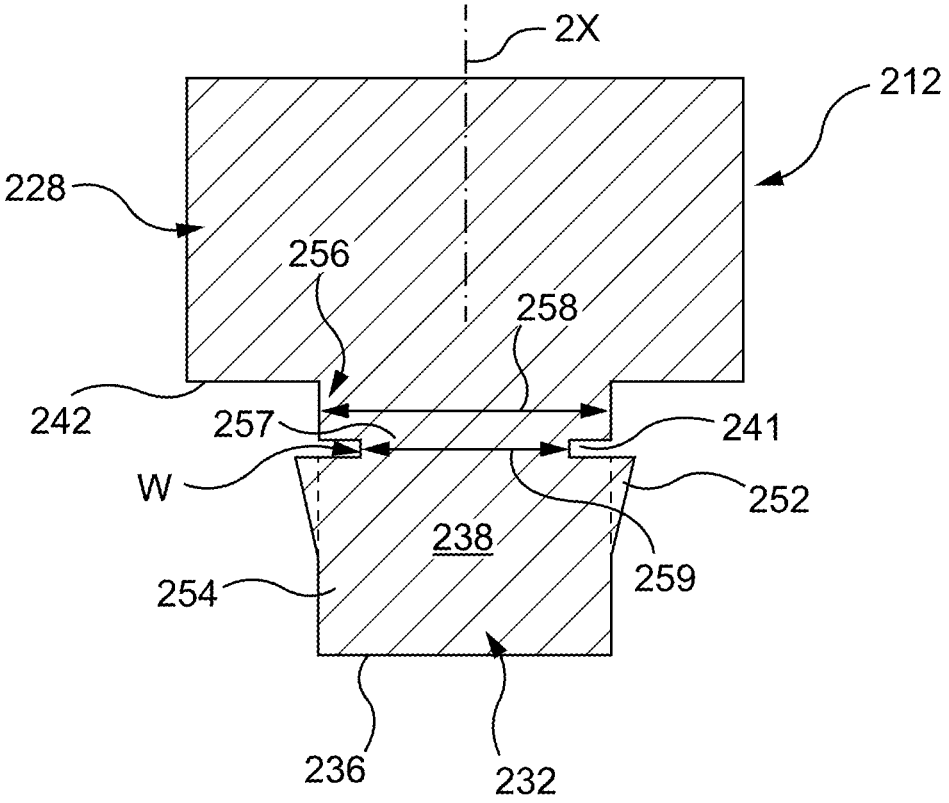
FIG. 3A is a cross-section of another embodiment of the end element of the invention, drawn at a smaller scale.
Figure 3B:
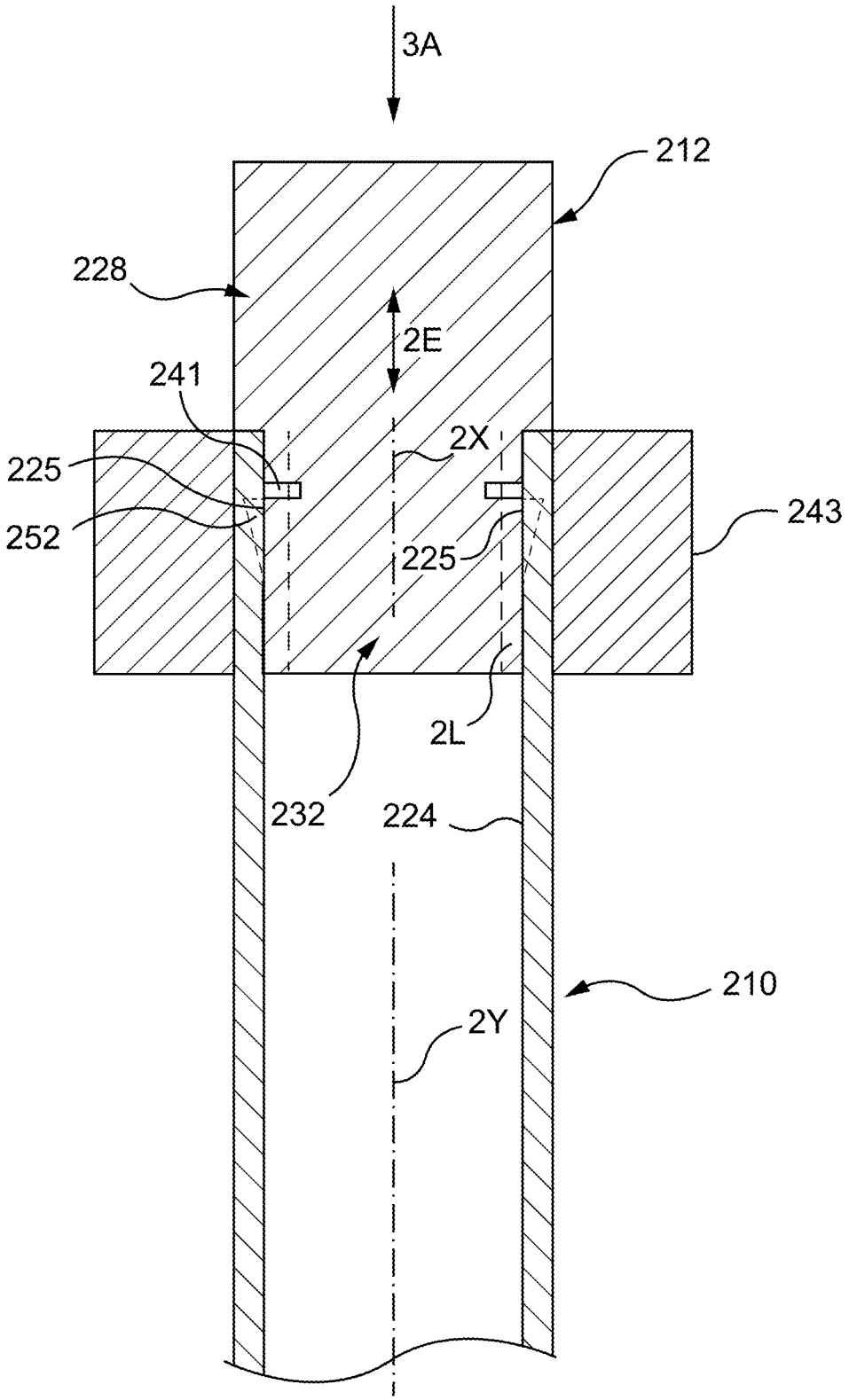
FIG. 3B is a cross-section of the end element of FIG. 3A, with the internal portion thereof positioned in the receptacle.
Figure 3C:
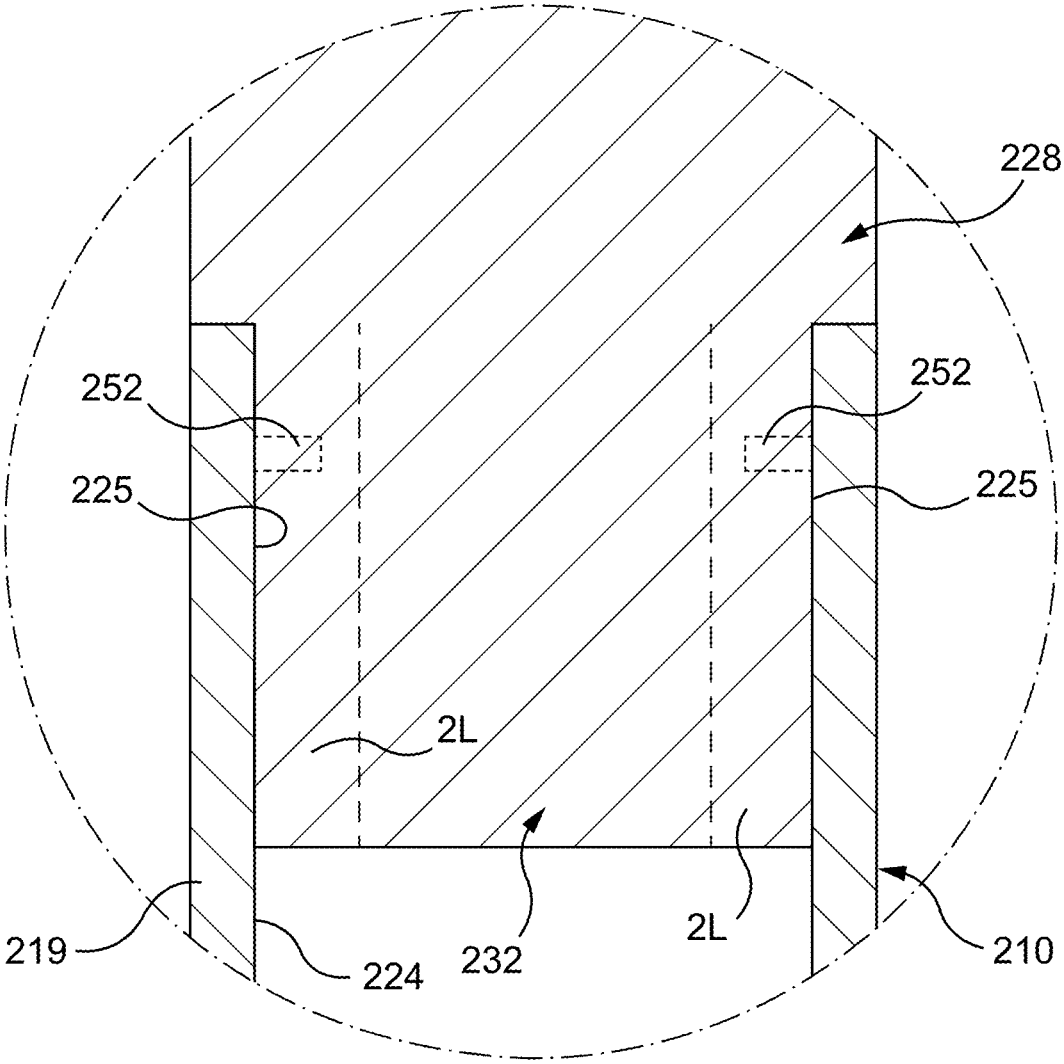
FIG. 3C is a cross-section of the end element and the receptacle of FIG. 3B showing parts of the internal portion received in the indentations, bonded to the receptacle.

An alternative embodiment of the end plug 212 of the invention is illustrated in FIGS. 3A-3C. As will be described, the end plug 212 is formed to define an indentation 241 in which one or more plastically deformable parts 252 of an internal portion 232 of the plug are at least partially receivable, when plastically deformed. The internal portion 232 also includes a body element 238 from which the parts 252 extend.

In one embodiment, the internal portion 232 includes a first segment 254 and a second segment 256. The second segment 256 extends between the external portion 228 and an inner end 257 thereof (FIG. 3A). The first segment 254 extends between the second segment 256 and an inner end 236 of the first segment 254. The first segment 254 includes the body element 238.

The external portion 228 includes an engagement face 242, positioned adjacent to the second segment 256.

Preferably, the second segment 256 has a second segment diameter 258 that is approximately the same as the diameter of the body element 238 (FIG. 3A). As can be seen in FIG. 2A, the first segment 254 preferably includes a bridge portion "W" having a diameter 259 that is less than the diameter 258, to partially define the indentation 241.

In this embodiment, heating elements (not shown) heat a heated layer "2L" of the internal portion to the hot working temperature, in an inert atmosphere. It will be understood that the size of the heated layer "2L" is exaggerated in FIGS. 3B and 3C, for clarity of illustration. When the heated layer "2L" is heated, a temperature gradient results in the body 238.

While the heated layer "2L" of the body element 238 is at the hot working temperature, the end plug 212 is subjected to a translocation motion, and moved in the direction indicated by arrow "3A" in FIG. 3B, to engage the part 252 with an inner surface 224 of a tube 210. It will be understood that the tube 210 is round in cross-section, and defined by an axis "2Y" thereof (FIG. 3B). The body element 238 includes the plastically deformable part 252 that is in the heated layer "2L". As can be seen in FIG. 3B, the part 252 of the heated layer "2L" preferably is plastically deformed when the part 252 engages the inner surface 224 of the tube 210.

It is also preferred that the internal portion 232 is subjected to an engagement motion relative to the wall 219 while the part 252 is engaged with one or more preselected parts 225 of the wall 219 that are contiguous with the inner surface 224. The engagement motion may be any motion, regularly repeated or otherwise. The engagement motion may, for example, be an oscillating motion, in the directions indicated by the double-ended arrow "2E" in FIG. 3B. The engagement motion may commence before, or when, the translocation motion commences. Alternatively, the engagement motion may commence only upon engagement of the internal portion 232 with the inner surface 224 of the wall 219. Due to shearing, the engagement motion adds heat to the part 252 and to the preselected parts 225 of the wall 219. As will be described, the engagement motion preferably continues until the internal portion 232 and the tube 210 are fused together.

As another example, the engagement motion may be rotation or oscillation of the plug 212 about an axis "2X" thereof (FIG. 3A). It will be understood that, as described above, the engagement motion preferably continues for a short time period after engagement, and may continue after the internal portion 232 is in its final position (i.e., when the engagement face 242 engages the tube 210), until the internal portion and the tube wall are fused together. It will also be understood that, even after the internal portion 232 is in its final position, the plug 212 is subjected to the engagement motion and the internal portion 232 is urged in the direction indicated by arrow "2A" until the internal portion 232 and the tube 210 are fused together, and the engagement motion ceases.

Preferably, the plug 212 and the tube 210 are axially aligned (FIG. 3B). As noted above, once the heated layer "2L" is heated to the hot working temperature, the end plug 212 is pushed in the direction indicated by arrow "3A", and simultaneously subjected to the engagement motion. When the engagement face 242 (FIG. 3A) of the external portion 228 engages an end of the tube 210, the translocation motion stops. However, as noted above, after the translocation motion ceases, the plug 212 is still urged against the tube, and it is preferred that the engagement motion continues for a short while (e.g., if the plug rotates about its axis) after the axial translocation motion has stopped.

Because the diameter 259 of the bridge "W" is less than the diameter 258, the end plug 212 partially defines the indentation 241 between the bridge "W" and the inner surface 224 (FIG. 3B). Preferably, the deformed part 252 is receivable in the indentation 241 once the insert portion 232 is fully positioned in the end of the tube 210, with the engagement face 242 abutting the end of the tube 210.

The part 252 is at least partially sheared from the body element 238 as the internal portion 232 is inserted into the tube 210, and the sheared-off part 252 is pushed by the preselected parts of the wall 219 into the indentation 241 while still plastically deformable. The indentation 241 preferably is sufficiently large to receive the sheared portion of the deformed part 252 therein. In FIG. 3C, the deformed part 252 is shown after its plastic deformation, with at least part thereof positioned in the indentation 241.

Preferably, the inert atmosphere remains in position covering the internal portion 232 and the preselected parts 225 while the heated layer is heated and also while the internal portion 232 is in the tube and subjected to the engagement motion. It will be understood that the heating elements and the container or covering for containing the inert atmosphere are omitted from FIGS. 3A-3C for clarity of illustration.

In one embodiment, a clamp 243 may be used to support the wall 219, when the insert portion 232 is pushed into the tube 210 (FIG. 3B).

It will be understood that the wall 219 of the tube 210 is not directly heated by the heating element(s). When the part 252 initially engages the inner wall surface 224, heat is transferred from the part 252 to the preselected parts 225 of the wall 219, by conduction. To the extent that the heated layer "2L" extends into the body element 238, it is believed that heat stored in the heated layer "2L" in the body element 238 may also be transferred, to an extent, to the wall 219 by radiation (or, via engagement of the engagement part 252 with the preselected parts 225, by conduction) when the part 252 first engages the inner wall surface 224. The preselected parts 225 of the wall 219 are heated by such indirect heating. Accordingly, upon the engagement part 252 engaging the inner wall surface 224, the preselected parts 225 are at elevated temperatures, for a short time period. Such elevated temperatures are below the hot working temperature.

Due to the engagement motion of the internal portion 232 upon engagement thereof with the preselected parts 225 of the wall 219 while the engagement part 252 is at the hot working temperature and the preselected parts 225 are at an elevated temperature, and while the plug 212 is urged in the direction indicated by arrow "3A", at least portions of the engagement part 252 and the preselected parts 225 are bonded together to form a bonded region having a substantially uniform microstructure, which fuses the internal portion 232 and the wall 219 together. It will be understood that the preselected parts 225 are relatively narrow and limited in extent from the inner surface 224 into the wall 219.

Figure 4A:
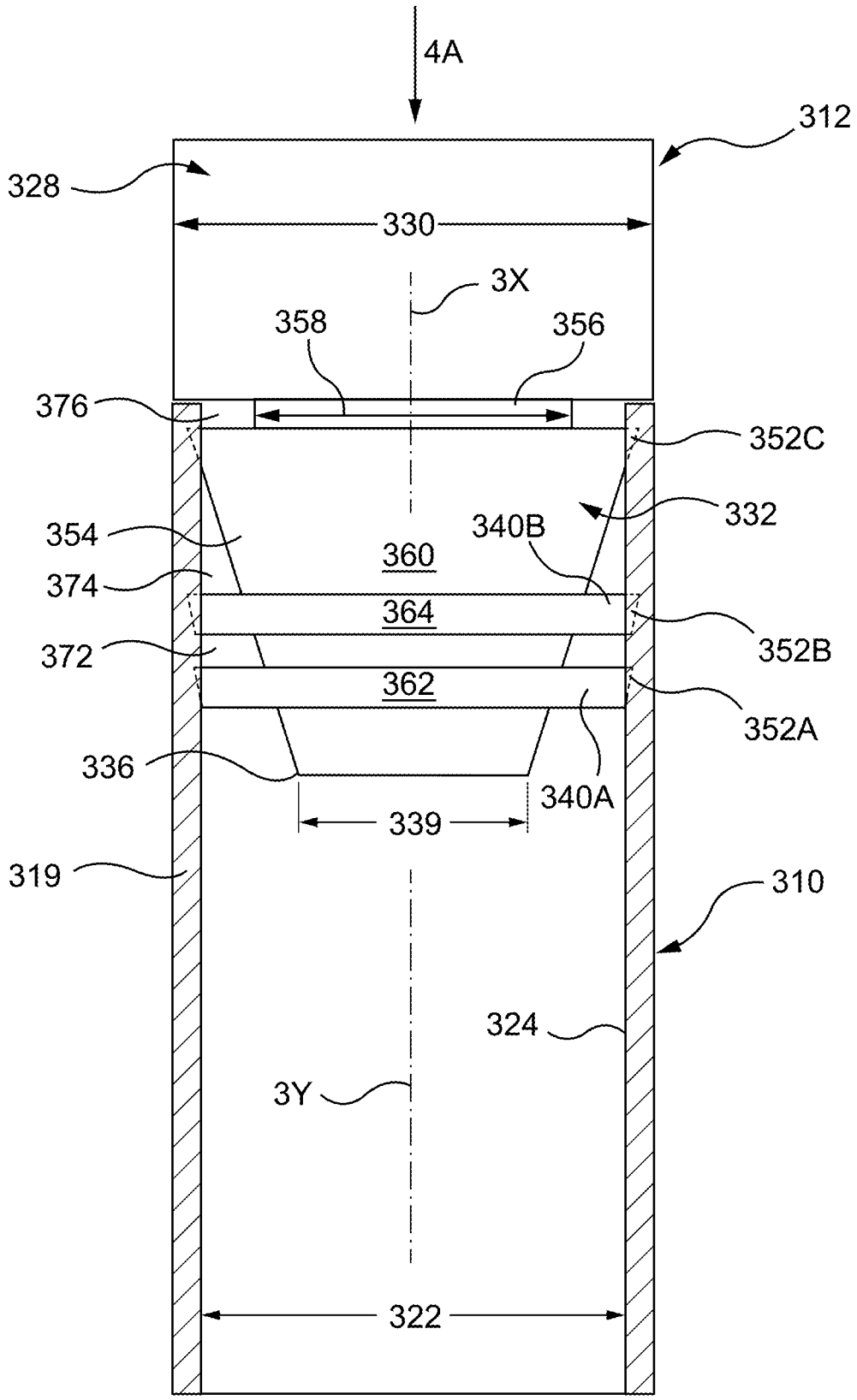
FIG. 4A is a side view of an alternative embodiment of the end element of the invention, with the internal portion thereof positioned in an end of the receptacle, drawn at a smaller scale.
Figure 4B:
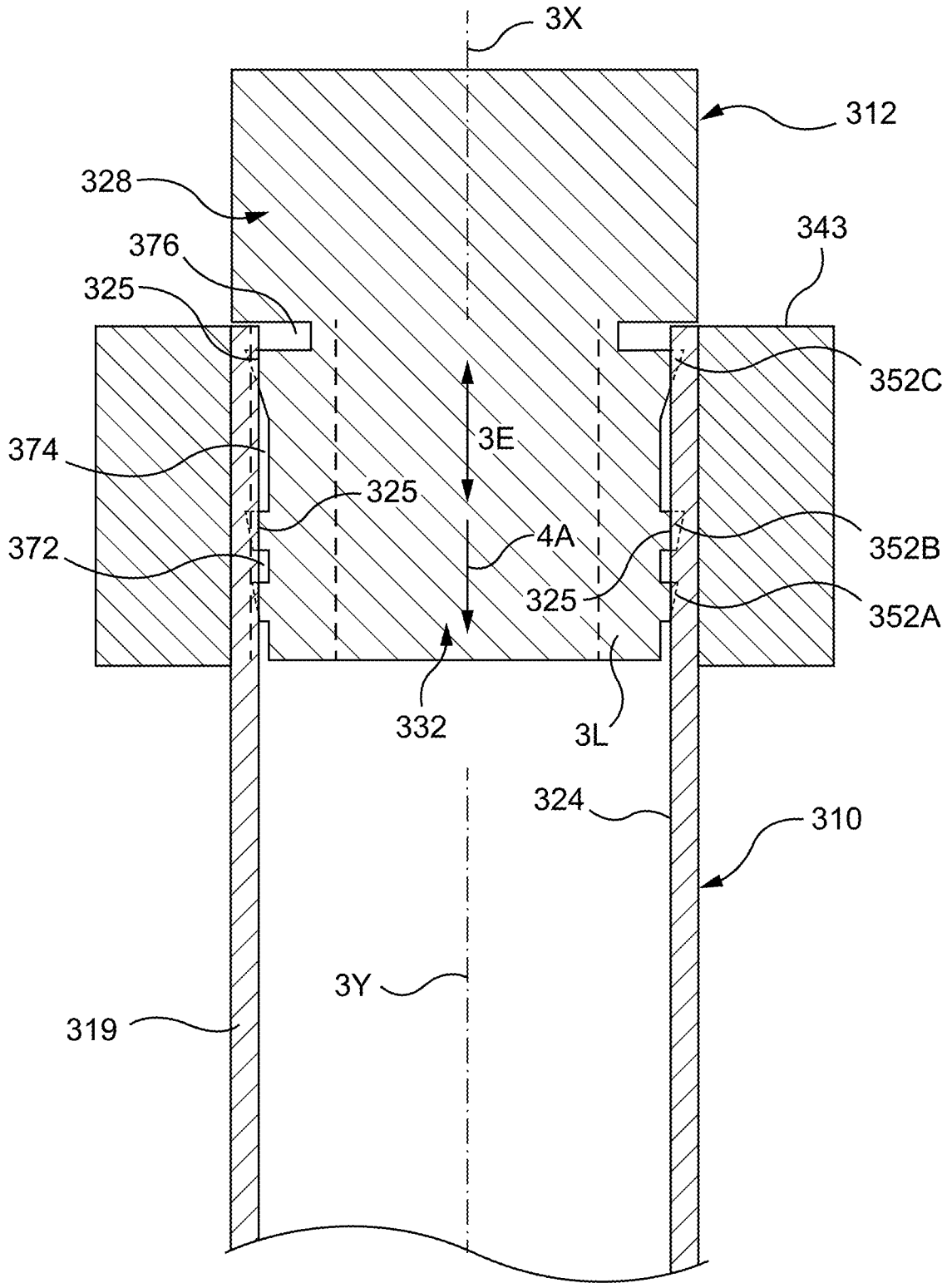
FIG. 4B is a cross-section of the end element of FIG. 4A, with the internal portion thereof positioned in the receptacle.

Those skilled in the art would appreciate that other configurations of the internal portion of the end plug may be utilized. For example, an alternative embodiment of the end plug 312 of the invention is illustrated in FIGS. 4A and 4B. The plug 312 is partially defined by an axis "3X" thereof.

As can be seen in FIG. 4A, the end plug 312 preferably includes an external portion 328 having an external portion diameter 330 that is greater than an inner diameter 322 of a tube 310. It will be understood that the tube 310 preferably is round in cross-section, defined by a tube axis "3Y". The end plug 312 preferably also includes an internal portion 332 thereof, which is formed to fit into an open end of the tube 310 in a light drive fit, as will be described.

Preferably, a first segment 354 of the internal portion 332 of the end plug 312 includes two projecting elements 340A and 340B. The first segment 354 preferably also includes a first segment body 360, and the projecting elements 340A and 340B preferably are included in first and second ridges 362, 364 on the first segment body 360.

As can be seen in FIG. 4A, the internal portion 332 preferably includes a second segment 356 that is adjacent to the external portion 328. The first segment 354 extends between the second segment 356 and an inner end 336 of the first segment 354. Preferably, the second segment 356 has a diameter 358 that is less than the inner diameter 322 of the tube 310.

The first segment body 360 preferably has a diameter 339 at the inner end 336 that is less than an inner diameter 322 of a wall 319 of the tube 310. As can be seen in FIG. 4A, the projecting elements 340A and 340B project radially beyond the diameter 339. The two projecting elements 340A, 340B include respective parts 352A, 352B thereof that are heated, and plastically deformed when the internal portion 332 is inserted into the tube 310, as will be described. The engagement parts 352A, 352B engage preselected parts 325 of the wall 319, when the internal portion 332 is inserted into the tube 310.

A third part 352C that is also heated and plastically deformed when the internal portion 332 is inserted into the tube 310 preferably is included in the body 360.

Preferably, the internal portion 332 is heated by one or more heating elements (not shown) in an inert atmosphere. The heating elements may heat the internal portion by induction heating, as described above. It will be understood that the heating elements and the container or covering for containing the inert atmosphere are omitted from FIGS. 4A and 4B for clarity of illustration.

Before the internal portion 332 is inserted into the open end of the tube 310, a heated layer thereof "3L" is heated to a hot working temperature. When the heated layer "3L" is at the hot working temperature, the layer is plastically deformable. It will be understood that the deformable parts 352A, 352B, and 352C are located in the heated layer.

It will be understood that the heated layer "3L", as illustrated in FIG. 4B, is exaggerated, for clarity of illustration. It will also be understood that the heated layer "3L" may not include portions of the body 360, and the heated layer "3L" may include only the segments 352A-352C. When the heated layer "3L" is heated, a temperature gradient results in the body 360.

The plug 312 is axially aligned with the tube 310. Once the heated layer "3L" is at the hot working temperature, the heating element is removed. When the heated layer is at the hot working temperature, the plug 312 is subjected to a translocation motion, i.e., the plug 312 is pushed into the open end of the tube 310, in the direction indicated by arrow "4A" (FIG. 4A), to engage the internal portion 332 with the preselected parts 325 of the wall 319. The preselected parts 325 are contiguous with an inner wall surface 324 of the tube wall 319.

Preferably, the plug 312 is also subjected to a suitable engagement motion, commencing at the same time as the internal portion 332 engages the inner wall surface 324, or earlier. The engagement motion may be, for example, an oscillation motion that is axially directed, as indicated by the double-ended arrow "3E" in FIG. 4B, or a rotation about the axis "3X". The engagement motion may involve any suitable movement of the internal portion 332 relative to the tube wall 319. The engagement motion may be regular (i.e., repeated at time intervals) or irregular (i.e., randomly repeated). The engagement motion may commence before or after the translocation motion commences. It will be understood that the engagement motion continues for a short time period after engagement, i.e., until the internal portion and the tube wall 319 are fused together.

It will also be understood that the inert atmosphere remains in place, both during heating and during engagement, covering the part of the inner surface 324 that is engaged and engageable with the internal portion, for as long as the engagement motion continues after engagement. When the plug's end portion 328 is initially engaged with an end of the tube 310, and while the plug 312 is subjected to the engagement motion, the plug 312 is urged in the direction indicated by arrow "4A".

The internal portion's translocation motion continues until an engagement face 342 of the external portion 328 engages the end 315 of the tube 310, at which point the internal portion 332 is fully inserted into the open end of the tube. As noted above, once the end 328 abuts the end of the tube 310, the engagement motion continues, and the end 328 is urged in the direction indicated by arrow "3A", until the plug is bonded to the tube, and no further engagement motion takes place.

As can be seen in FIGS. 4A and 4B, when the internal portion 332 is inserted into the open end, the heated parts 352A, 352B, 352C engage the inner surface 324, and they are respectively deformed thereby. The parts 352A, 352B, and 352C preferably are at least partially at the hot working temperature, and they are plastically deformed by their engagement with the preselected parts 325 of the wall 319, and at least partially pushed thereby into indentations 372, 374, and 376 respectively. The indentations 372, 374, and 376 are formed to at least partially receive the respective parts 352A, 352B, 352C of the internal portion 332 therein after the parts 352A, 352B, 352C are plastically deformed, as will be described. Due to shearing, the engagement motion adds heat to the engagement parts 352A-352C and to the preselected parts 325 of the wall 319.

Preferably, when the first engagement part 352A engages the preselected parts 325 of the wall 319, the first engagement part 352A of the ridge 362 is at least partially pushed thereby into the indentation 372 and is received therein. Also, the second engagement part 352B of the ridge 364 preferably is at least partially pushed into the indentation 374 when the second engagement part 352B engages the preselected parts 325. Finally, the third engagement part 352C of the body 360 is at least partially pushed into the indentation 376 when the third engagement part 352C engages the preselected parts 325 of the wall 319.

As noted above, the tube 310 preferably is a relatively thin-walled tube. Because of this, it is preferred that the end plug 312 is moved into its fully inserted position (i.e., to locate the internal portion 332 entirely inside the tube 310) with relatively little pressure applied to the external portion 328 in the direction indicated by arrow "4A" (FIG. 4B).

The embodiment of the end plug 312 illustrated in FIGS. 4A and 4B has the advantage that, because it includes more than one segment engaging the inner wall surface 324, the extent of the engagement of each of the deformed engagement parts 352A-352C with the preselected parts 325 of the wall 319 is minimized. This is believed to have the beneficial result that the risk of rupturing or buckling the tube wall 319 is decreased, because the stress to which the tube wall 319 is subjected at any single point thereon, during engagement with the engagement parts 352A-352C, is minimized.

Also, because the engagement parts 352A, 352B are parts of the projecting elements 340A, 340B (i.e., rather than parts of the body 360), such parts may be heated to the hot working temperature relatively quickly, with relatively less energy input required.

It will be understood that FIGS. 4A and 4B illustrate only one example, and other configurations, e.g., plugs with more than three segments, may be utilized. From the foregoing, it can be seen that more segments with smaller cross-sections may be utilized, in order to minimize the amount of pressure required to push the plug into the tube.

The wall 319 is not directly heated by the heating elements. When the engagement parts 352A-352C engage the preselected parts 325, heat is transferred from the engagement parts 352A-352C to the preselected parts 325 of the wall 319 by conduction. It is believed that heat stored in the heated layer "3L" in the body 360 and also in the balance of the projecting elements 340A, 340B may also be transferred, to an extent, to the presselected parts 325 of the wall 319 by radiation (or, via the engagement parts 352A-352C, by conduction therethrough) when the engagement parts 352A-352C engage the preselected parts 325. Accordingly, the preselected parts 325 are indirectly heated due to such indirect heating. When the engagement parts 352A-352C engage the preslected parts 325, the preselected parts 325 are at an elevated temperature, for a short time period.

Due to the engagement motion of the internal portion 332 upon engagement thereof with the preselected parts 325 while the engagement parts 352A-352C are at the hot working temperature and the preselected parts 325 are at the elevated temperature, at least portions of the engagement parts 352A-352C and the preselected parts 325 are bonded together to form a bonded region having a substantially uniform microstructure to fuse the internal portion 332 and the wall 319 together. It will be understood that the preselected parts 325 extend a very short distance from the inner surface 324 into the wall 319.

As can be seen in FIG. 4B, a clamp 343 may be used to support the wall 319 when the insert portion 332 is pushed into the tube 310.

Figure 5A:
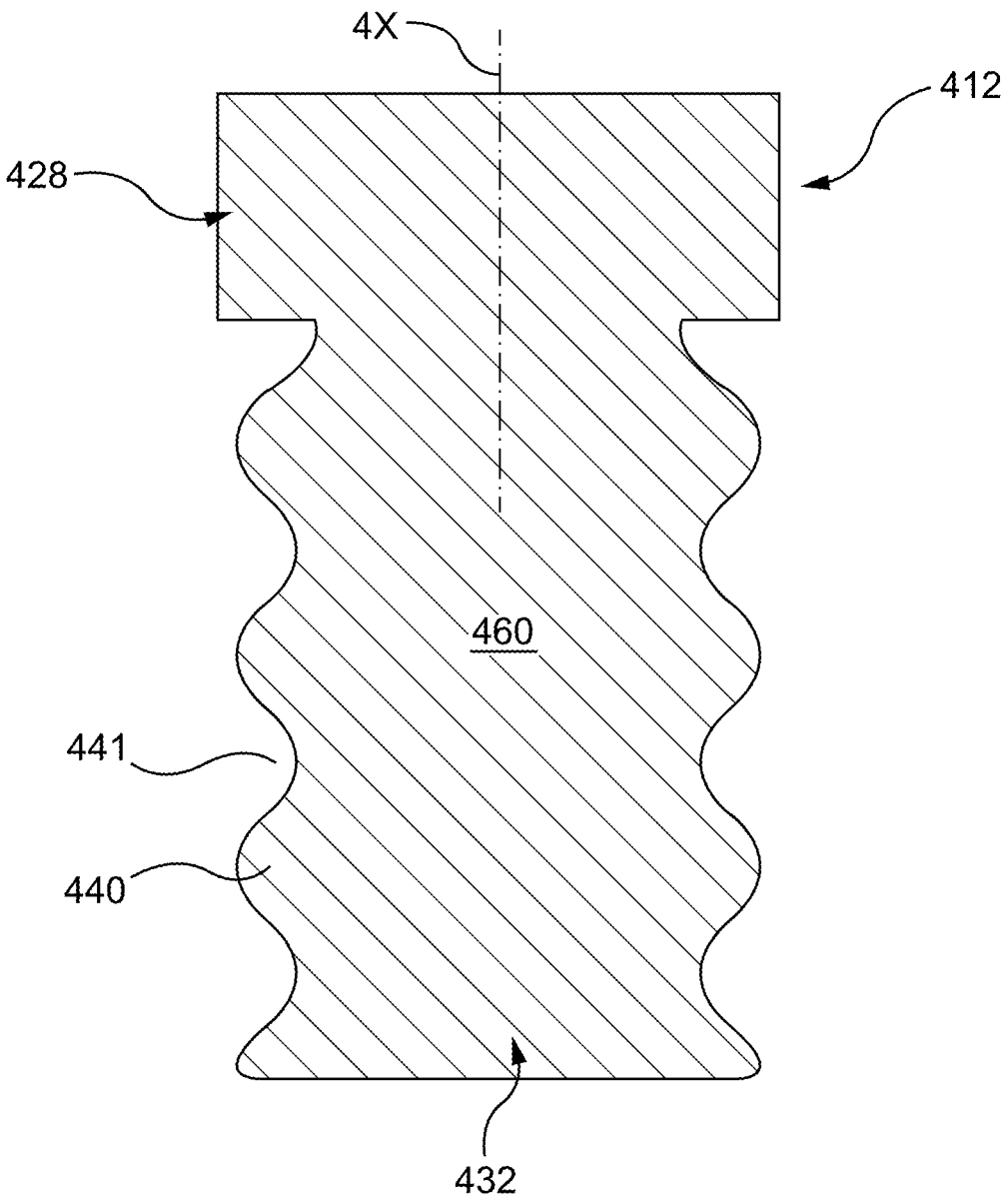
FIG. 5A is a cross-section of another alternative embodiment of the end element of the invention.
Figure 5B:
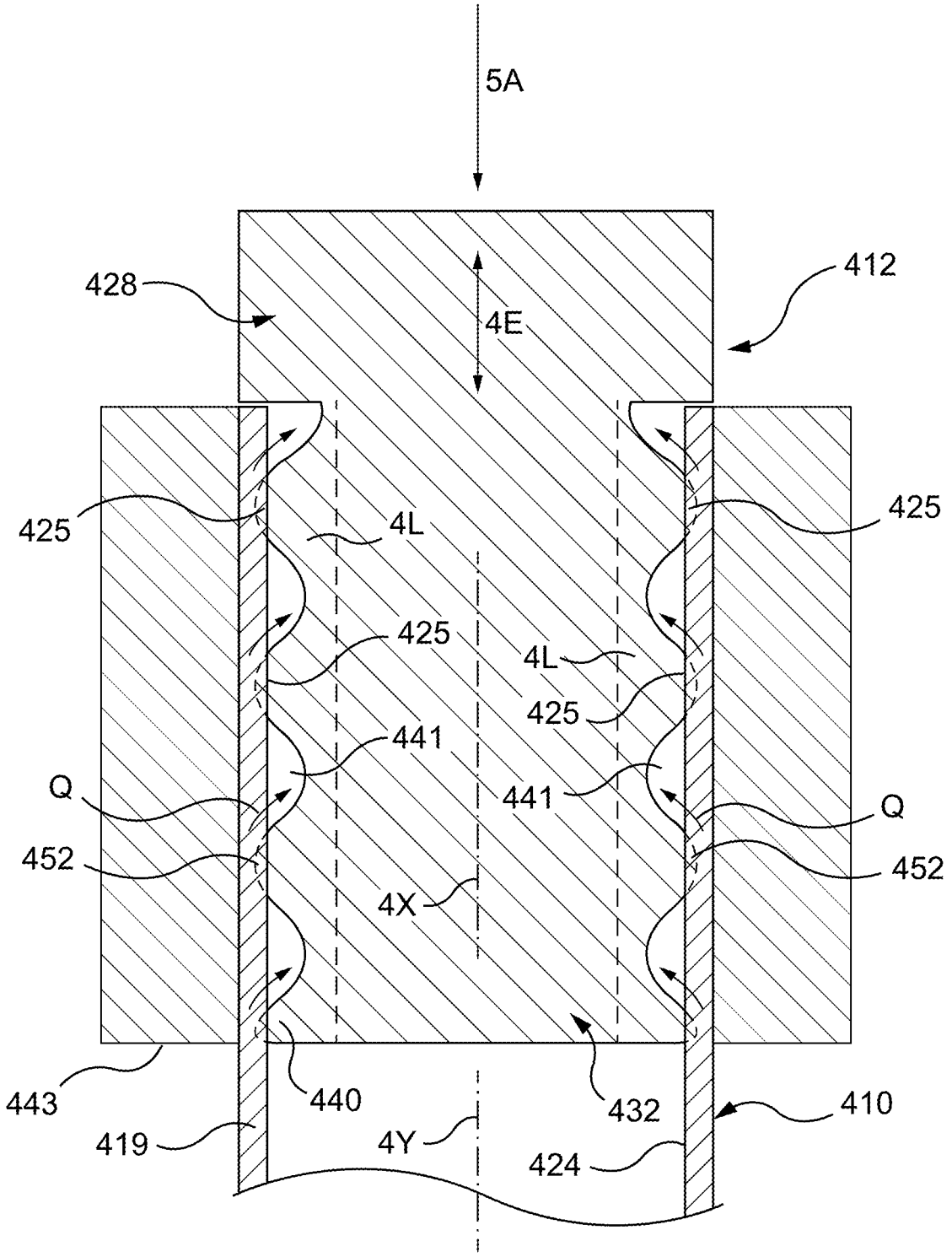
FIG. 5B is a cross-section of the end element of FIG. 5A, with the internal portion thereof positioned in the receptacle.

Another alternative embodiment of the end plug 412 is illustrated in FIGS. 5A and 5B. The plug 412 is partially defined by an axis "4X" thereof. Preferably, the plug 412 includes internal and external portions 432, 428. The internal portion 432 is formed to fit inside a tube 410, as will be described. It will be understood that the tube 410 is round in cross-section and defined by a tube axis "4Y" (FIG. 5B).

The tube 410 includes a tube wall 419 with an inner surface 424. As will be described, when the internal portion 432 is inserted into the tube 410, the internal portion 432 engages one or more preselected parts 425 of the tube wall 419. The preselected parts 425 are contiguous with the inner surface 424.

The internal portion 432 preferably is heated in an inert atmosphere and, when a heated layer "4L" of the internal portion 432 is at the hot working temperature, the internal portion 432 is axially aligned with the tube 410 and pushed into the tube 410, in the direction indicated by arrow "5A" in FIG. 5B. The internal portion 432 preferably includes a body element 460 and a number of rounded projecting elements 440 that are positioned adjacent to respective indentations 441.

Preferably, the heated layer "4L" of the internal portion 432 is heated by heating elements (not shown) in an inert atmosphere before engagement, as described above. The projecting elements 440 include respective parts 452 that are included in the heated layer, i.e., the parts 452 are heated to the hot working temperature, at which the parts are plastically deformable. When the heated layer "4L" is heated, a temperature gradient results in the projecting elements 440 and the body element 460. It will be understood that the heated layer "4L", as illustrated in FIG. 5B, is exaggerated, for clarity of illustration. Those skilled in the art would appreciate that the heated layer "4L" may include, at a minimum, the engagement parts 452. Depending on the circumstances, the heated layer may include all or substantially all of the respective projecting elements 440, and may include a portion of the body element 460.

When the engagement parts 452 engage the preselected parts 425 of the wall 419 due to the translocation motion, the internal portion 432 preferably is also subjected to an engagement motion. The engagement motion may involve any suitable movement of the internal portion 432 relative to the tube wall 419. The engagement motion may be an oscillation of the internal portion in an axial direction, as indicated by double-ended arrow "4E" (FIG. 5B). Alternatively, the engagement motion may be oscillation or rotation of the plug 412 about the axis "4X". The engagement motion continues for a short time period after engagement, i.e., until the internal portion 432 and the tube wall 419 are fused together.

It will be understood that the engagement motion may commence before or after the translocation motion commences.

Preferably, each of the projecting elements 440 is formed so that the part 452 of each of the projecting elements 440 is engaged with the preselected parts 425 of the wall 419 at the inner surface 424 and plastically deformed as a result, when the plug 412 is pushed into the tube 410. As the internal portion 432 is pushed into the open end of the tube 410 (i.e., in the direction indicated by arrow "5A"), the plastically deformed parts 452 are at least partially pushed into the indentations, which are located downstream relative to the movement of the internal portion 432 into the tube. The movement of the deformed parts 452 or portions thereof into the indentations 441 is schematically indicated by arrows "Q" in FIG. 5B. It will be understood that the dashed outlines of the parts 452 represent the original outline of each of the parts 452, i.e., before plastic deformation thereof. The plastic deformation results from engagement of the parts 452 with the preselected parts 425 of the wall 419.

The internal portion 432 is subjected to the translocation motion until an engagement face 442 of the external portion 428 engages an end 415 of the tube (FIG. 5B). It will be understood that, after initial engagement of the engagement face 442 with the end 415 of the tube 410, the plug 412 preferably is continuously urged in the direction indicated by arrow "5A", and at the same time, the plug 412 is subjected to the engagement motion. Due to shearing, the engagement motion adds heat to the parts 452 and to the inner surface 424. The engagement motion ceases when the plug 412 and the tube are bonded together. At that time, the pressure urging the plug 412 in the direction indicated by arrow "5A" also ceases.

It will be understood that the sizes of the projecting elements 440 and the deformed parts 452 thereof are exaggerated in FIGS. 5A and 5B relative to the body 460 for clarity of illustration.

The wall 419 of the tube 410 is not directly heated by the heating elements. When the engagement parts 452 engage the preselected parts 425, some heat is transferred from the plastically deformed engagement parts 452 to the preselected parts 425 of the wall 419 by conduction. It is believed that heat stored in the heated layer "4L" of the body element 460 (if any) may also be transferred, to an extent, to the wall 419 by radiation (or, via the engagement parts 452, by conduction therethrough) when the engagement parts 452 engage the inner wall surface 424. The preselected parts 425 are indirectly heated to an elevated temperature as a result. Accordingly, upon the engagement parts 452 engaging the preselected parts 425 of the wall 419, the preselected parts 425 are at elevated temperatures, for a short time period. Such elevated temperatures are less than the hot working temperature.

Due to the engagement motion of the internal portion 432 upon engagement thereof with the preselected parts 425 while the engagement parts 452 are at the hot working temperature and the preselected parts 425 are at an elevated temperature, the engagement parts 452 and the preselected parts are bonded together to form a bonded region having a substantially uniform microstructure to fuse the internal portion 432 and the preselected parts 425 of the wall 419 together.

It is believed that, due to the rounded shapes of the projecting elements 440, the force or pressure required to be applied in the direction indicated by arrow "5A" to plastically deform the parts 452 thereof is somewhat reduced. In one embodiment, a clamp 443 may be used to support the wall 419, when the insert portion 332 is inserted into the tube 410 (FIG. 5B).

Figure 6B:
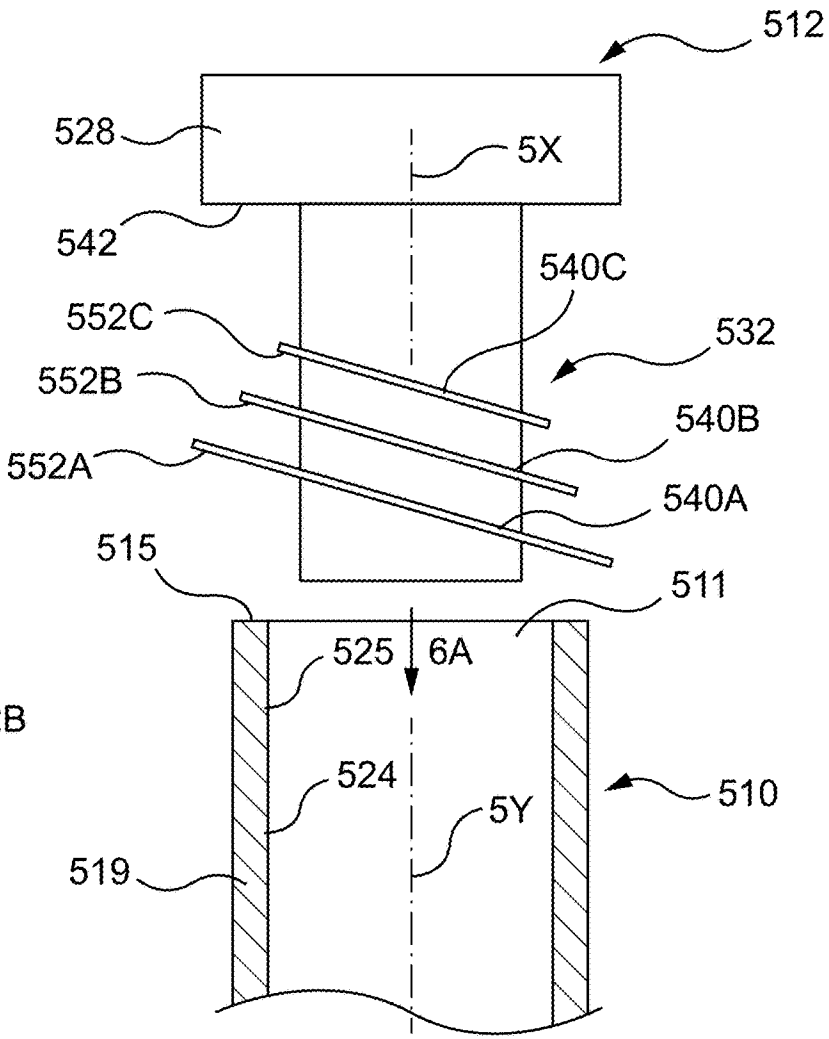
FIG. 6B is a side view of the end element of FIG. 6A prior to insertion thereof into an open end of a receptacle.
Figure 6A:
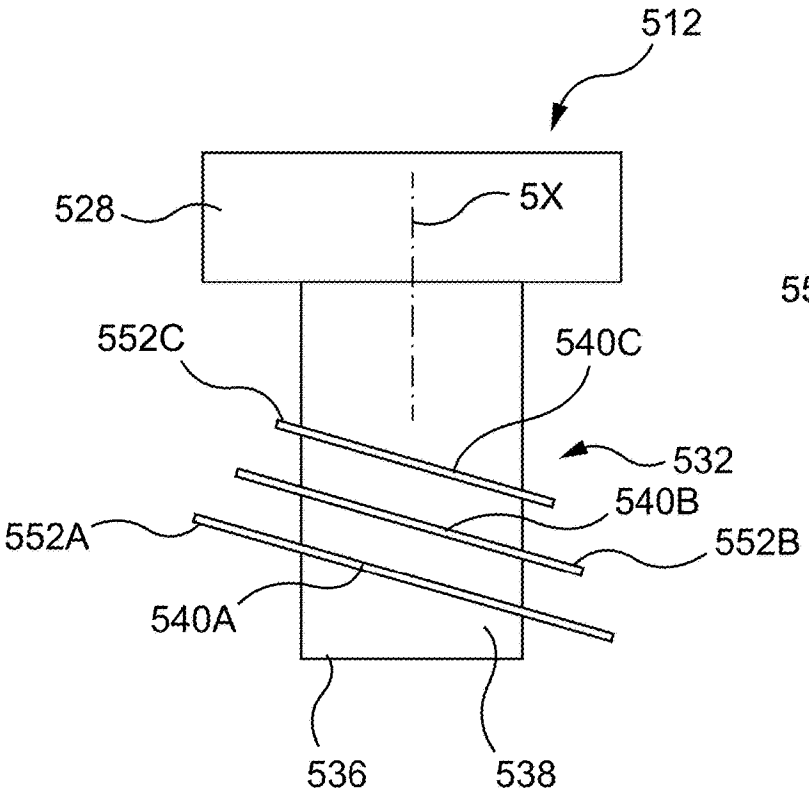
FIG. 6A is a side view of another embodiment of the end element of the invention, drawn at a smaller scale.
Figure 6C:
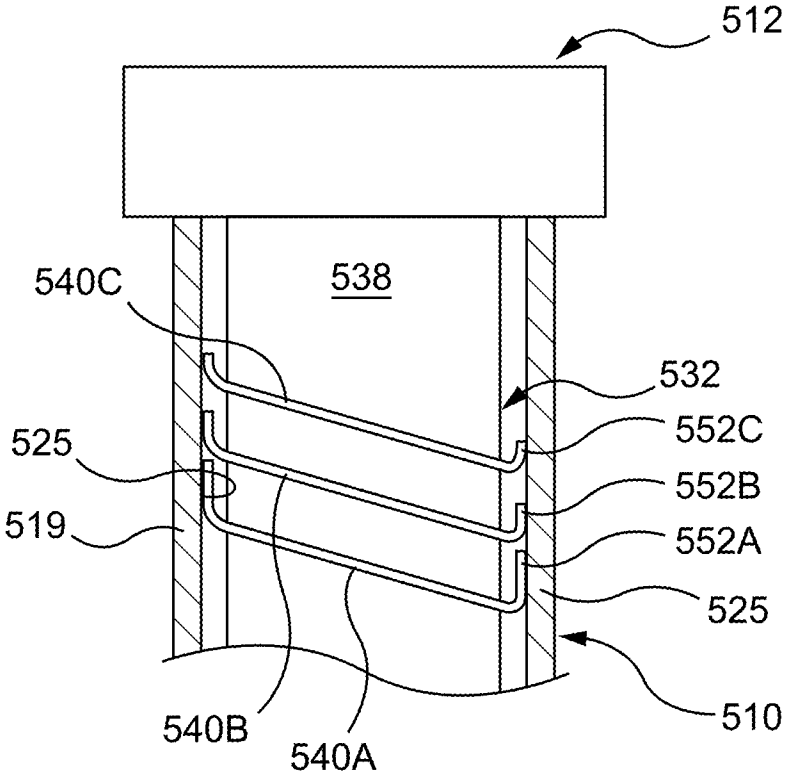
FIG. 6C is a partial cross-section of the tube of FIG. 6B with the end element of FIGS. 6A and 6B partially positioned therein.

An alternative embodiment of the end plug 512 is illustrated in FIGS. 6A-6C. As can be seen in FIGS. 6A and 6B, the end plug 512 is defined by an axis "5X" thereof, and has an internal portion 532 on which fins or projecting elements 540 are mounted. The internal portion 532 includes a body element 538 extending between an external portion 528 of the plug 512 and an inner end 536 of the internal portion 532. In the example illustrated, the plug 512 includes three fins 540A-540C that extend outwardly (away from the axis "5X") from the body element 538. The fins 540A-540C are parallel to each other, and they preferably are positioned non-orthogonally to the plug axis "5X".

In addition, the fins 540A-540C are of unequal lengths. Specifically, the longest fin 540A is positioned proximal to the inner end 536, and the shortest fin 540C is positioned distal to the inner end 536. It will be understood that the lengths of the fins 540A-540C are exaggerated in relation to the size of the body element 538 in FIGS. 6A-6C for clarity of illustration.

Preferably, the plug 512 is positioned so that the axis "5X" is aligned with an axis "5Y" of a tube 510 (FIG. 6B). The tube 510 preferably is a relatively thin-walled tube, and round in cross-section. The tube 510 has a tube wall 519, with an inner surface 524 thereof. It will also be understood that the internal portion 532 preferably is heated by heating elements (not shown) in an inert atmosphere to a hot working temperature, as described above. As is also described above, engagement parts 552A-552C of the fins 540A-540C are heated to the hot working temperature. The parts 552A-552C are plastically deformable while they are at the hot working temperature. It will be understood that the parts 552A-552C are those parts of the fins 540A-540C that are distal to the body 538, e.g., such parts may be outer edges of the fins 540A-540C. When the parts 552A-552C are heated to the hot working temperature, a temperature gradient results in each of the fins 540A-540C.

While the parts 552A-552C (or at least portions thereof) are at the hot working temperature, the plug 512 preferably is subjected to a translocation motion, moving the plug 512 in the direction indicated by arrow "6A" in FIG. 6B, pushing the internal portion 532 into an open end 511 of the tube 510. When the internal portion 532 is pushed into the open end 511, the fins 540A-540C engage one or more preselected parts 525 of the tube wall 519. The preselected parts 525 are contiguous to the inner surface 524. Preferably, the plug 512 is also subjected to an engagement motion, causing the plug 512 to move relative to the tube, as described above. The engagement motion preferably commences before the fin 540A engages the inner surface 524.

The internal portion 532 is moved into the tube 510 (i.e., in the direction indicated by arrow "6A") until an engagement surface 542 of the external portion 528 engages an end 515 of the tube 510 (FIGS. 6B, 6C). It will be understood that, as the internal portion 532 is moved into the tube 510, the plug 512 is subjected to the engagement motion. It will also be understood that, after the engagement surface 542 engages the end 515 of the tube 510, the plug 512 continues to be urged in the direction indicated by arrow "6A", and the engagement motion continues as well. Due to shearing, the engagement motion adds heat to the parts 552A-552C and to the inner surface 524. The engagement motion ends when the internal portion 532 and the tube 510 are bonded together, as will be described. When the internal portion 532 and the tube are bonded together, the pressure urging the plug 512 in the direction indicated by arrow "6A" also ceases.

As can be seen in FIGS. 6B and 6C, as the internal portion 532 is moved into the tube 510, the parts 552A-552C engage the inner surface 524 of the tube 510. Because the parts 552A-552C are plastically deformable, they are at least partially bent in a direction that is generally opposite to the direction indicated by arrow "6A" (FIG. 6C). However, the parts 552A-552C remain engaged with the preselected parts 525, and become bonded to the preselected parts 525 of the tube wall 519, due to the parts 552A-552C being at the hot working temperature and also due to the engagement motion, which scrapes the parts 552A-552C against the inner surface 524.

As described above, when the engagement parts 552A-552C engage the preselected parts 525, some heat is transferred to the preselected parts 525, at least by conduction. As a result, the preselected parts 425 are at an elevated temperature, below the hot working temperature.

Because the engagement parts 552A-552C are at the hot working temperature, and because the engagement parts 552A-552C are pushed against the preslected parts 525 due to the engagement motion, at least portions of the engagement parts 552A-552C and the preselected parts 525 of the wall 519 form a bonded region having a substantially uniform microstructure.

As can be seen in FIG. 6C, the parts 552A-552C that are bonded with the wall 519 at the inner surface 524 form a series of barriers, positioned to prevent fluids (liquids or gases) from passing through the spaces between the inner surface 524 and the body element 538. A gastight seal is thereby created. Because there are multiple parts 552A-552C, the risk of the seal between the engagement parts 552A-552C and the preselected parts 525 not being gastight is low.

The fins 540A-540C are positioned at a non-orthogonal angle relative to the axis "5X" to facilitate movement of the internal portion 532 into the tube 510. For example, the engagement motion may involve rotation or oscillation of the plug 512 about its axis "5X", as the plug 512 is also subjected to the translocation motion, and moved into the tube 510. Also, the fin 540A that is proximal to the inner end 536 of the internal portion 532 is the largest fin, and the fins located more closely to the external portion 528 are progressively smaller.

It is believed that the decrease in the lengths of the fins positioned at greater distances from the inner end 536 also tends to decrease the amount of pressure needed to push the plug 512 into the tube 510, as compared to other arrangements. From FIGS. 6B and 6C, it can be seen that, because the fin 540A is the first fin to engage the inner surface 524 as the internal portion 532 is inserted into the tube 510, that fin 540A continues to engage the preselected parts 525 of the wall 519 as the internal portion 532 moves further into the tube 510. To continue to move the internal portion 532 into the tube, pressure is required to be applied in the direction indicated by arrow "6A", and also the plug is subjected to torque, to rotate or oscillate the plug 512 about the axis "5X".

When the internal portion 532 is moving into the tube, the second fin to engage the inner surface 524 is the fin 540B. Those skilled in the art would appreciate that, when the two fins 540A, 540B are engaging the inner surface 524 as the internal portion 532 is moved further into the tube 510, more pressure and more torque are required to be applied to the plug in order to keep it moving into the tube 510. However, because the fin 540B is smaller than the fin 540A, the incremental pressure and torque required due to engagement of the fin 540B with the inner surface 524 is less than the pressure and torque applied due to engagement of the fin 540A.

For the same reason, the fin 540C is somewhat smaller than the fin 540B. The incremental pressure and torque required due to the engagement of the fin 540C is less than the pressure and torque required because of the engagement of either of the fins 540A, 540B.

The fin 540A may partly fold over onto a part of the fin 540B.

From the foregoing, it can be seen that varying the sizes of the fins, from relatively larger at the inner end 536 of the internal portion 532 to relatively smaller as the fins are positioned closer to the external portion 528, may be advantageous because multiple fins may be used without requiring significantly more pressure and torque to be applied during installation of the plug.

Figure 7:
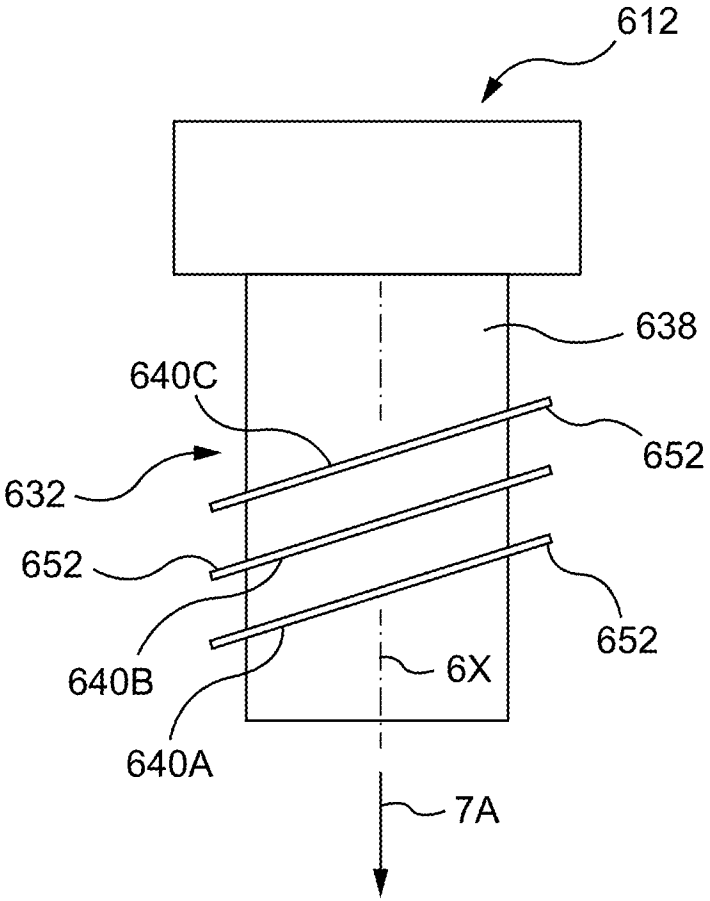
FIG. 7 is a side view of another embodiment of the end element of the invention.

Other arrangements of fins mounted to the internal portion of the plug may be advantageous. For example, in the embodiment of the plug 612 illustrated in FIG. 7, fins 640A-640C are mounted to a body element 638 of an internal portion 632 of the plug 612. As can be seen in FIG. 7, the fins 640A-640C preferably are parallel to each other, and positioned at a non-orthogonal angle relative to the plug axis "6X". As noted above, it is believed that positioning the fins in this way relative to the direction of translocation motion (indicated by arrow "7A" in FIG. 7) tends to mitigate the pressure and the torque required to be applied to the plug 612, if the plug 612 is subjected to an engagement motion (e.g., rotated or oscillated about the axis "6X"), i.e., after parts 652 of the fins distal to the body 638 are heated to a hot working temperature, and the internal portion 632 is inserted into an open end of a tube (not shown in FIG. 7). In substantially the same way as illustrated in FIG. 6C, the parts 652 are deformed when the internal portion 632 is inserted into the tube. Due to shearing, the engagement motion adds heat to outer parts 652 of the fins and to the inner surface (not shown) of the tube.

Figure 8:
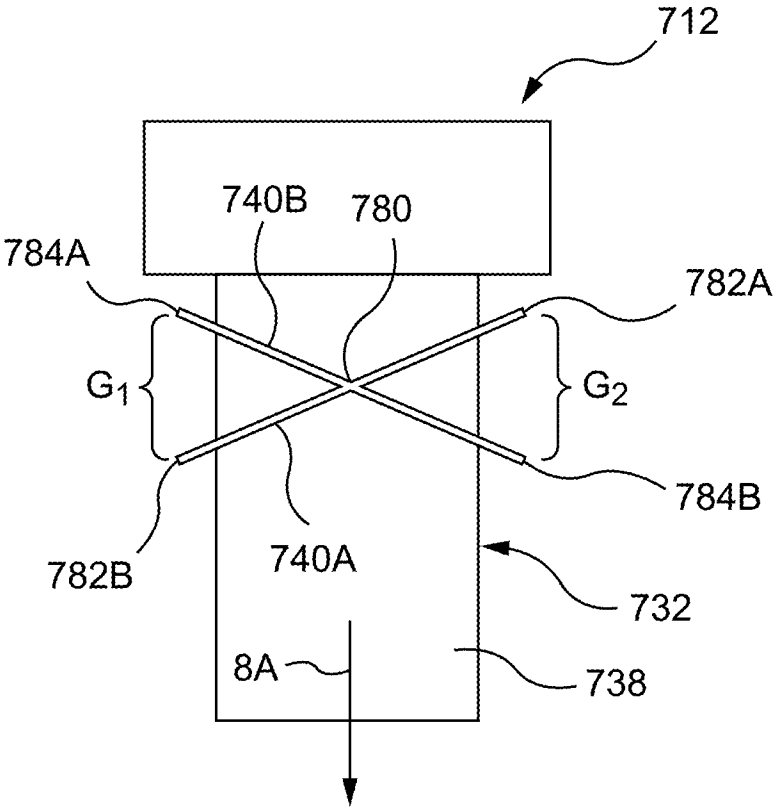
FIG. 8 is a side view of another embodiment of the end element of the invention.

Another alternative embodiment of the plug 712 is illustrated in FIG. 8. Fins 740A, 740B intersect at a location 780. It will be understood that the fins 740A, 740B are mounted to a body element 738 of an internal portion 732 and the body element 738 is round in cross-section. Accordingly, the fins 740A, 740B intersect at two locations, on opposite sides of the body member 738.

As can be seen in FIG. 8, the fin 740A extends between respective high and low ends 782A, 782B thereof, and the fin 740B extends between respective high and low ends 784A, 784B thereof. The ends 784A, 782B are spaced apart to define a gap "$G_1$" therebetween, and the ends 782A, 784B are spaced apart to define a similar gap "$G_2$" therebetween.

Preferably, the internal portion 732 is heated by heating elements (not shown) in an inert atmosphere, so that parts of the fins 740A, 740B that are distal to the body 738 are heated to a hot working temperature. The plug 712 is then subjected to a translocation motion and an engagement motion, and the plug 712 is moved in the direction indicated by arrow "8A" to push the internal portion 732 into an open end of a tube (not shown in FIG. 8).

It is believed that the intersecting arrangement of the fins 740A, 740B may be advantageous due to the relatively large gaps "$G_1$", "$G_2$" between the fins at their highest and lowest points. When the internal portion 732 is first pushed into the open end of the tube, the parts of the fins 740A, 740B adjacent to the ends 782B, 784B engage the inner surface (not shown) of the tube. The plug 712 is subjected to pressure and torque, in order to keep the internal portion 732 moving into the tube.

When the internal portion 732 is at the point where the intersection 780 engages the inner surface, only a relatively small area of the fins engages the inner surface, namely, the area of the intersection 780 on two sides of the internal portion 732. At that point, it is believed that the pressure and torque applied will cause the internal portion 732 to move relatively quickly into the tube, until the parts of the fins that are in the regions of the ends 784A, 782A engage the inner surface of the tube. The intention is to generally make the insertion of the internal portion 732 into the open end of the tube proceed with a minimum of pressure and torque required.

In another alternative embodiment, an internal portion 832 of a plug 812 preferably includes fins 840A-840C positioned non-orthogonally relative to an axis "8X" of the plug 812. The fins 840A-840C are mounted to the body 838 of the internal portion 832. The body 838 extends between an external portion 828 of the plug 812 and an inner end 836 of the body 838, which is located distal to the external portion 828 (FIG. 9A).

Figure 9B:
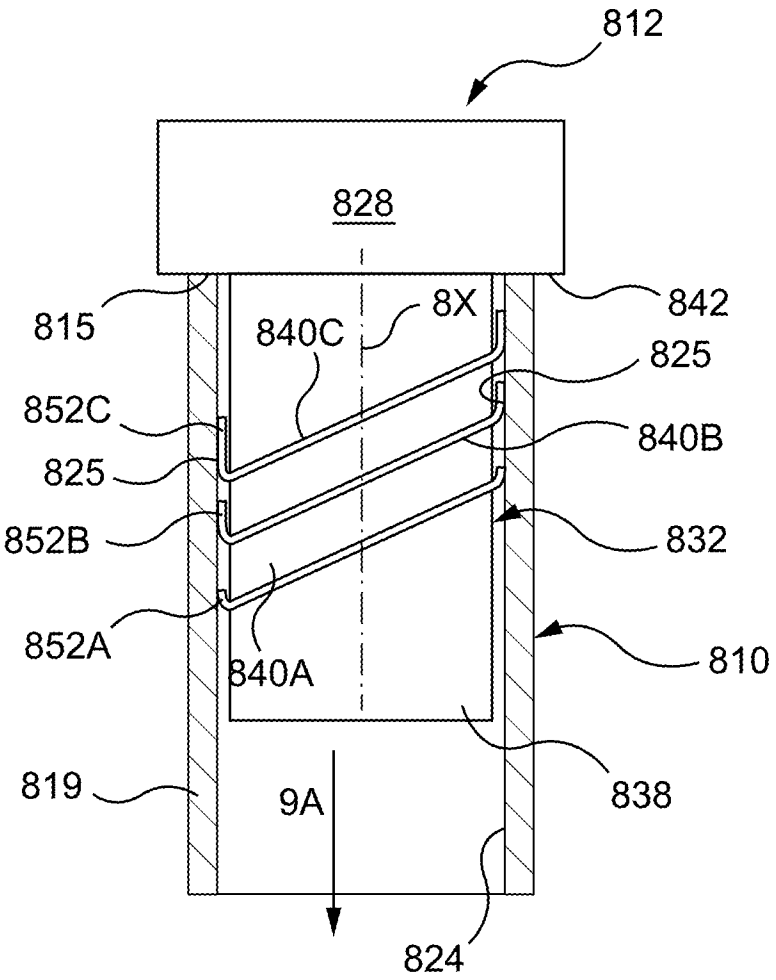
FIG. 9B is a partial cross-section of a receptacle with the end element of FIG. 9A partially positioned therein.
Figure 9A:
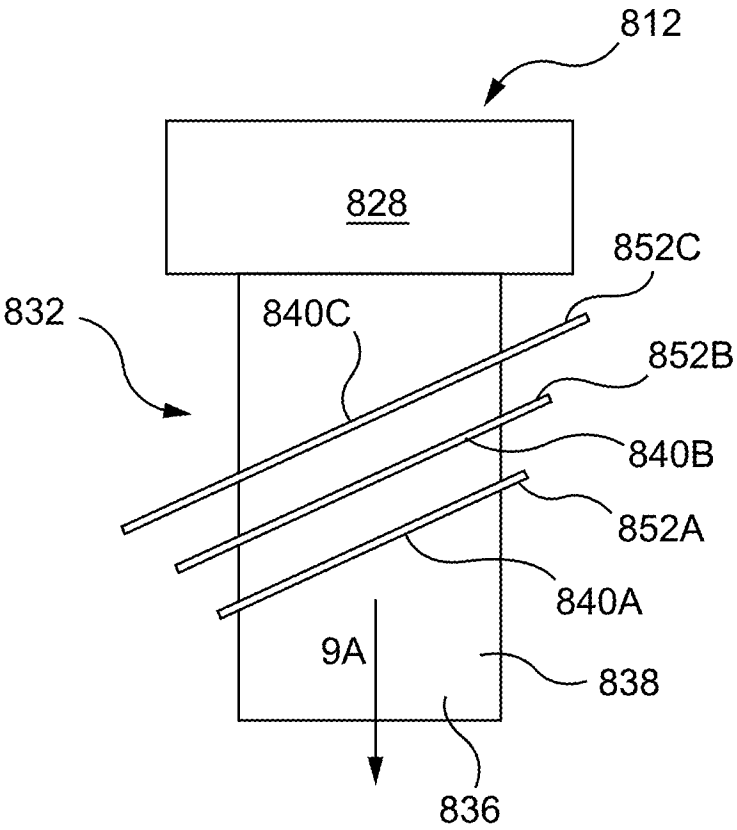
FIG. 9A is a side view of another embodiment of the end element of the invention.

As can be seen in FIG. 9A, the fins 840A-840C preferably are mounted parallel to each other. The fin 840A that is positioned proximal to the inner end 836 is the shortest of the fins, and the fin 840C that is positioned distal to the inner end 836 is the longest of the fins. In the example illustrated, there are only three fins, and the middle fin 840B has a length that is greater than the length of the fin 840A but less than the length of the fin 840C.

The plug 812 is axially aligned with the tube 810 (FIG. 9B), and positioned for insertion of the internal portion 832 into an open end (not shown) of the tube 810. It will be understood that, in FIG. 9B, the internal portion 832 is shown in the tube 810 after the insertion thereof into the open end. It will also be understood that, as described above, before the internal portion 832 is pushed into the open end of the tube 810, respective outer parts 852A-852C of the fins 840A-840C preferably are heated to a hot working temperature by heating elements (not shown) in an inert atmosphere. The parts 852A-852C are plastically deformable when they are at the hot working temperature. When the parts 852A-852C are heated to the hot working temperature, a temperature gradient results in the fins 840A-840C.

Preferably, the plug 812 is subjected to an engagement motion as the internal portion 832 is moved into the open end of the tube 810. The engagement motion may include, for example, axial motion and/or rotation or oscillation of the plug 812 about its axis "8X". Due to shearing, the engagement motion adds heat to the parts 852A-852C and to the inner surface 824.

While the plug 812 is subjected to the engagement motion, and also while the parts 852A-852C are at the hot working temperature, the plug 812 is also subjected to a translocation motion, to move the internal portion 832 into the open end of the tube 810. As the internal portion 832 is moved into the open end of the tube 810 and subsequently further into the tube 810, the parts 852A-852C engage one or more preselected parts 825 of a tube wall 819 of the tube 810. The preselected parts 825 are contiguous with an inner surface 824 of the tube wall 819. Upon such engagement, the parts 852A-852C are at least partially bent backwardly, i.e., they are partially bent in a direction opposite to the direction indicated by arrow "9A".

It will be understood that the use of more than one fin is preferred, because the risk of a leak from inside the tube is less likely if a number of fins are used to engage the inner surface 824. Also, because a number of relatively thin fins are utilized, the amount of pressure required to push the internal portion 832 into the tube, and the amount of torque required to rotate or oscillate the plug 812 about its axis "8X" are less that would be needed if the fins were thicker.

When an engagement surface 842 of the external portion 828 engages an end 815 of the tube 810 (as shown in FIG. 9B), the engagement motion continues, and the pressure urging the plug 812 in the direction indicated by arrow "9A" also continues, until the parts 852A-852C and the tube 810 are bonded together, as described above. In the same manner as described above, due to the parts 852A-852C being at the hot working temperature and also due to the engagement motion and the pressure applied to the plug 812 in the direction indicated by arrow "9A", the parts 852A-852C and the preselected parts 825 of the wall 819 are bonded together and form a bonded region with a substantially uniform microstructure.

Figure 10:
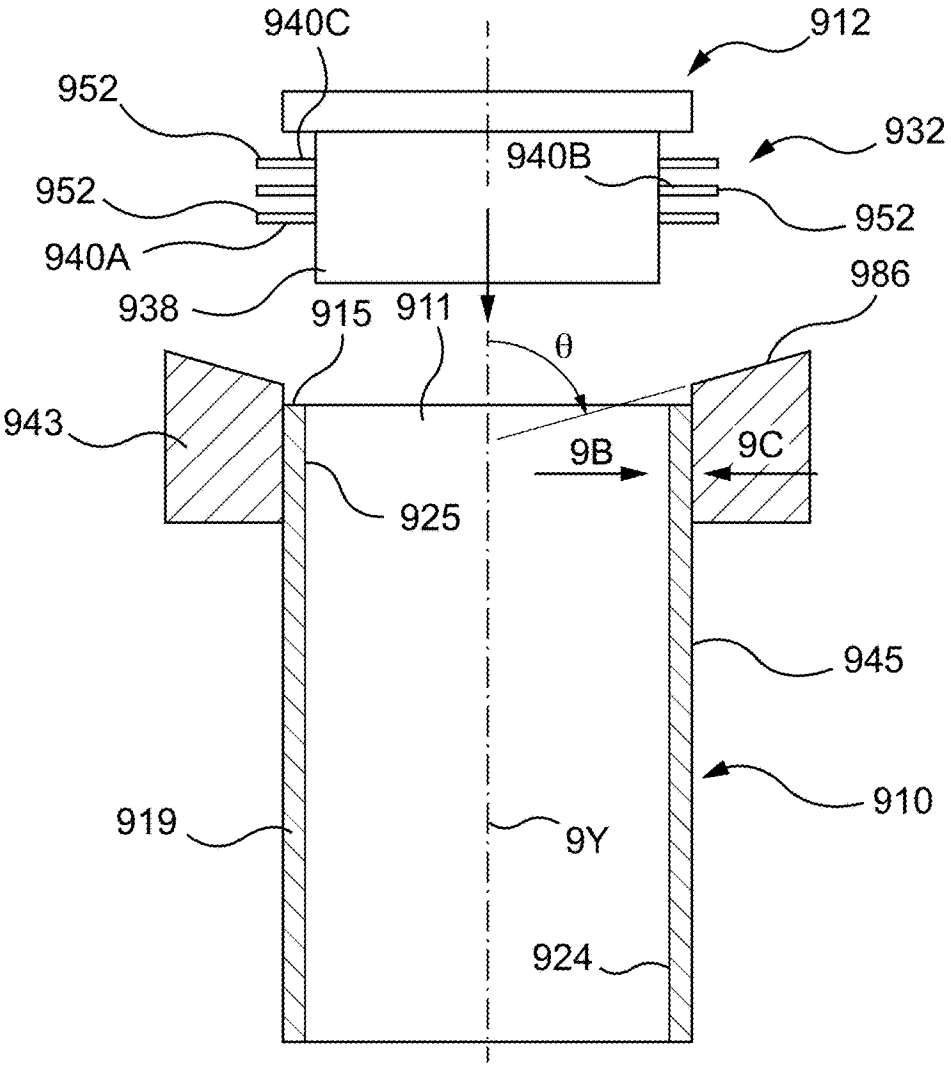
FIG. 10 is a side view of another embodiment of the end element of the invention and a partial cross-section of a receptacle with an embodiment of a clamp of the invention positioned on the receptacle.

As noted above, a clamp may be utilized to support the tube when the internal portion of the plug is inserted into the tube. As can be seen in FIG. 10, a tube 910 including a tube wall 919 defines an open end 911 thereof, at an end 915 of the tube wall 919. The tube 910 is round in cross-section, and defined by a tube axis "9Y". After a plug 912 has been suitably heated, the plug 912 is moved in the direction indicated by arrow "11A", to push an internal portion 932 of the plug 912 into the tube 910 via the open end 911.

It will be understood that the fins 940A-940C extend around the circumference of a body 938 of the internal portion 932 that is round in cross-section. The fins 940A-940C extend outwardly from the body 938. In the same manner as described above, outer parts 952 of the fins 940A-940C preferably are heated to a hot working temperature, by suitable heating elements (not shown in FIG. 10), in an inert atmosphere. The parts 952 are distal to the body 938. When they are at the hot working temperature, the outer parts 952 of the fins 940A-940C are plastically deformable, and the internal portion 932 is pushed into the open end 911.

It will be understood that the heating elements and a cover or container for containing the inert atmosphere are omitted from FIG. 10 for clarity of illustration.

In one embodiment, a clamp 943 preferably is provided that engages an outer surface 945 of the tube wall 919, generally at the end 915 of the tube 910. As can be seen in FIG. 10, the clamp 943 preferably is tightly engaged with the outer surface 945, to resist an outwardly-directed pressure exerted against one or more preselected parts 925 of the wall 919, when the internal portion 932 of the plug 912 is pushed into the open end 911. The preselected parts are contiguous with an inner surface 924 of the wall 919. The pressure exerted against the inner surface 924 when the plug is first inserted into the open end is schematically represented by arrow "9B" and the pressure exerted by the wall and the clamp in response thereto is also represented by arrow "9C" in FIG. 10. The clamp 943 is round in cross-section. It will be understood that the clamp 943 includes a mechanism (not shown) that can be used to release the clamp 943 from the outer surface 945, after the internal portion 932 is secured to the tube wall 919.

Preferably, the clamp 943 includes a camming surface 986 that is positioned at an acute angle θ relative to the tube axis "9Y". The camming surface 986 is engaged by the heated parts of the fins 940A-940C, which are plastically deformable, when the internal portion 932 is pushed into the open end 911. Those skilled in the art would appreciate that each of the heated parts 952 of the fins is deformed by its engagement with the camming surface 986 respectively, before each such heated engagement part 952 engages the preselected parts 925 of the wall 919. Specifically, as the internal portion 932 is pushed into the open end 911, each such heated part is bent partly in a direction opposite to the direction of movement of the plug 912, that is indicated by arrow "11A".

Those skilled in the art would also appreciate that the advantage provided by the camming surface 986 is that the extent to which the heated parts 952 of the fins are required to be bent upon engagement with the preselected parts 925 (as the internal portion 932 is moved into the open end 911) is reduced, due to the prior deformation of the heated engagement parts 952 when they engage the camming surface 986.

As the internal portion 932 is moved into the open end 911, the parts 952 first respectively engage the camming surface 986, and the parts 952 subsequently respectively engage the inner surface 924. Each of the parts 952 is bent, to an extent, due to its engagement with the camming surface 986, as the respective fins are moved past the camming surface 986. Because the extent to which the parts 952 are bent upon engagement with the preselected parts 925 is reduced, the pressure and torque required to be applied to the plug 912 (i.e., to continue the translocation motion and the engagement motion as the parts 952 respectively engage the inner surfaces 924) is somewhat reduced.

Because the tube 910 is a relatively thin-walled tube, it is desirable to minimize the pressure and torque required to be applied to the plug 912 in order to bond the plug 912 with the tube 910, so as to minimize the risk of rupturing the tube during insertion of the internal portion 932 in the open end 911.

As noted above, relatively thin-walled receptacles and end elements for closing open ends thereof are illustrated in FIGS. 2A-10. In FIGS. 11A-15B, the receptacle to be closed or covered may be, e.g., a nuclear waste container, in which radioactive waste from nuclear power generation operations or from other operations is stored. Those skilled in the art would appreciate that the waste container may not be thin-walled, and may have any suitable configuration. The containers or receptacles disclosed in FIGS. 11A-15B may be used for purposes other than nuclear waste containment. The container or receptacle may, for example, have walls that are approximately four inches thick, or less. Depending on the use to which the sealed container or receptacle may be put, the gastight seal created between the end elements and the receptacles illustrated in FIGS. 11A-15B may be subjected to higher gas pressures and greater stresses that the sealed tubes resulting from the embodiments of the invention illustrated in FIGS. 2A-10.

Also, the nuclear waste container wall may include two layers of different materials, e.g., an inner layer of a material that is resistant to corrosion or deterioration due to exposure to radiation, and an outer layer of suitable material, e.g., a suitable steel. Those skilled in the art would also appreciate that the material that is resistant to corrosion or deterioration due to exposure to radiation typically is relatively expensive (For clarity of illustration, the container is shown as being made of only one material in FIGS. 11A-15B.)

Figure 11A:
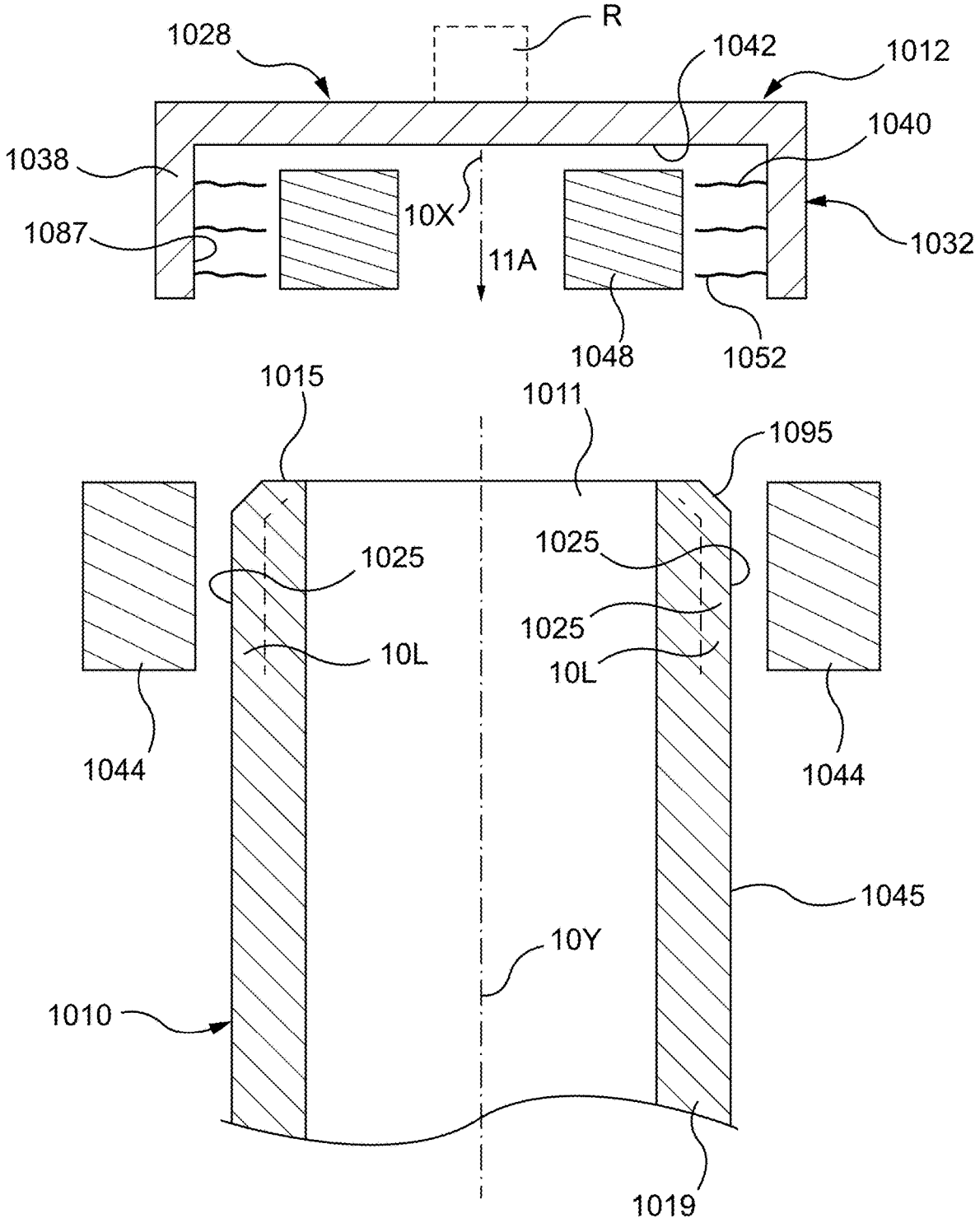
FIG. 11A is a cross-section of an embodiment of an end element of the invention and of a receptacle with an open end which the end element is formed to cover.
Figure 11B:
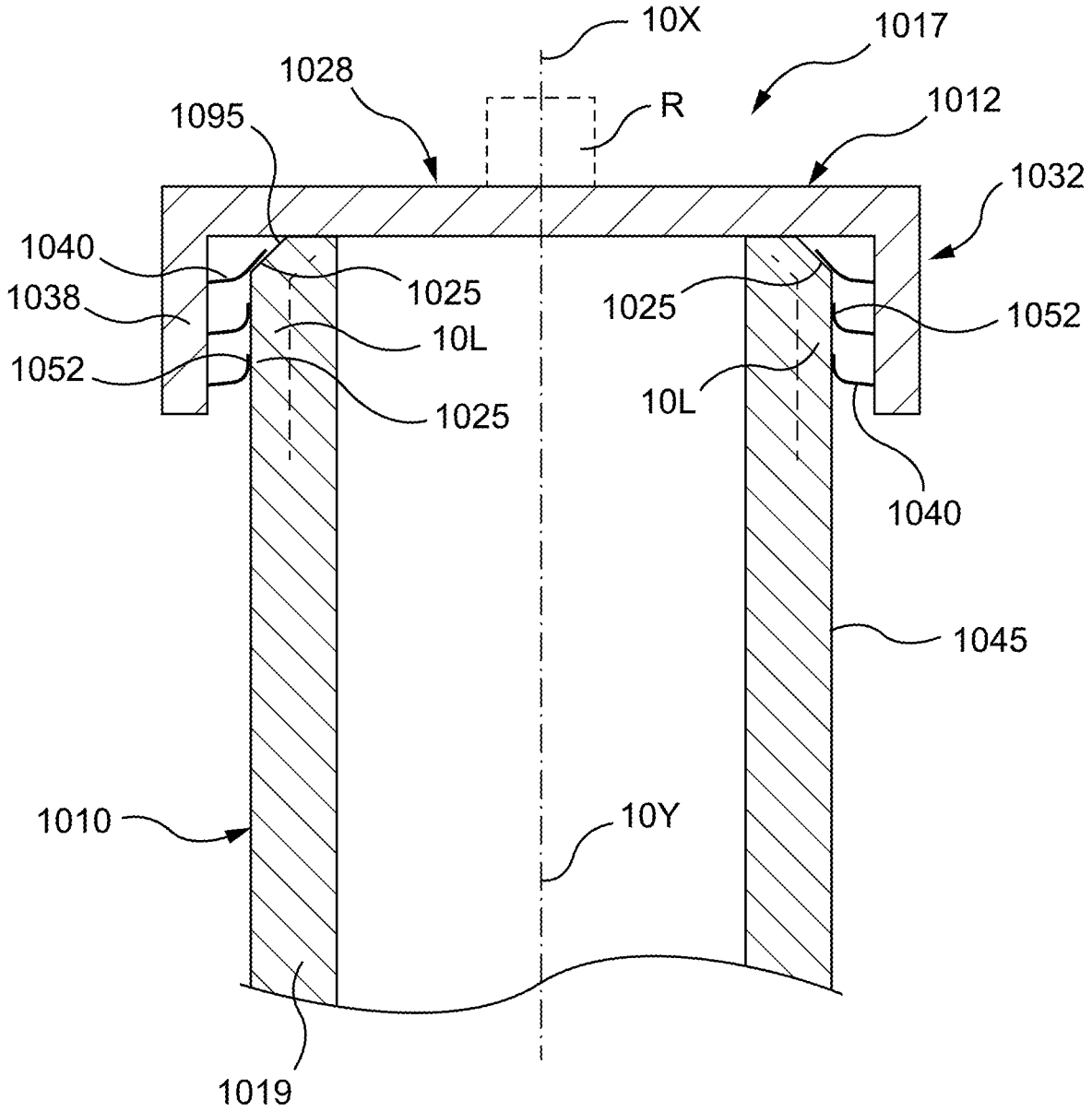
FIG. 11B is a cross-section of the receptacle and the end element of FIG. 11A with the end element covering the open end of the receptacle.

In another alternative embodiment, an open end 1011 of a receptacle or 1010 may be closed by an end element 1012 (FIG. 11B). As illustrated, the exemplary receptacle 1010 is round in cross-section, and defines a container axis "10Y". The receptacle 1010 includes a wall 1019 with an outer wall surface 1045 that at least partially defines an outer diameter 1026 of the container receptacle 1010.

As can be seen in FIG. 11A, in one embodiment, the end element 1012 preferably includes an external portion 1028 and an internal portion 1032. The end element 1012 preferably is formed for covering the open end 1011 of the receptacle 1010. As will be described, when the end element 1012 is covering the open end 1011, fins 1040 included in the internal portion 1032 at least partially engage one or more preselected parts 1025 of the wall 1019, the preselected parts 1025 being partially contiguous with the outer surface 1045 of the wall 1019.

The end element 1012 may also be round in cross-section, and formed to fit over the open end 1011. As can also be seen in FIG. 11A, the end element 1012 preferably is first positioned to be mounted over the open end 1011, with an end element axis "10X" of the end element 1012 aligned with the container axis "10Y".

The outer surface 1045 of the receptacle 1010 may include a bevelled surface 1095 at the end 1015 (FIG. 11A). The preselected parts 1025 include the bevelled surface 1095.

The end element 1012 defines the end element axis "10X". The external portion 1028 preferably includes a planar engagement surface 1042, for engagement with an end 1015 of the receptacle 1010, as will be described.

The internal portion 1032 includes a body 1038. The body 1038 preferably includes an inner wall surface 1087 that is formed to fit over the outer wall surface 1045 of the wall 1019. The internal portion 1032 also includes the fins 1040, which are mounted to the inner wall surface 1087. The external portion 1028 is formed to cover the open end 1011 of the receptacle 1010 when the internal portion 1032 is positioned to fit over the outer wall surface 1045 of the wall 1019, with the fins 1040 pressed between the inner wall surface 1087 and the outer wall surface 1045.

Preferably, prior to engagement, the one or more fins 1040 extend from the inner wall surface 1087 generally toward the end element axis "10X" (FIG. 11A). In the example illustrated in FIG. 11A, three fins 1040 are shown, however, it will be understood that any suitable number of fins may be used.

Prior to engagement, the fins 1040 preferably are positioned generally parallel to each other. In one embodiment, prior to the end element 1012 being positioned on the receptacle 1010, the fins 1040 preferably are positioned substantially orthogonally relative to the end cap axis "10X". However, prior to engagement of the end element 1012 with the receptacle 1010, the fins 1040 may be positioned in any suitable orientation relative to the end cap axis "10X".

As can be seen in FIG. 11A, before the end element 1012 is positioned on the open end 1011 of the receptacle 1010, each of the fins 1040 extends from the inner wall surface 1087 generally toward the end element axis "10X", and engagement parts 1052 of each fin 1040 are positioned distal to the inner wall surface 1087. As can be seen in FIG. 11A, in one embodiment, one or more heating elements 1048 preferably are provided, for heating at least the engagement parts 1052 of the fins 1040 in an inert atmosphere to a hot working temperature, at which the engagement parts 1052 are plastically deformable. It will be understood that the fins 1040 are relatively thin, and the engagement parts 1052 extend along the fins from the tips of the fins toward the inner wall surface 1087.

It is preferred that, prior to engagement, a heated wall layer "10L" of the receptacle wall 1019 is heated to a hot working temperature by one or more receptacle heating elements 1044, while the open end 1011 of the receptacle 1010 and the end element 1012 are generally covered by the inert atmosphere. While the heated layer "10L" is at the hot working temperature, it is subject to plastic deformation. It will be understood that the width of the heated layer "10L" is exaggerated as illustrated in FIGS. 11A and 11B, for clarity of illustration. A cover containing the inert atmosphere is omitted from FIGS. 11A and 11B, also for clarity of illustration.

It will be understood that the preselected parts 1025 are included in the heated layer "10L". The preselected parts 1025 extend from the outer wall surface 1045 into the wall 1019 a short distance, i.e., the preselected parts 1025 are contiguous with the outer wall surface 1045, but also extend a small distance into the wall 1019. It will be understood that the preselected parts 1025 are very small. It will also be understood that the heated layer "10L" extends from the outer wall surface 1045 into the wall 1019. When the preselected parts 1025 are at the hot working temperature, they are plastically deformable.

Next, the heating element 1048 is energized, for heating the engagement parts 1052 to the hot working temperature, at which, the engagement parts 1052 are plastically deformable. The internal portion 1032 (including the fins 1040) are also covered by the inert atmosphere while they are heated.

Those skilled in the art would appreciate that (i) the engagement parts 1052 and (ii) the heated layer "10L" may be heated to different hot working temperatures, depending on the materials.

After the engagement parts 1052 are heated to the hot working temperature thereof, the heating elements 1048 are removed. Similarly, after the heated layer "10L" is heated to the hot working temperature thereof, the receptacle heating elements 1044 are removed.

The end element 1012 preferably is then subjected to a translocation motion, causing the end element 1012 to move in the direction indicated by arrow "11A". It is also preferred that, at substantially the same time, the end element 1012 is subjected to an engagement motion, e.g., axial motion of the end element 1012, and/or rotation or oscillation of the end element 1012 about the end cap axis "10X", relative to the receptacle 1010. The engagement motion of the end element 1012 may commence before or after the translocation motion commences.

Alternatively, the engagement motion may commence upon engagement of the engagement parts 1052 with the preselected part 1025. A knob or projection "R" may be included in the external portion 1028, to facilitate the engagement motion of the end element 1012 relative to the receptacle 1010.

Preferably, while the heated layer "10L" and the engagement parts 1052 are at the hot working temperature(s), and while the end element 1012 is subjected to the engagement motion, the end element 1012 is moved in the direction indicated by arrow "11A" due to the translocation motion, urging the engagement parts 1052 and one or more preselected parts 1025 of the heated layer "10L" against each other, while one or both of the end element 1012 and the receptacle 1010 move relative to the other, until the engagement surface 1042 engages the end 1015 of the receptacle 1010.

It will be understood that the width of the heated layer "10L" as illustrated in FIG. 11A has been exaggerated, for clarity of illustration. The preselected parts 1025 of the wall 1019 are included in the heated layer "10L", and the preselected parts 1025 are contiguous with the outer wall surface 1045.

It is also preferred that, once the engagement surface 1042 engages the end 1015 (i.e., the translocation motion ceases), the engagement motion continues thereafter, until the end element 1012 and the receptacle 1010 are bonded together. Shearing of the engagement parts 1052 and the preselected parts 1025 takes place during engagement because they are plastically deformable. Due to shearing and friction, the engagement motion also adds heat to the parts 1052 and to the outer surface 1045. Also, although the end element 1012 does not move further in the direction indicated by arrow "11A" once the engagement surface 1042 engages the end 1015, the end element 1012 continues to be urged in the direction indicated by arrow "11A" relative to the receptacle 1010, until the end element 1012 and the receptacle 1010 are bonded together.

As the internal portion 1032 is moved onto the receptacle 1010, the engagement parts 1052 of the respective fins 1040 engage the preselected parts 1025 of the wall 1019. It will be understood that the fins 1040 preferably are relatively thin. As can be seen in FIG. 11B, due to the engagement of the engagement parts 1052 with the heated layer "10L" as the end element 1012 is moved in the direction indicated by arrow "11A", the fins 1040 are at least partially bent in a direction generally opposite to the direction indicated by arrow "11A".

The bevelled surface 1095 at the end 1015 is for engagement with each of the engagement parts 1052 respectively, as the end element 1012 is moved onto the receptacle 1010.

While the end element 1012 is moved by the translocation motion to engage the engagement parts 1052 with the preselected parts 1025, the end element 1012 preferably is also subject to the engagement motion. As a result, the engagement parts 1052 are scraped against and pressed against the preselected parts 1025 of the heated layer "10L", exerting partially laterally-directed pressure against the preselected parts 1025 of the heated layer "10L". The scraping engagement of the engagement parts 1052 of the fins 1040 against the preselected parts 1025 of the heated layer "10L" causes plastic deformation of the preselected parts 1025, and plastic deformation of the engagement parts 1052. Due to the engagement motion, the engagement parts 1052 and the preselected parts 1025 are pressed against the interior wall surface 1087 during relative motion thereof, to provide a gastight seal between the internal portion 1032 and the wall 1019 at the outer wall surface 1045.

In the same manner as described above, the engagement parts 1052 become bonded with the preselected parts 1025 of the heated layer "10L", due to the engagement motion of the end element 1012 while the parts 1052 are engaged with the preselected parts 1025 of the heated layer "10L", to form a metallic bond between the end element 1012 and the receptacle 1010 with a substantially uniform microstructure.

From the foregoing, it will be understood that the engagement parts 1052 of the fins 1040 that are bonded with the preselected parts 1025 form a gastight seal between the interior wall surface 1087 of the internal portion 1032 of the end element 1012 and the outer wall surface 1045 of the receptacle 1010, thereby sealing the end element 1012 and the receptacle 1010 together.

Those skilled in the art would appreciate that, in the embodiment illustrated, a number of relatively thin fins 1040 preferably are used because they are, collectively, likely to provide a gastight seal. The surface areas of the engagement part 1052 of each fin that are engaged with the outer surface 1045 during the engagement motion and the translocation motion are relatively small, and as a result, the pressure and the torque to which the end element 1012 is subjected in order to achieve the engagement motion and the translocation motion is minimized.

It is believed that the bond formed between the end element 1012 and the receptacle 1010 is relatively strong. For a stronger bond, a larger number of fins 1040 may be utilized, and a larger internal portion 1032 may be provided, in order to have more engagement parts 1052 engaging with the preselected parts 1025.

For convenience, the gastight sealed receptacle assembly (i.e., the receptacle 1010 with the end element 1012 bonded thereto) is identified by reference character 1017 in FIG. 11B.

The embodiment illustrated in FIGS. 11A and 11B has the advantage that the bonded material (i.e., the engagement parts 1052 of the fins 1040, and preselected parts 1025 of the wall 1019) is positioned on the exterior of the receptacle 1010, and so is generally shielded by the wall 1019 from embrittlement and corrosion that may result over time from exposure to radiation from waste material inside the sealed container 1017. Also, the fins 1040 and the other elements of the end element 1012 may be made of a relatively less expensive suitable material (e.g., steel), which would fairly readily bond with the relatively less expensive material (e.g., steel) of the outer surface 1045 of the receptacle 1010. An interior surface of the receptacle 1010 may, for example, include a corrosion-resistant material that is relatively expensive.

Preferably, prior to subjecting one or both of the end element 1012 and the receptacle 1010 to the translocation motion, the end element axis "10X" is aligned with the receptacle axis "10Y". It will be understood that the translocation motion may result from the movement of one or both of the end element 1012 and the receptacle 1010 toward the other. Also, the engagement motion may result from the movement of one or both of the end element 1012 and the receptacle 1010 relative to the other. The engagement motion may commence before, during, or after the translocation motion. For example, the engagement motion may commence upon engagement of the engagement parts 1052 with the preselected parts 1025.

Figure 12A:
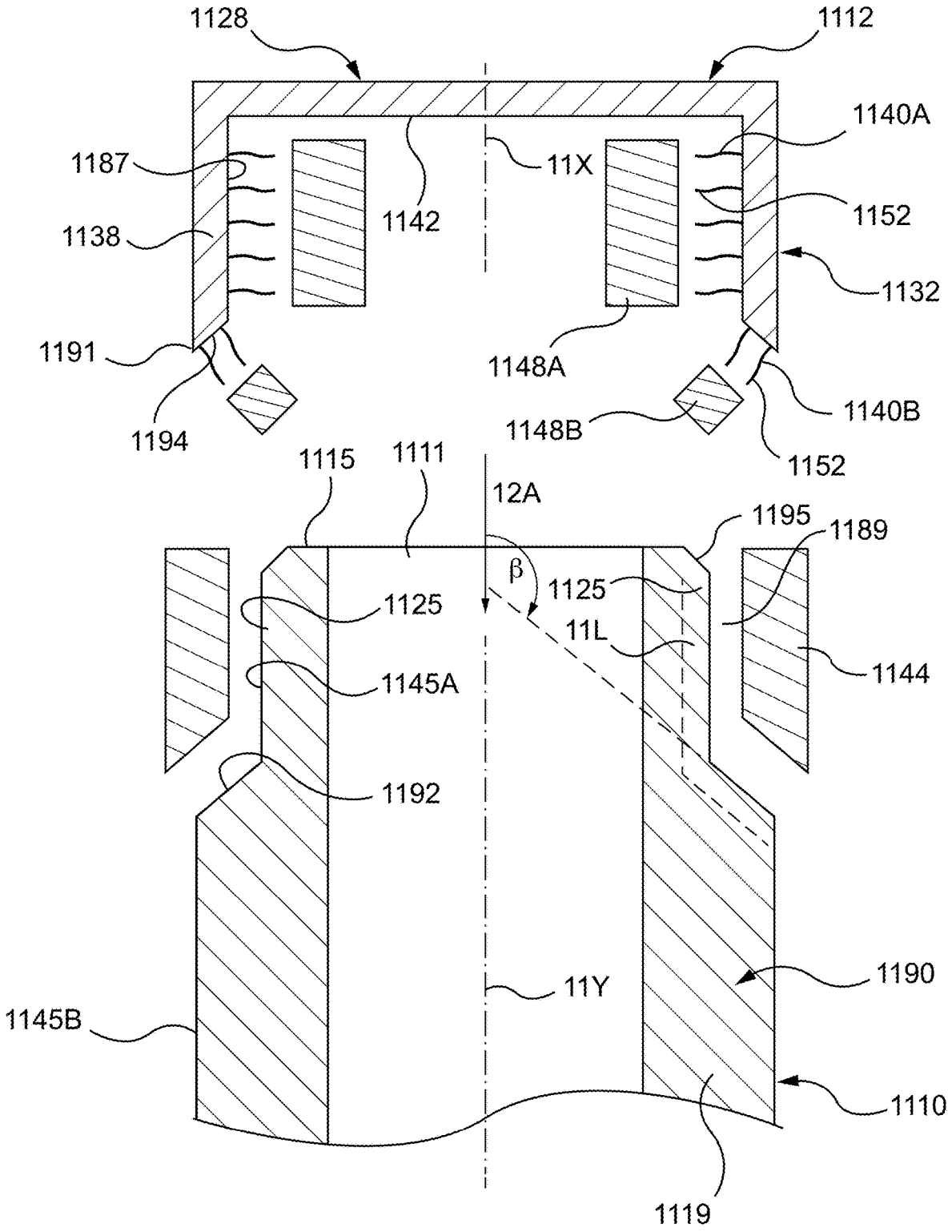
FIG. 12A is a cross-section of another embodiment of the end element of the invention and of the receptacle of the invention with an open end which the end element is formed to cover.

As can be seen in FIG. 12A, in one embodiment, a receptacle 1110 preferably includes a container wall 1119 with an end portion 1189 thereof extending between an open end 1111 of the receptacle 1110 and an intermediate portion 1190 that is distal to an end 1115 defining the open end 1111. The receptacle 1110 preferably defines a container axis "11Y" thereof.

The end portion 1189 has an outer surface 1145A thereof, and the intermediate portion also has an outer surface 1145B thereof (FIG. 12A). As can be seen in FIG. 12A, the outer surfaces 1145A, 1145B preferably are joined by a stop surface 1192 that is positioned at an obtuse angle β relative to the container axis "11Y". In one embodiment, the stop surface 1192 preferably is planar.

As can be seen in FIG. 12A, the outer surface 1145A of the receptacle 1110 may include a bevelled surface 1195 at the end 1115.

In one embodiment, a heated layer "11L" of the receptacle 1110 preferably is heated to a hot working temperature in an inert (non-oxidizing) atmosphere by one or more heating elements 1144 (FIG. 12A). It will be understood that the inert atmosphere is held in place by a cover or container that is omitted from FIGS. 12A and 12B for clarity of illustration.

Preferably, an end element 1112 is provided, to cover the open end 1111. The end element 1112 may be round in cross-section, and defines an end cap axis "11X" thereof. In one embodiment, the end element 1112 preferably includes an external or external portion 1128 and an internal portion 1132 (FIG. 12A). The internal portion 1132 preferably includes a body 1138 that includes an inner wall surface 1187. The internal portion 1132 preferably also includes fins 1140. When the end element 1112 covers the open end 1111, the internal portion 1132 preferably fits over the outer surface 1145A of the receptacle 1010, on the end portion 1189.

As can be seen in FIG. 12A, the end element 1112 preferably is first positioned spaced apart from the open end 1111 to be mounted onto the end portion 1189 over the open end 1111, with the end cap axis "11X" aligned with the container axis "11Y".

In one embodiment, the external portion 1128 preferably is generally planar. The external portion 1128 preferably includes a planar engagement surface 1142, for engagement with the end 1115 of the receptacle 1110 when the end element 1112 is positioned on the end portion 1189, as will be described. The body 1138 extends between the external portion 1128 and an end 1191 thereof that is distal to the external portion 1128.

The body 1138 preferably includes the substantially planar interior wall surface 1187 that preferably is positioned orthogonal to the engagement surface 1142, and parallel to the end cap axis "11X". It is also preferred that the body 1138 includes an end surface 1194 located at the end 1191 of the body 1138.

Preferably, the end element 1112 includes one or more fins. As can be seen in FIG. 12A, before the end element 1112 is positioned on the end portion 1189 to cover the open end 1111, certain of the fins extend generally inwardly from the interior surface 1187, and certain others of the fins extend from the end surface 1194.

Figure 12B:
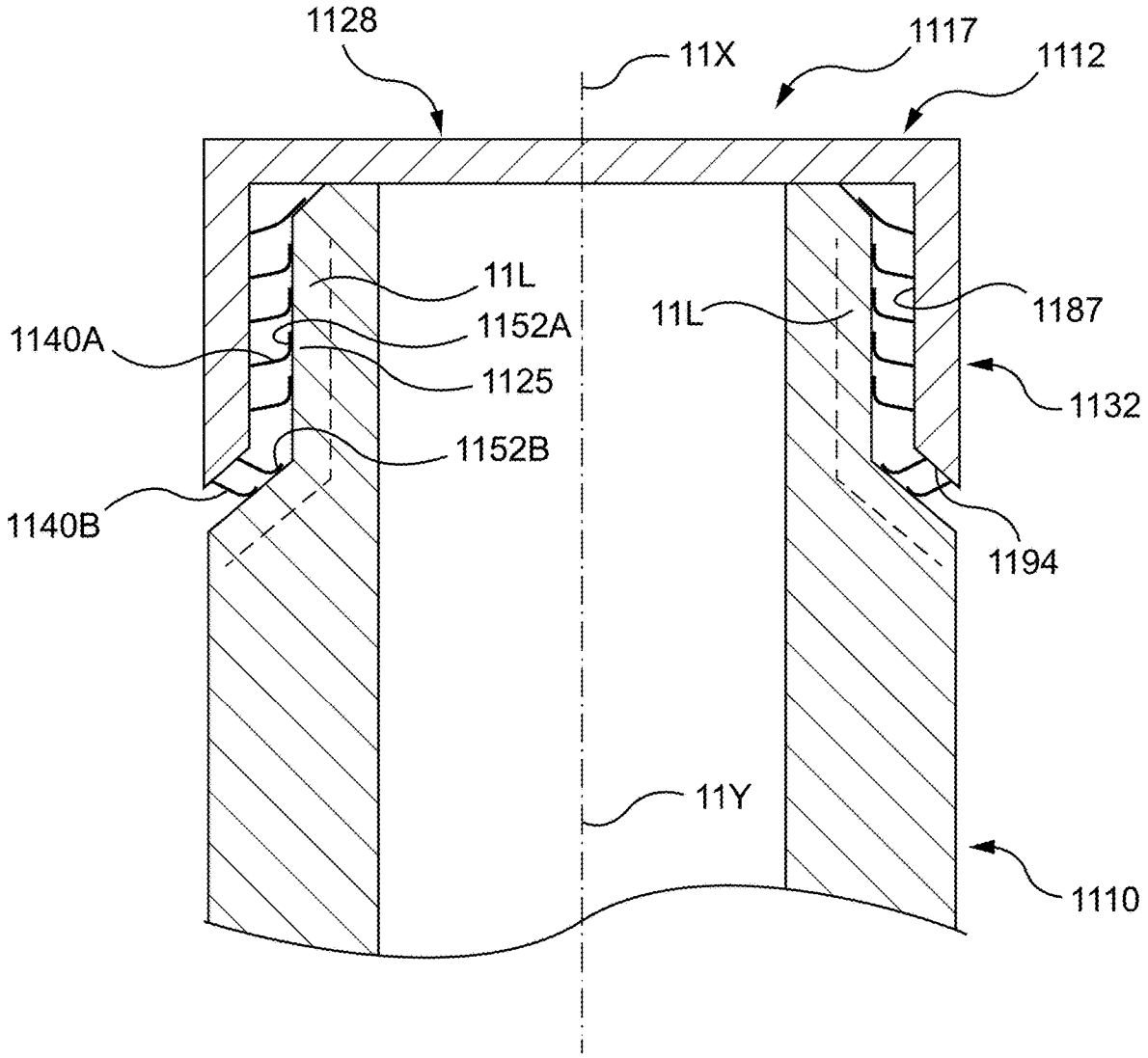
FIG. 12B is a cross-section of the receptacle and the end element of FIG. 12A with the end element covering the open end of the receptacle.

For clarity of illustration, the fins extending from the interior surface 1187 are identified by reference character 1140A in FIG. 12B, and the fins extending from the end surface 1194 are identified by reference character 1140B. As illustrated in FIG. 12A, before engagement, the fins 1140A may extend substantially orthogonally from the interior surface 1187, and the fins 1140B may extend substantially orthogonally from the end surface 1194.

When the end element 1112 is positioned on the receptacle 1110 and the engagement surface 1142 is engaged with the end 1115, the interior surface wall 1187 fits over the outer wall surface 1145, with the fins 1140A that are mounted to the interior surface wall 1187 pressed therebetween (FIG. 12B).

As will be described, it is preferred that, when the end element 1112 is positioned on the end portion 1189 and the engagement surface 1142 is engaged with the end 1115 of the receptacle 1110, the end surface 1194 fits over the stop surface 1192, with the fins 1140B that are mounted to the end surface 1194 pressed therebetween (FIG. 12B). As can be seen in FIG. 12A, in one embodiment, the end surface 1194 preferably is substantially planar.

Preferably, one or more heating elements 1148A are provided, for heating engagement parts 1152 of the fins 1140A to the hot working temperature, at which the engagement parts 1152 are plastically deformable. Also, one or more supplementary end element heating elements 1148B preferably are provided, for heating the engagement parts 1152 of the fins 1140B to the hot working temperature, at which the engagement parts 1152 of the fins 1140B are plastically deformable. Such heating may be, e.g., induction heating. Preferably, the engagement parts 1152 are heated in an inert atmosphere.

In one embodiment, the heated wall layer "11L" preferably is heated, by the heating element(s) 1144 and in an inert atmosphere, to a hot working temperature, at which the heated layer "11L" is plastically deformable. Once the heated layer "11L" is at the hot working temperature, the heating element 1144 is removed. It will be understood that the heated layer "11L" is shown only on the right-hand side of the container as shown in FIG. 12A for clarity of illustration. As illustrated, the heated layer "11L" is exaggerated, for clarity of illustration.

Once the engagement parts 1152 are at the hot working temperature, the heating element 1148A and the supplementary end element heating element 1148B are removed.

While the heated layer "11Y" and the engagement parts 1152 are at the hot working temperature(s), the end element 1112 preferably is subjected to a translocation motion, moving the end element 1112 in the direction indicated by arrow "12A". At the same time or at substantially the same time, the end element 1112 preferably is also subjected to an engagement motion, in which the end element 1112 is moved relative to the receptacle 1110. The engagement motion may be, for example, axial motion of the end cap, and/or rotation or oscillation of the end element 1112 about the axis "11X".

The engagement parts 1152 of the fins 1140 are plastically deformed upon engagement thereof with one or more preselected parts 1125 of the wall 1119.

The preselected parts 1125 are included in the heated layer "11L". Also, the preselected parts 1125 are contiguous with the outer wall surface 1145A and the stop surface 1192. Accordingly, when the preselected parts 1125 are engaged by the engagement parts 1152, both the preselected parts 1125 and the engagement parts 1125 preferably are subjected to plastic deformation thereof. The engagement parts 1152 preferably are distal to the surfaces 1187, 1194 on which the fins 1140A, 1140B are mounted.

The heated layer "11L", and the preselected parts 1125, extend from the outer wall surface 1145 and the stop surface 1192 into the wall 1119.

Due to the engagement motion and the translocation motion, the engagement parts 1152 are urged against the preselected part(s) 1125 of the heated layer "11L" at the outer wall surface 1145 as the end element 1112 is pushed onto the end portion 1189, in the direction indicated by arrow "12A". The movement of the end element 1112 in the direction indicated by arrow "12A" stops when the engagement surface 1142 engages the end 1115 of the receptacle 1110.

When the engagement surface 1142 engages the end 1115 of the receptacle 1110, the engagement parts 1152 of the fins 1140B are plastically deformed between the end surface 1194 and the preselected parts 1125 at the stop surface 1192.

The engagement motion continues until at least some of the engagement parts 1152 and the preselected parts of the heated layer "11L" are bonded together. Due to shearing, the engagement motion adds heat to the engagement parts 1152 and to the preselected parts 1125 of the wall 1119.

It will be understood that the engagement parts 1152 of the fins 1140A are initially plastically deformed by their respective engagements with the bevelled surface 1195 as the fins 1140A respectively move past the bevelled surface 1195, when the end element 1112 is subjected to the translocation motion.

It will also be understood that, after the translocation motion has ceased, the engagement motion continues, and the end element 1112 is also urged in the direction indicated by arrow "12A", until the engagement parts 1152 and the preselected parts 1125 are bonded together. Due to the engagement motion, the engagement parts 1152 and the preselected parts 1125 are pressed against the interior wall surface 1187 during relative motion thereof to provide a gastight seal between the internal portion 1132 and the wall 1119 at the outer wall surface 1145 and at the stop surface 1192. Because the preselected parts 1125 and the engagement parts 1152 are at the hot working temperature, at least some of the preselected parts 1125 and the engagement parts 1152 become bonded together. As described above, due to shearing because of the engagement motion, the crystalline microstructure of the preselected parts 1125 and the engagement parts 1152 is formed into a substantially uniform microstructure bonding the preselected parts 1125 and the engagement parts 1152 together.

For convenience, the gastight sealed receptacle assembly (i.e., the receptacle 1110 with the end element 1112 bonded thereto) is identified by reference character 1117 in FIG. 12B.

Figure 13A:
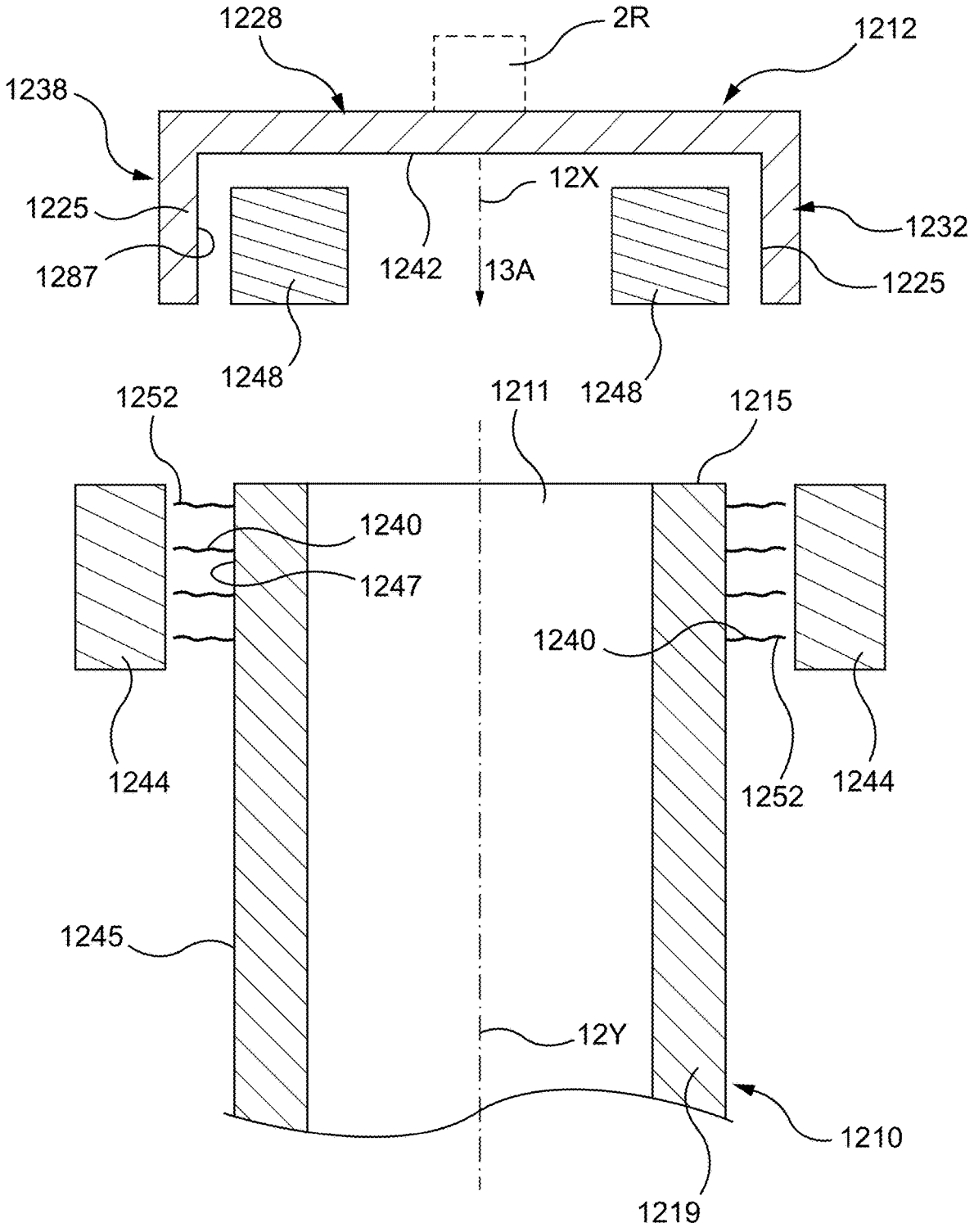
FIG. 13A is a cross-section of another embodiment of the end element of the invention and of the receptacle of the invention with an open end which the end element is formed to cover.
Figure 13B:
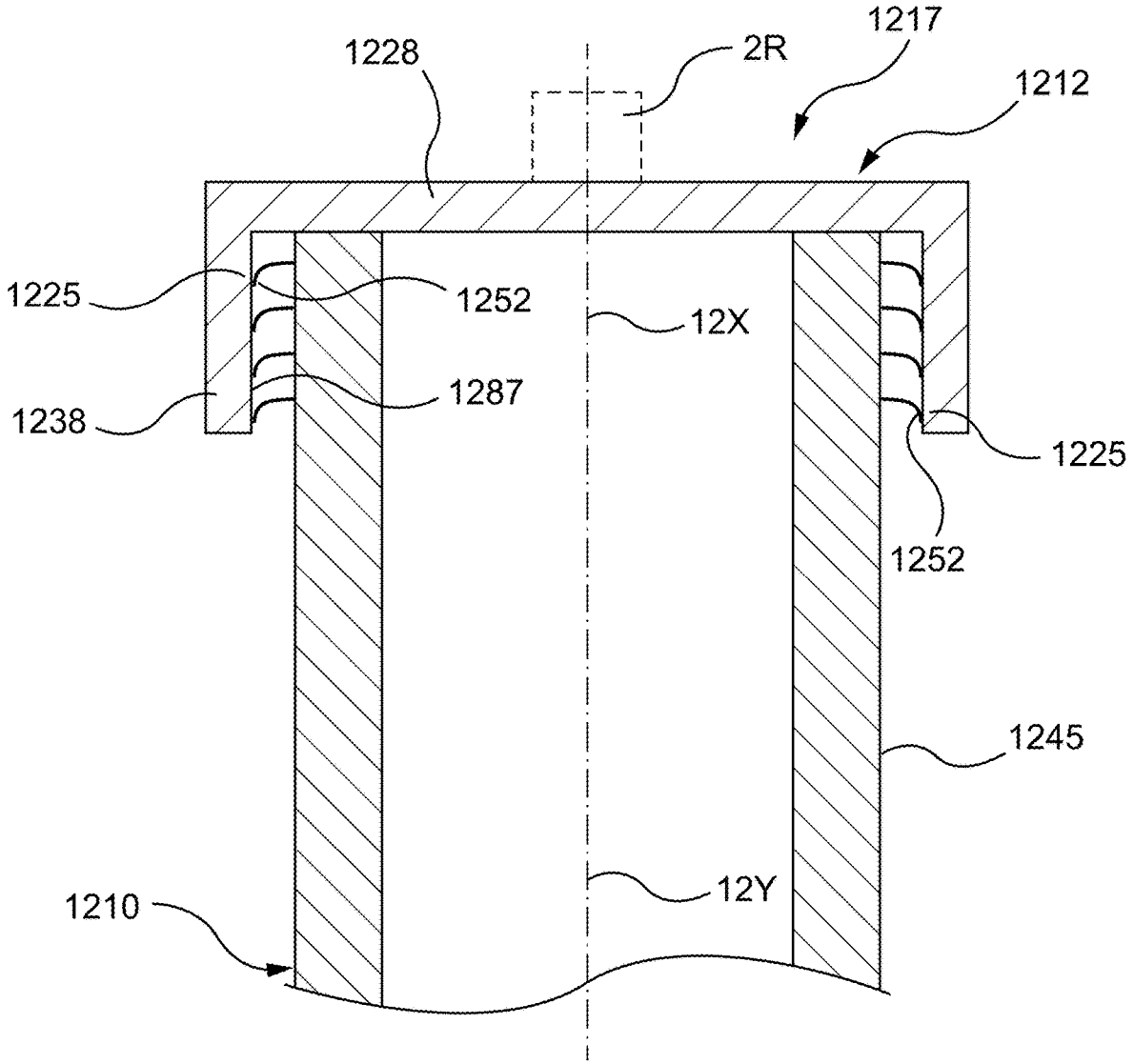
FIG. 13B is a cross-section of the receptacle and the end element of FIG. 13A with the end element covering the open end of the receptacle.

In another alternative embodiment, an open end 1211 of a receptacle 1210 may be closed or covered by an end element 1212 (FIGS. 13A, 13B). In one embodiment, the receptacle 1210 preferably defines a container axis "12Y" thereof. As can be seen in FIG. 13A, in one embodiment, the end element 1212 preferably includes an external or external portion 1228 and an internal portion 1232. The internal portion 1232 includes a body 1238 that includes an inner wall surface 1287. As will be described, when the end element 1212 is positioned to cover the open end 1211, one or more preselected parts 1225 of the body 1238 are engaged by engagement parts 1252 of fins 1240 extending from an outer wall surface 1245 of the receptacle 1210.

The end element 1212 preferably defines an end element axis "12X" thereof. In one embodiment, the fins 1240 preferably are mounted to a preselected portion 1247 of the outer wall surface 1245. The inner wall surface 1287 preferably is formed to fit over the preselected portion 1247 of the outer wall surface 1245, with the fins 1240 positioned therebetween.

Preferably, when the internal portion 1232 is positioned on the preselected portion 1247, the external portion 1228 is located over the open end 1211, to cover the open end 1211. As can also be seen in FIG. 13A, the end element 1212 preferably is initially spaced apart from the receptacle 1210, and positioned to be mounted over the open end 1211, with the end element axis "12X" of the end element 1212 aligned with the receptacle axis "12Y".

Preferably, the external portion 1228 includes a planar engagement surface 1242, for engagement with an end 1215 of the receptacle 1210 when the end element 1212 is on the receptacle 1210, as will be described.

In one embodiment the body 1238 preferably is positioned orthogonal to the engagement surface 1242, and parallel to the end cap axis "12X". The preselected parts 1225 are contiguous with the inner wall surface 1287. When the end element 1212 is positioned on the receptacle 1210, the inner wall 1287 preferably fits over the preselected portion 1247 with the fins 1240 therebetween, and the external portion 1228 covers the open end 1211 (FIG. 13B).

As can be seen in FIG. 13A, prior to engagement, the fins 1240 preferably are positioned generally parallel to each other. In one embodiment, prior to the end element 1212 being positioned on the receptacle 1210, the fins 1240 preferably are positioned substantially orthogonally relative to the receptacle axis "12Y". However, prior to engagement of the end element 1212 with the receptacle 1210, the fins 1240 may be positioned in any suitable orientation relative to the container axis "12Y".

As can also be seen in FIG. 13A, before the end element 1212 is positioned to cover the open end 1211 of the receptacle 1210, each of the fins 1240 extends from the preselected portion 1247 of the outer wall surface 1245 generally outwardly, away from the container axis "12Y", and engagement parts 1252 of each fin 1240 are positioned distal to the outer wall surface 1245.

It is preferred that, prior to engagement, the parts 1252 of the fins 1240 are heated to a hot working temperature by one or more fin heating elements 1244, while the open end 1211 of the receptacle 1210 and the fins 1240 and the end element 1212 are covered by an inert atmosphere. While the engagement parts 1252 are at the hot working temperature, they are plastically deformable. It will be understood that a cover containing the inert atmosphere is omitted from FIGS. 13A and 13B, for clarity of illustration.

Also, one or more heating elements 1248 preferably are provided, for heating at least one or more preselected parts 1225 of the body 1238 to the hot working temperature, at which the preselected parts 1225 are plastically deformable.

When the engagement parts 1252 are heated to the hot working temperature, the fin heating elements 1244 are removed. Also, when the preselected parts 1225 are heated to the hot working temperature (preferably, at approximately the same time as the engagement parts 1225 are heated to the hot working temperature), the heating element 1248 preferably is removed.

While the engagement parts 1252 and the preselected parts 1225 are at the hot working temperature, the end element 1212 preferably is subjected to the translocation motion, causing the end element 1212 to move relative to the receptacle 1210, i.e., in the direction indicated by arrow "13A".

It will be understood that one or both of the end element 1212 and the receptacle 1210 may be moved toward the other, to achieve the translocation motion.

In one embodiment, it is also preferred that the end element 1212 is subjected to an engagement motion, i.e., motion relative to the receptacle 1210, before or after commencement of the translocation motion. The engagement motion may commence, for example, upon the engagement parts 1252 engaging the preselected parts 1225.

The engagement motion may be, for example, axial motion of the end element 1212 relative to the receptacle 1210, or rotation or oscillation of the end element 1212 about the end cap axis "12X", thereby also causing the internal portion 1232 of the end element 1212 to move relative to the receptacle 1210. A knob or projection "2R" may be included in the external portion 1228, to facilitate the engagement motion of the end element 1212 relative to the receptacle 1210.

Preferably, while the engagement parts 1252 are at the hot working temperature, and while the preselected parts 1225 are at the hot working temperature, the end element 1212 is moved in the direction indicated by arrow "13A" in the translocation motion, until the engagement surface 1242 engages the end 1215 of the receptacle 1210. As noted above, the end element 1212 may be subjected to the engagement motion before or after the translocation motion begins. Alternatively, the engagement motion may commence upon the engagement parts 1252 engaging the preselected parts 1225 of the body 1238.

It is also preferred that, once the engagement surface 1242 engages the end 1215, although the translocation motion ends at that point, the engagement motion continues, until the end element 1212 and the receptacle 1210 are bonded together due to shearing of the plastically deformable engagement parts 1252 and the preselected parts 1225 as they are urged together. It will be understood that, although the end element 1212 does not move further in the direction indicated by arrow "13A" once the engagement surface 1242 has engaged the end 1215, the end element 1212 thereafter continues to be urged in the direction indicated by arrow "13A", until the end element 1212 and the receptacle 1210 are bonded together.

As the internal portion 1232 is moved onto the receptacle 1210, the engagement parts 1252 of the respective fins 1240 engage the preselected parts 1225 of the body 1238. It will be understood that the fins 1240 preferably are relatively thin. As can be seen in FIG. 13B, due to the engagement of the engagement parts 1252 with the preselected parts 1225 of the body 1238 as the end element 1212 is moved in the direction indicated by arrow "13A", the engagement parts 1252 are at least partially bent in a direction generally similar to the direction indicated by arrow 13A.

It will be understood that the engagement parts 1252 respectively engage the preselected parts 1225 of the body 1238, due to the translocation motion.

Due to the engagement motion, the engagement parts 1252 and the preselected parts 1225 are pressed against the interior wall surface 1287 during relative motion thereof to provide a gastight seal between the internal portion 1232 and the wall 1219 at the outer wall surface 1245. In the same manner as described above, due to the engagement motion of the end element 1212 while the engagement parts 1252 are engaged with the preselected parts 1225 of the body 1238, the engagement parts 1252 and the preselected parts 1225 form a metallic bond with a substantially uniform microstructure, bonding the end element 1212 and the receptacle 1210 together to form a gastight sealed receptacle assembly 1217 (FIG. 13B).

From the foregoing, it will be understood that at least some of the engagement parts 1252 of the fins 1240 that are bonded with the preselected parts 1225 of the body 1238 form a gastight seal between the outer surface 1245 of the receptacle 1210 and the preselected parts 1225 of the body 1238.

Those skilled in the art would appreciate that, in the embodiment illustrated, a number of relatively thin fins are used because one or more of them are likely to provide a gastight seal.

Figure 14A:
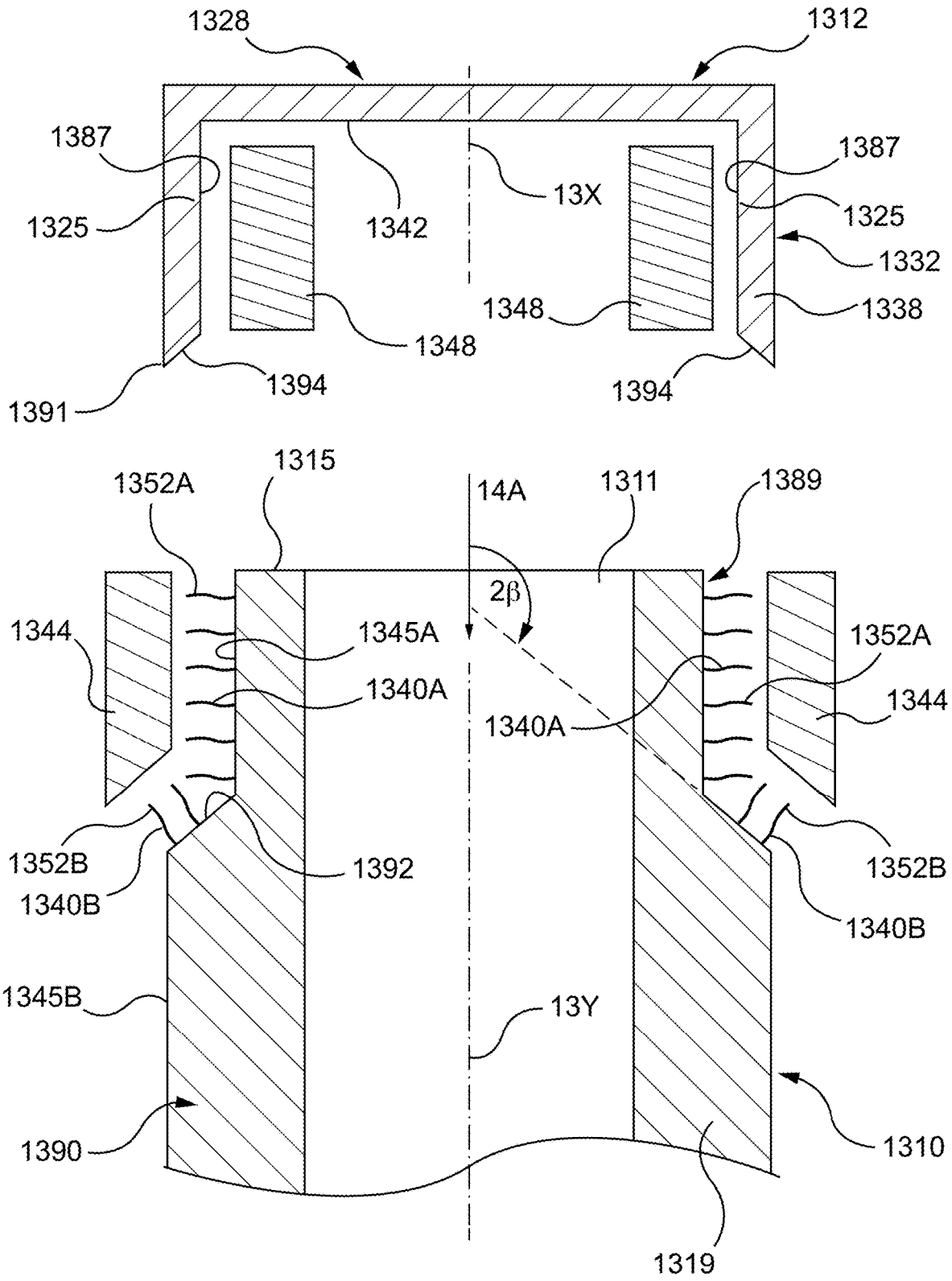
FIG. 14A is a cross-section of another embodiment of the end element of the invention and of the receptacle of the invention with an open end which the end element is formed to cover.

As can be seen in FIG. 14A, in one embodiment, a receptacle 1310 has an open end 1311, and defines a receptacle axis "13Y". The receptacle 1310 includes a wall 1319 with an end portion 1389 thereof extending between an open end 1311 of the receptacle 1310 and an intermediate portion 1390. The end portion 1389 defines the open end 1311 of the receptacle 1310.

The end portion 1389 has an outer surface 1345A thereof, and the intermediate portion 1390 also has an outer surface 1345B thereof (FIG. 14A). As can be seen in FIG. 14A, the outer surfaces 1345A, 1345B preferably are joined by a stop surface 1392 that is positioned at an obtuse angle 2ß relative to the container axis "13Y". In one embodiment, the stop surface 1392 preferably is planar.

Preferably, the receptacle 1310 includes a number of fins extending outwardly (i.e., away from the container axis "13Y") from the outer surface 1345A, prior to engagement.

Figure 14B:
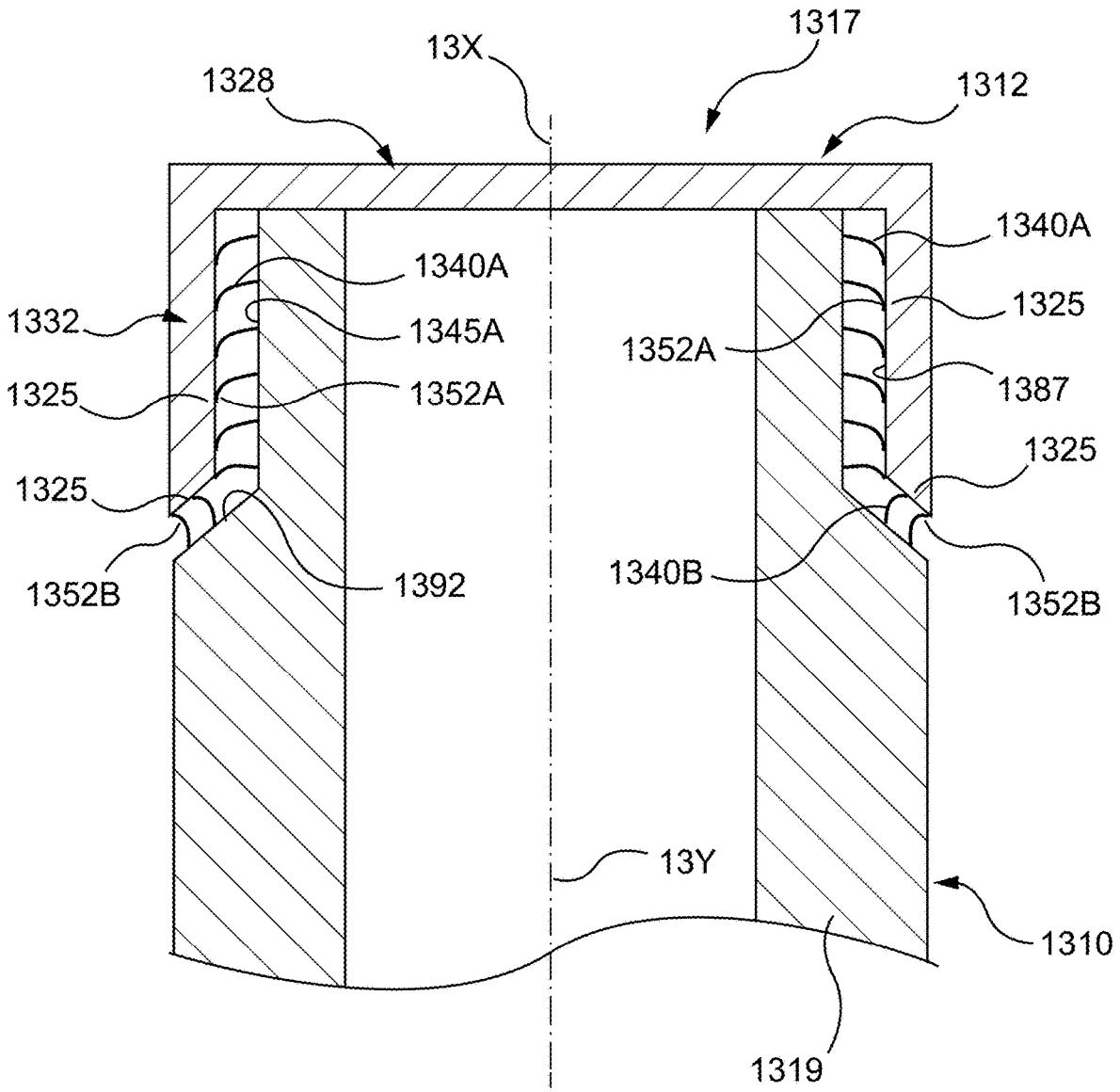
FIG. 14B is a cross-section of the end element and the receptacle of FIG. 14A with the end element covering the open end.

For convenience, the fins extending from the surface 1345A are identified by reference character 1340A in FIG. 14B. Each of the fins 1340A includes an engagement part 1352A thereof that is distal to the outer surface 1345A (FIG. 14B). It is also preferred that the receptacle 1310 includes fins extending outwardly from the stop surface 1392, and the fins extending from the stop surface 1392 are identified by reference character 1340B in FIG. 14B. Each of the fins 1340B includes an engagement part 1352B thereof that is distal to the stop surface 1392.

In one embodiment, the engagement parts 1352A, 1352B preferably are heated to a hot working temperature in an inert (non-oxidizing) atmosphere by one or more heating elements 1344 (FIG. 14A). It will be understood that the inert atmosphere is held in place by a cover or container that is omitted from FIGS. 14A and 14B for clarity of illustration.

Preferably, an or end element 1312 is provided, to cover the open end 1311. The end element 1312 preferably defines an end cap axis "13X" thereof. In one embodiment, the end element 1312 preferably includes a planar external or external portion 1328 and an internal portion 1332 (FIG. 14A). As can be seen in FIG. 14A, the internal portion 1332 preferably includes a body 1338 with a substantially planar interior surface 1387 positioned orthogonally relative to the external portion 1328. As can also be seen in FIG. 14A, the end element 1312 preferably is first positioned spaced apart from the open end 1311 to be mounted onto the end portion 1389 over the open end 1311, with the end cap axis "13X" aligned with the container axis "13Y".

The external portion 1328 preferably includes a planar engagement surface 1342, for engagement with the end 1315 of the receptacle 1310 when the end element 1312 is positioned on the end portion 1389, as will be described. The body 1338 extends between the external portion 1328 and an end 1391 thereof that is distal to the external portion 1328.

In one embodiment, the interior surface 1387 preferably is positioned orthogonal to the engagement surface 1342, and parallel to the end cap axis "13X". When the end element 1312 is positioned on the end portion 1389 and the engagement surface 1342 is engaged with the end 1315 of the receptacle 1310, the interior surface 1387 fits over the outer wall surface 1345A, with the fins 1340A therebetween.

It is also preferred that the body 1338 includes an end surface 1394 located at the end 1391 of the body 1338. As will be described, it is also preferred that, when the end element 1312 is positioned on the end portion 1389 and the engagement surface 1342 is engaged with the end 1315 of the receptacle 1310, the end surface 1394 fits over the stop surface 1392, with the fins 1340B therebetween. (FIG. 14B). As can be seen in FIG. 14A, in one embodiment, the stop surface 1392 and the end surface 1394 preferably are both substantially planar.

Preferably, one or more heating elements 1348 are provided, for heating preselected parts 1325A of the body element 1338 to the hot working temperature in the inert atmosphere, at which the preselected parts 1325A are plastically deformable. The preselected parts 1325A are contiguous with the interior wall surface 1387 (FIG. 14A).

The heating elements 1348 are also configured to heat preselected parts 1325B of the body element 1338 to the hot working temperature in the inert atmosphere at which the preselected parts 1325B are plastically deformable. The preselected parts 1325B are contiguous with the end surfaces 1394 (FIG. 14A).

In one embodiment, the engagement parts 1352A, 1352B preferably are heated, by the heating element(s) 1344 and in an inert atmosphere, to a hot working temperature, at which the parts 1352A, 1352B are plastically deformable. When the parts 1352A, 1352B are at the hot working temperature, the heating element 1344 is removed.

When the preselected parts 1325A, 1325B are at the hot working temperature, the heating elements 1348 are also removed, to permit movement of the end element 1312 toward the receptacle 1310, or vice versa.

It will be understood that the preselected parts 1325A, 1325B and the engagement parts 1352A, 1352B may be heated to different hot working temperatures. Those skilled in the art would be aware of suitable hot working temperatures for various materials.

While the parts 1352A, 1352B and the preselected parts 1325 are at the hot working temperature(s), the end element 1312 preferably is subjected to a translocation motion, moving the end element 1312 in the direction indicated by arrow "15A" (FIG. 14A). At the same time or at substantially the same time, the end element 1312 preferably is also subjected to an engagement motion, in which the end element 1312 is moved relative to the receptacle 1310. The engagement motion may be, for example, axial motion of the end cap, and/or rotation or oscillation of the end element 1312 about the axis "13X".

It will be understood that the translocation motion may be achieved by movement of one or both of the end element 1312 and the receptacle 1310 toward each other. It will also be understood that the engagement motion may commence before or after the translocation motion commences. The engagement motion may commence upon engagement of the preselected parts 1325A, 1325B with the engagement parts 1352A, 1352B.

As can be seen in FIGS. 14A and 14B, due to the engagement motion and the translocation motion, the engagement parts 1352A are urged against the preselected parts 1325A as the end element 1312 is pushed onto the end portion 1389, in the direction indicated by arrow "14A". Also, the engagement parts 1352B are urged against the preselected parts 1325B of the body portion 1338. The movement of the end element 1312 relative to the receptacle 1310 in the direction indicated by arrow "14A" stops when the engagement surface 1342 engages the end 1315 of the receptacle 1310 (as shown in FIG. 14B).

It will be understood that, when the engagement parts 1352A engage the preselected parts 1325A, because they are at the hot working temperature, the engagement parts 1352A and the preselected parts 1325A are plastically deformed. It will also be understood that, when the engagement parts 1352B engage the preselected parts 1325B, the parts 1352B and the preselected parts 1325B are plastically deformed.

After the translocation motion has ceased, the engagement motion continues, and the end element 1312 is also urged in the direction indicated by arrow "14A", until the engagement parts 1352A and the preselected parts 1325A of the body element 1338 are bonded together due to shearing, and the engagement parts 1352B and the preselected parts 1325B of the body element 1338 are bonded together.

In the same manner as described above, the engagement parts 1352A are bonded with preselected parts 1325A of the body element 1338, to form a metallic bond therebetween having a substantially uniform microstructure. Similarly, the engagement parts 1352B are bonded with the preselected parts 1325B of the body element 1338, to form a metallic bond therebetween having a substantially uniform microstructure.

Due to the engagement motion, the engagement parts 1352A and the preselected parts 1325A are pressed against the outer wall surface 1345A during relative motion thereof to provide a gastight seal between the wall 1319 and the internal portion 1332 at the interior wall surface 1387, and the engagement parts 1352B and the preselected parts 1325B are pressed against the stop surface 1392 to provide a gastight seal between the wall 1319 and the internal portion 1332 at the end surface 1392. The resulting gastight sealed container assembly is identified by reference character 1317 (FIG. 14B).

Figure 15A:
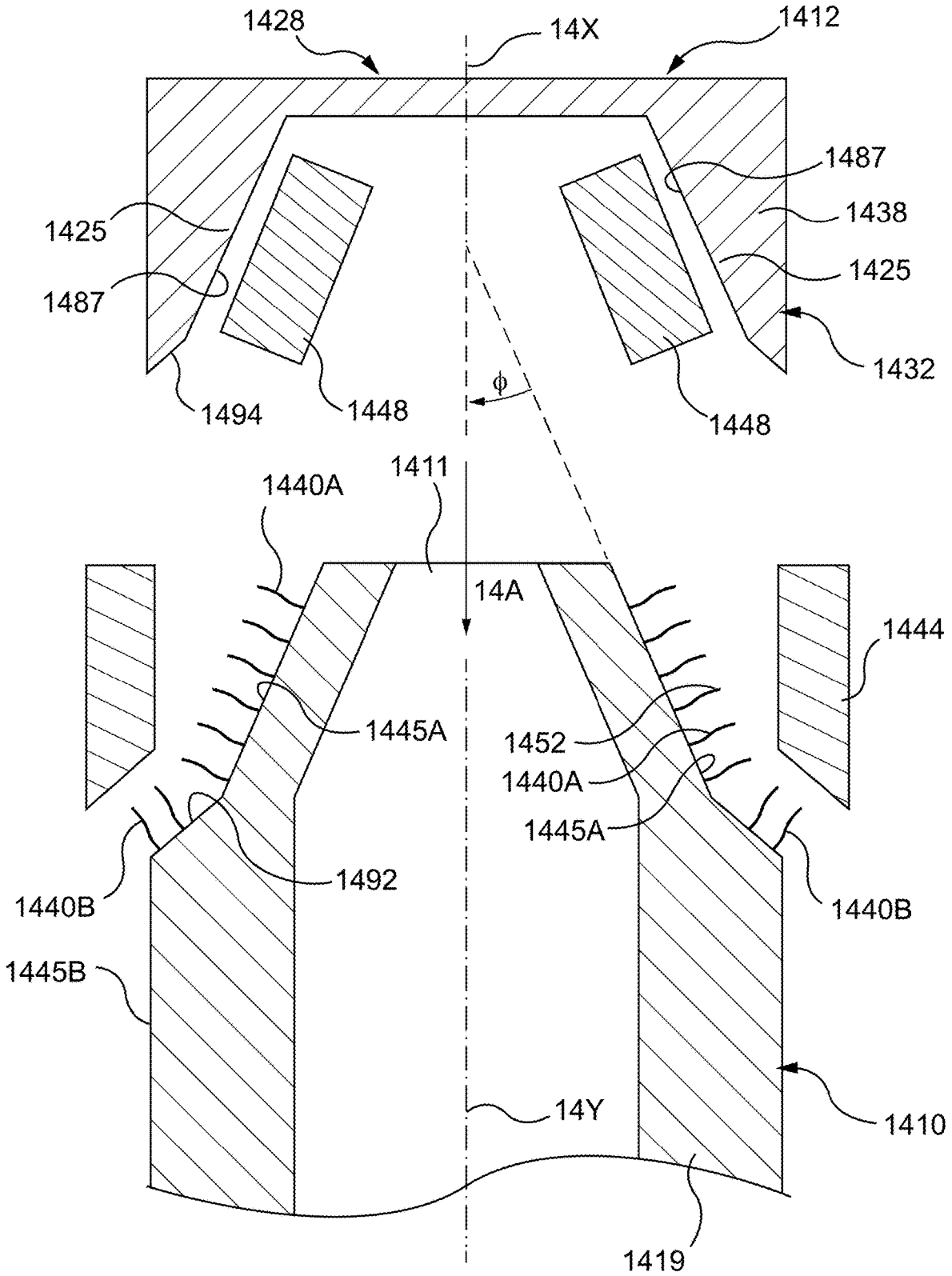
FIG. 15A is a cross-section of another embodiment of the end element of the invention and of the receptacle of the invention with an open end which the end element is formed to cover.
Figure 15B:
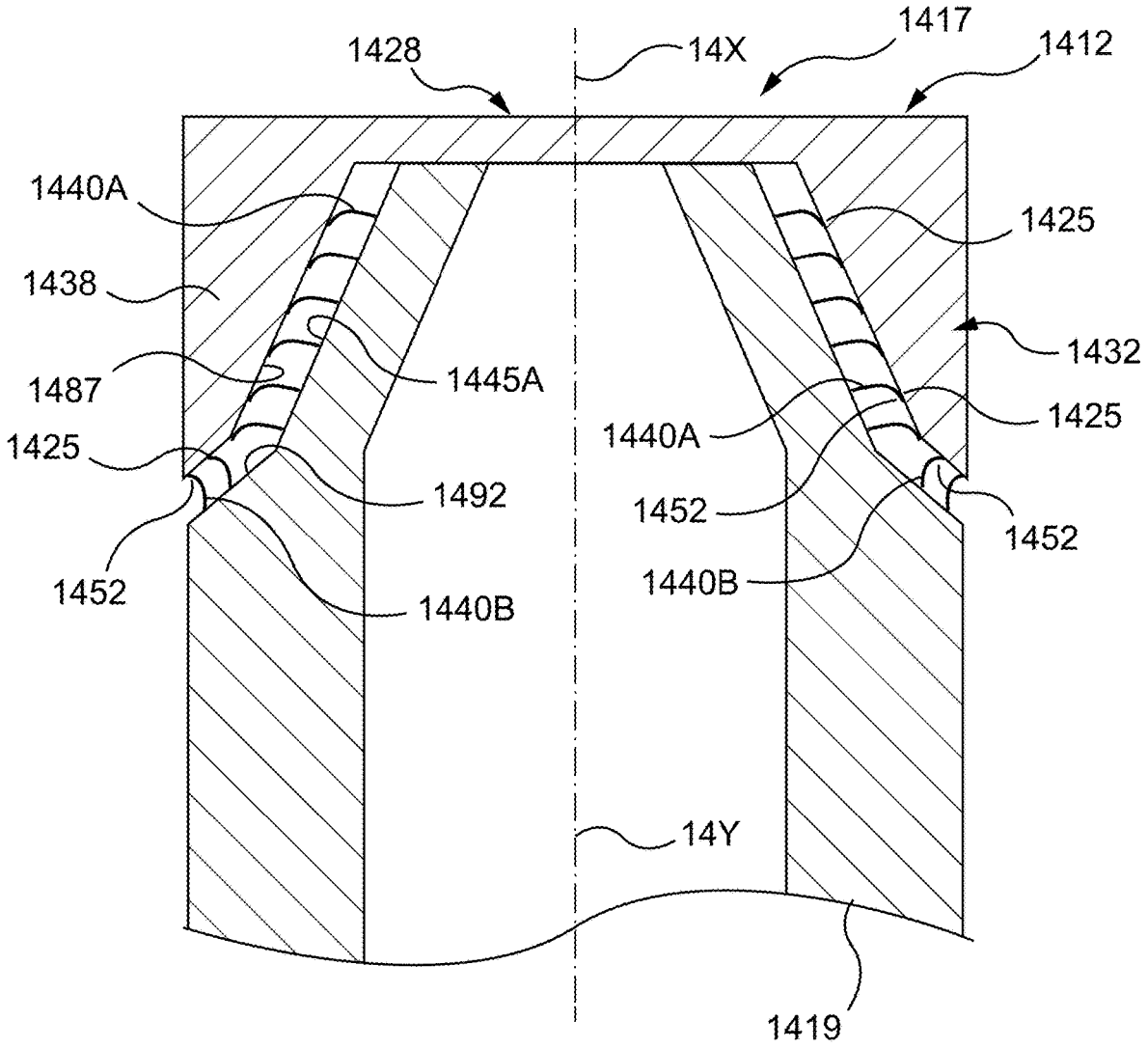
FIG. 15B is a cross-section of the end element and the receptacle of FIG. 15A with the end element covering the open end.

In one embodiment, the method of the invention includes providing a receptacle 1410 having an open end 1411 thereof and defining a receptacle axis "14Y" thereof (FIGS. 15A, 15B). The receptacle 1410 preferably includes a wall 1419 having an outer wall surface 1445A formed to define an acute angle Φ relative to the receptacle axis "14Y".

The wall 1419 preferably also includes outer wall surface fins 1440A mounted on the outer wall surface 1445A.

As can be seen in FIG. 15A, in one embodiment, the wall 1419 preferably also includes a distal outer wall surface 1445B and a stop surface 1492 located between the outer wall surface 1445A and the distal outer wall surface 1445B. Preferably, the wall 1419 also includes stop surface fins 1440B that are mounted on the stop surface 1492.

Preferably, an end element 1412 is provided that defines an end element axis "14X" thereof. The end element 1412 preferably is formed to be positioned on the receptacle 1410 for covering the open end 1411.

In one embodiment, the end element 1412 preferably includes a external portion 1428 and an internal portion 1432 (FIG. 15A). The external portion 1428 is configured to cover the open end 1411 when the end element 1412 is positioned on the receptacle 1410, as will be described.

The internal portion 1432 preferably includes a body 1438 thereof having an inner wall surface 1487 that is formed to fit over the outer wall surface 1445A and the outer wall surface fins 1440A thereon, when the end element 1412 is positioned on the receptacle 1410.

In one embodiment, the body 1438 preferably also includes an end surface 1494 thereon that is formed to fit over the stop surface 1492 and the stop surface fins 1440B thereon, when the end element 1412 is positioned on the receptacle 1410. As can be seen in FIG. 15B, when the end element 1412 is positioned to locate the inner surface 1487 to fit over the outer wall surface 1445A and the fins 1440A thereon, and to locate the end surface 1494 to fit over the stop surface 1492 and the fins 1440B thereon, the external portion 1428 at least partially covers the open end 1411.

It can also be seen in FIG. 15B that, when the end element 1412 is positioned to locate the external portion 1428 to cover the open end 1411, the inner surface 1487 preferably is parallel or substantially parallel to the outer wall surface 1445A, and the end surface 1494 preferably is parallel or substantially parallel to the stop surface 1492. As will be described, when the end element 1412 is positioned on the receptacle 1410 to cover the open end 1411, the outer wall surface fins 1440A are bent to fit between the inner wall surface 1487 and the outer wall surface 1445A.

Similarly, when the end element 1412 is positioned on the receptacle 1410 to cover the open end 1411, the stop surface fins 1440B are bent to fit between the end surface 1494 and the stop surface 1492. The internal portion 1432 preferably is configured to fit over the outer wall surface 1445A and the stop surface 1492 so as to accommodate the bent fins 1440A, 1440B therebetween. It will be understood that the distances between (i) the inner surface 1487 and the outer wall surface 1445A, and (ii) the end surface 1494 and the stop surface 1492 that are shown in FIG. 15B are exaggerated, for clarity of illustration.

As can be seen in FIG. 15A, one or more fin heating elements 1444 are provided, for heating at least an engagement part 1452 of each of the fins 1440A, 1440B. It will be understood that the engagement parts 1452 of the fins 1440A are distal to the outer wall surface 1445A. The engagement parts 1452 of the fins 1440B are distal to the stop surface 1492.

Preferably, one or more heating elements 1448 are also provided, for heating one or more preselected parts 1425 of the body 1438. It will be understood that the preselected parts 1425 are contiguous with the inner surface 1487 and extend into the body 1438.

Preferably, the receptacle 1410 and the end element 1412 are positioned to align the end element axis "14X" with the receptacle axis "14Y".

An inert (non-oxidizing) atmosphere is provided, to cover the fins 1440A, 1440B, the outer wall surface 1445A, and the stop surface 1492. Preferably, the inert atmosphere also covers the body 1438. Those skilled in the art would appreciate that the inert atmosphere preferably is held in position by a suitable cover. It will be understood that the cover is omitted from FIGS. 15A and 15B for clarity of illustration.

Next, the fin heating element 1444 preferably is energized, to heat the engagement parts 1452 to a hot working temperature, at which the engagement parts 1452 are at least partially plastically deformable. Also, the heating element 1448 preferably is energized, to heat the preselected parts 1425 to the hot working temperature, at which the preselected parts are at least partially plastically deformable.

It will be understood that the engagement parts 1452 and the preselected parts 1425 may be heated to different hot working temperatures.

When the engagement parts 1452 are at the hot working temperature and the preselected parts 1425 are also at the hot working temperature, the engagement parts 1452 and the preselected parts 1425 are urged together. Preferably, one or both of the end element 1412 and the receptacle 1410 are subjected to an engagement motion to move one or both of the end element 1412 and the receptacle 1410 relative to the other while engaged, for at least partially bonding the engagements parts and preselected parts together, to form a gastight seal between the end element 1412 and the receptacle 1410.

As described above, due to the shearing of the engagement parts 1452 and the preselected parts 1425 as a result of relative motion thereof while at the hot working temperature and while engaged, the engagement parts 1452 and the preselected parts 1425 join to form a bond therebetween in which the microstructure is substantially uniform.

To engage the engagement parts 1452 and the preselected parts 1425, one or both of the end element 1412 and the receptacle 1410 are subjected to a translocation motion. For example, the end element 1412 may be moved in the direction indicated by arrow "15A" in FIG. 15A.

While the engagement parts 1452 and the preselected parts 1425 are at the hot working temperature, the end element 1412 is subjected to the translocation motion, i.e., more in the direction indicated by arrow "15A" relative to the receptacle 1410, until an engagement surface 1442 of the end element 1412 engages an end 1415 of the receptacle 1410. As can be seen in FIG. 15B, when the engagement surface 1452 engages the end 1415 of the receptacle 1410, the end element 1412 is positioned on the receptacle 1410 to locate the external portion 1428 to cover the open end 1411.

As noted above, once the end element 1412 is so positioned on the receptacle 1410, and while the engagement parts 1452 and the preselected parts 1425 are at the hot working temperature, one or both of the end element 1412 and the receptacle 1410 are subjected to the engagement motion. Such motion may be, for example, rotation or oscillation of the end element 1412 about the end element axis "14X", or axial motion thereof. The engagement motion may commence before or after the translocation motion commences. For example, the engagement motion may commence upon engagement of the preselected parts 1425 with the engagement parts 1452. The engagement motion ceases once the end element 1412 and the receptacle 1410 are bonded together. Also, once the end element 1412 is positioned on the receptacle 1410, the end element 1412 is urged in the direction indicated by arrow "15A", until the end element 1412 and the receptacle 1410 are bonded together.

For convenience, the gastight sealed receptacle assembly (i.e., the container or receptacle 1410 with the end element 1412 bonded thereto) is identified by reference character 1417 in FIG. 15B.

It will be understood that the steps of the embodiments of the method of the invention as disclosed herein may be performed in any suitable order or sequence other than the disclosed order or sequence.

It will be appreciated by those skilled in the art that the invention can take many forms, and that such forms are within the scope of the invention as claimed. The scope of the claims should not be limited by the preferred embodiments set forth in the examples, but should be given the broadest interpretation consistent with the description as a whole.

I claim:

1. A method of closing an open end (111A) of a receptacle (110) having a wall (119) with an inner wall surface (124) defining an inner diameter (122) that defines a receptacle axis, the method comprising:

(a) providing an end element (112) defining an end element axis, the end element comprising:

an external portion (128) having at least one external portion diameter (130) greater than the inner diameter (122) of the receptacle (110);

an internal portion (132) formed for at least partial engagement thereof with the wall (119), the internal portion (132) comprising a body element (138), and at least one projecting element (140) extending radially from the body element relative to the end element axis (X) of the end element (112), said at least one projecting element comprising the engagement part (152) of the heated layer (L), said at least one projecting element at least partially defining at least one recess (141) located adjacent thereto;

(b) providing at least one heating element (144), for heating the internal portion (132);

(c) providing an inert atmosphere covering the internal portion (132) and a preselected part of the wall (119);

(d) energizing said at least one heating element (144), to heat at least one or more heated layers (L) of the internal portion (132) to a hot working temperature, at which the heated layer (L) is at least partially plastically deformable; and (e) when the heated layer (L) is at the hot working temperature, engaging at least an engagement part (152) of the heated layer (L) with at least the preselected part of the wall (119), and subjecting one or both of the receptacle (110) and the end element (112) to an engagement motion relative to the other while the engagement part and the preselected part are engaged for plastic deformation thereof, to at least partially bond the heated layer (L) and the wall (119) of the receptacle (110) together to form a gastight container assembly (127), wherein the engagement part (152) is at least partially moved into said at least one recess when said at least one projecting element is engaged with the preselected part of the inner wall surface for plastic deformation thereof.

2. A method comprising:

(a) providing a metal receptacle (1010) having a wall (1019) defining an open end (1011) and a receptacle axis (10Y) thereof;

(b) providing a metal end element (1012) defining an end element axis (10X) thereof, the end element (1012) comprising:

an internal portion (1032) formed for at least partial engagement thereof with at least one preselected part (1025) of the wall (1019), the internal portion (1032) comprising a body (1038) having an inner wall surface (1087) formed to fit over said at least one preselected part (1025) of an outer wall surface (1045) of the wall (1019), the internal portion (1032) additionally comprising a plurality of fins (1040) mounted to the inner wall surface (1087), each said fin (1040) comprising an engagement part (1052) thereof positioned distal to the inner wall surface (1087), for engagement with the outer wall surface (1045) of the receptacle (1010);

an external portion (1028) formed for covering the open end (1011) of the receptacle (1010) when the inner surface (1087) is positioned over said at least one preselected part (1025);

(c) providing at least one heating element (1048), said at least one heating element (1048) being positioned for heating the engagement parts (1052) of the fins (1040);

(d) providing at least one receptacle heating element (1044), for heating a heated wall layer (10L) of the receptacle wall (1019), the heated wall layer (10L) comprising at least one preselected part (1025) of the wall (1019);

(e) providing an inert atmosphere at least partially covering the end element (1012) and the open end (1011);

(f) energizing said at least one heating element (1048), to heat at least the engagement parts of the internal portion (1032) to a hot working temperature below the metal's melting temperature, at which the engagement parts of the internal portion (1032) are plastically deformable;

(g) energizing said at least one receptacle heating element (1044) to heat the heated wall layer (10L) to the hot working temperature, at which the heated wall layer (10L) and said at least one preselected part (1025) are plastically deformable; and (h) when the heated layer (10L) and the engagement parts of the internal portion (1032) are at the hot working temperature, engaging the engagement parts with the heated layer (10L), and subjecting one or both of the receptacle (1010) and the end element (1012) to an engagement motion relative to the other while the engagement parts and the heated layer (10L) are engaged, for plastic deformation thereof, and urging the engagement parts and said at least one preselected part (1025) against each other, to at least partially metallically bond the heated layer (10L) and the engagement parts of the internal portion (1032) together to form a gastight sealed receptacle assembly (1017), wherein upon said at least one heating element (1048) being energized, the engagement parts (1052) are heated thereby to the hot working temperature, wherein the engagement parts (1052) are plastically deformable.

3. The method according to claim 2 in which, after the engagement parts (1052) and the heated wall layer (10L) are heated to the hot working temperature, one or both of the receptacle (1010) and the end element (1012) are subjected to a translocation motion to urge the engagement parts (1052) of the fins (1040) against said at least one preselected part (1025) of the wall (1019).

4. The method according to claim 3 in which, prior to subjecting one or both of the receptacle (1010) and the end element (1012) to the translocation motion, the receptacle (1010) and the end element (1012) are positioned relative to each other to align the end element axis (10X) and the receptacle axis (10Y).

5. The method according to claim 3 in which, when the engagement parts (1052) are engaged with said at least one preselected part (1025), the end element (1012) is subjected to the translocation motion, and urged in the axial direction onto the receptacle (1010).

6. The method according to claim 5 in which the end element (1012) is subjected to the engagement motion while the end element (1012) is subjected to the translocation motion.

7. The method according to claim 3 in which the end element (1012) is subjected to the engagement motion before the engagement parts (1052) are engaged with said at least one preselected part (1025) of the wall (1019).

8. The method according to claim 2 in which the end element (1012) is rotated relative to the receptacle (1010) about the end element axis (10X) to provide the engagement motion.

9. The method according to claim 2 in which the end element (1012) is moved in the axial direction relative to the receptacle (1010) while the engagement parts (1052) are at least partially engaged with said at least one preselected part (1025) to provide the engagement motion.

10. The method according to claim 2 in which one or both of the end element (1012) and the receptacle (1010) are subjected to the translocation motion until a planar engagement surface (1042) of the end element (1012) engages an end (1015) of the receptacle (1010) that defines the open end (1011).

11. The method according to claim 10 in which the outer surface (1045) comprises a bevelled surface (1095) positioned at the end (1015) of the receptacle (1010), for engagement of the bevelled surface (1095) by the engagement parts (1052) as the end element (1012) is moved onto the receptacle (1010).

12. The method according to claim 2 in which:

the wall (1119) of the receptacle (1110) comprises a stop surface (1192);

the body (1138) comprises an end surface (1194) located at an end (1191) thereof that is distal to the external portion (1128), and the internal portion (1132) comprises a plurality of fins (1140B) mounted on the end surface (1194), wherein, when the internal portion (1132) is positioned on the end portion (1189) and the external portion (1128) engages the end (1115) of the receptacle (1110), the end surface (1194) fits over the stop surface (1192), and the fins (1140B) that are mounted to the end surface (1194) are pressed therebetween;

the method additionally comprising:

providing at least one supplementary end element heating element (1148B), for heating the engagement parts (1152) of the fins (1140B);

providing at least one receptacle heating element (1144), for heating a heated wall layer (11L) of the wall (1119), the heated wall layer (11L) comprising at least one preselected part (1125) of the wall (1119) that includes the stop surface (1192);

energizing said at least one heating element (1148B), to heat the engagement parts (1152) of the fins (1140B) to the hot working temperature, at which the engagement parts (1152) thereof are plastically deformable;

energizing said at least one receptacle heating element (1144) to heat the heated wall layer (11L) to the hot working temperature, at which the heated wall layer (11L) and said at least one preselected part (1125) are plastically deformable; and when the heated layer (11L) and the engagement parts (1152) are at the hot working temperature, engaging the engagement parts (1152) with the heated layer (11L), in said at least one preselected part (1125) and subjecting one or both of the receptacle (1110) and the end element (1112) to an engagement motion relative to the other while the engagement parts (1152) and the heated layer (11L) are engaged, for plastic deformation thereof, and urging the engagement parts (1152) and said at least one preselected part (1125) together, to at least partially metallically bond the heated layer (11L) and the engagement parts (1152) together to form a gastight sealed receptacle assembly (1117).

13. A method comprising:

(a) providing a metal receptacle (1210) having a wall (1219) defining an open end (1211) and a receptacle axis (12Y) thereof, the receptacle (1210) comprising an outer wall surface (1245) thereof, and a plurality of fins (1240) extending from a preselected portion (1247) of the outer wall surface (1245);

(b) providing a metal end element (1212) formed to cover the open end and defining an end element axis (12X) thereof, the end element (1212) comprising:

an external portion (1228);

an internal portion (1232) comprising a body (1238) having an inner wall surface (1287) wherein, when the end element (1212) is positioned to cover the open end (1211) with the external portion (1228), one or more preselected parts (1225) of the body (1238) are engaged with engagement parts (1252) of the fins (1240), the engagement parts (1252) being located distal to the outer wall surface (1245) before the end element (1212) is positioned to cover the open end (1211);

(c) providing at least one heating element (1248), said at least one heating element (1248) being positioned for heating the preselected parts (1225) of the body (1238);

(d) providing at least one fin heating element (1244), for heating the engagement parts (1252) of the fins (1240);

(e) providing an inert atmosphere that covers the open end (1211) of the receptacle (1210) and the fins (1240), and the end element (1212);

(f) with said at least one heating element (1248), heating the one or more preselected parts (1225) of the body (1238) to a hot working temperature, at which the preselected parts (1225) are plastically deformable;

(g) with said at least one fin heating element (1244), heating the engagement parts (1252) of the fins (1240) to the hot working temperature, at which the engagement parts (1252) are plastically deformable; and (h) when the engagement parts (1225) are at the hot working temperature and the one or more preselected parts are at the hot working temperature, engaging the engagement parts (1252) with the one or more preselected parts (1225), and subjecting one or both of the end element and the receptacle to an engagement motion relative to the other while the engagement parts (1252) and the one or more preselected parts (1225) are engaged, for plastic deformation thereof, and urging the engagement parts (1252) and the one or more preselected parts (1225) together, to at least partially metallically bond the engagement parts (1252) and the one or more preselected parts (1225) together, to form a gastight sealed receptacle assembly (1217).

14. The method according to claim 13 comprising:

providing the receptacle (1310) with a plurality of fins (1340B) extending from a stop surface (1392) on the receptacle (1310) that is between an end portion (1389) and an intermediate portion (1390) of the receptacle (1310), the fins (1340B) comprising respective engagement parts (1352B) thereof that are distal to the stop surface (1392);

providing a metal end element (1312) comprising an internal portion (1332) having a body (1338) comprising an end surface (1394) located at an end (1391) thereof that is distal to the external portion (1328), the body (1338) comprising preselected parts (1325B) thereof that are contiguous with the end surface (1394);

providing at least one heating element (1348), for heating the first and second preselected parts (1325A, 1325B) of the body (1338);

providing at least one receptacle heating element (1344), for heating the first and second engagement parts (1352A, 1352B);

providing an inert atmosphere at least partially covering the end element (1312) and the open end (1311);

energizing said at least one heating element (1348), to heat the preselected parts (1325A, 1325B) of the body (1338) to a hot working temperature below the metal's melting temperature, at which the preselected parts (1325A, 1325B) are plastically deformable;

energizing said at least one receptacle heating element (1344) to heat the engagement parts (1352A, 1352B) to the hot working temperature, at which the engagement parts (1352A, 1352B) are plastically deformable; and when the engagement parts (1352A, 1352B) and the preselected parts (1325A, 1325B) are at the hot working temperature, engaging the preselected parts (1325A, 1325B) with the engagement parts (1352A, 1352B) respectively and subjecting one or both of the receptacle (1310) and the end element (1312) to an engagement motion relative to the other while the engagement parts (1352A, 1352B) and the preselected parts (1325A, 1325B) are respectively engaged, for plastic deformation thereof, and urging the engagement parts (1352A, 1352B) and the preselected parts (1325A, 1325B) together respectively, to at least partially metallically bond the engagement parts (1352A, 1352B) and the preselected parts (1325A, 1325B) together respectively to form a gastight sealed receptacle assembly (1317).

15. A method according to claim 13 in which:

the wall (1419) of the receptacle (1410) has an outer wall surface (1445A) that is formed to define an acute angle (Φ) relative to the receptacle axis (14Y), the wall (1419) additionally comprising a distal outer wall surface (1445B) and a stop surface (1492) located between the outer wall surface (1445A) and the distal outer wall surface (1445B);

the method additionally comprising:

providing the receptacle (1410) with a plurality of outer wall surface fins (1440A) mounted on the outer wall surface (1445A) and a plurality of stop surface fins (1440B) mounted on the stop surface (1492), each of the outer wall surface fins (1440A) and the stop surface fins (1440B) comprising an engagement part thereof located distal to the outer wall surface (1445A) and to the stop surface (1492) respectively;

providing a metal end element (1412) defining an end element axis (14X), the end element (1412) comprising an internal portion (1432) comprising a body (1438) having an inner wall surface (1487) formed to fit over the outer wall surface (1445A) and the outer wall surface fins (1440A) mounted thereon, and an end surface (1494) formed to fit over the stop surface (1492) and the stop surface fins (1440B) mounted thereon, the body (1438) comprising at least one preselected part (1425) thereof that is contiguous with the inner wall surface (1487), located for engagement with the engagement parts (1452) when the inner wall surface (1487) is positioned over the outer wall surface (1445A) of the receptacle (1410);

providing at least one fin heating element (1444), for heating the engagement parts (1452) of the outer wall surface fins (1440A) and the engagement parts (1452) of the stop surface fins (1440B);

providing at least one heating element (1448), for heating the preselected parts (1425) of the body (1438);

providing an inert atmosphere covering the receptacle (1410) and the end element (1412);

energizing said at least one fin heating element (1444) to heat the engagement parts (1452) to a hot working temperature, at which the engagement parts (1452) are at least partially plastically deformable;

energizing said at least one heating element (1448) to heat the preselected parts (1425) to the hot working temperature, at which the preselected parts (1425) are at least partially plastically deformable; and when the engagement parts (1452) are at the hot working temperature and the preselected parts (1425) are at the hot working temperature, engaging the preselected parts (1425) with the engagement parts (1452) and subjecting one or both of the receptacle (1410) and the end element (1412) to an engagement motion relative to the other while the preselected parts (1425) and the engagement parts (1452) are engaged, for plastic deformation thereof, and urging the engagement parts (1452) and the preselected parts (1425) together, to at least partially metallically bond the engagement parts (1452) and the preselected parts (1425) together to provide a gastight sealed receptacle assembly (1417).

* * * * *